US006002381A

United States Patent [19]

Tomio et al.

[11] Patent Number: 6,002,381

[45] Date of Patent: Dec. 14, 1999

[54] PLASMA DISPLAY WITH IMPROVED REACTIVATION CHARACTERISTIC, DRIVING METHOD FOR PLASMA DISPLAY, WAVE GENERATING CIRCUIT WITH REDUCED MEMORY CAPACITY, AND PLANAR MATRIX TYPE DISPLAY USING WAVE GENERATING CIRCUIT

[75] Inventors: Shigetoshi Tomio; Yoshikazu Kanazawa; Tomokatsu Kishi; Tetsuya Sakamoto; Akira Yamamoto; Masaya Tajima; Toshio Ueda; Hirohito Kuriyama; Katsuhiro Ishida, all of Kawasaki, Japan

[73] Assignee: Fujitsu Limited, Kawasaki, Japan

[21] Appl. No.: 08/661,065

[22] Filed: Jun. 10, 1996

[30] Foreign Application Priority Data

Jan. 31, 1996 [JP] Japan ..... 8-15198
Jan. 31, 1996 [JP] Japan ..... 8-15489

[51] Int. Cl.[6] ..... G09G 3/28

[52] U.S. Cl. ..... 345/60; 345/55; 345/67

[58] Field of Search ..... 345/60, 63, 68, 345/69, 211, 55, 67, 213; 315/169.4

[56] References Cited

U.S. PATENT DOCUMENTS 5,420,602 5/1995 Kanazawa ..... 345/67
5,583,527 12/1996 Fujisaki et al. ..... 345/55
5,627,569 5/1997 Matsuzaki et al. ..... 345/214

FOREIGN PATENT DOCUMENTS 0121070 10/1984 European Pat. Off. .
0576125 12/1993 European Pat. Off. .
4284491 10/1992 Japan .

*Primary Examiner*—Richard A. Herpe
*Assistant Examiner*—Francis N. Nguyen
*Attorney, Agent, or Firm*—Greer, Burns, Crain, Ltd.

[57] ABSTRACT

A PDP not posing the problem that previous display data appears at the time of activation, and a wave generating circuit capable of generating a complex wave without the necessity of expanding a quantity of ROM data and of increasing a reading speed have been disclosed. A plasma display panel display comprising a plasma display panel that includes a plurality of cells to be selectively discharged to glow, a reset unit for bringing the plurality of cells to a given state, an addressing unit for setting the plurality of cells to states associated with display data, and a sustaining discharge unit for enabling the plurality of cells to glow according to the set states further comprises an operation halt factor detector for detecting the fact that a factor of halting the operation of the plasma display panel has occurred, and an initialization unit that when it is detected that the operation halt factor has occurred, initializes memory information in the plasma display panel. In a wave generating circuit for generating a wave on the basis of ROM data that is stored in a ROM and concerned with a wave and its generation, the ROM data is stored while being split into basic period data that changes at intervals of a basic period and long period data that changes at intervals of a long period data. The basic period data and long period data are read at intervals of associated periods and converted at intervals of associated periods.

25 Claims, 47 Drawing Sheets

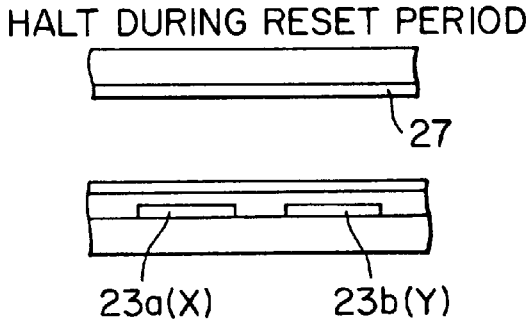
Fig. 7A
(PRIOR ART)
Fig. 7B
(PRIOR ART)
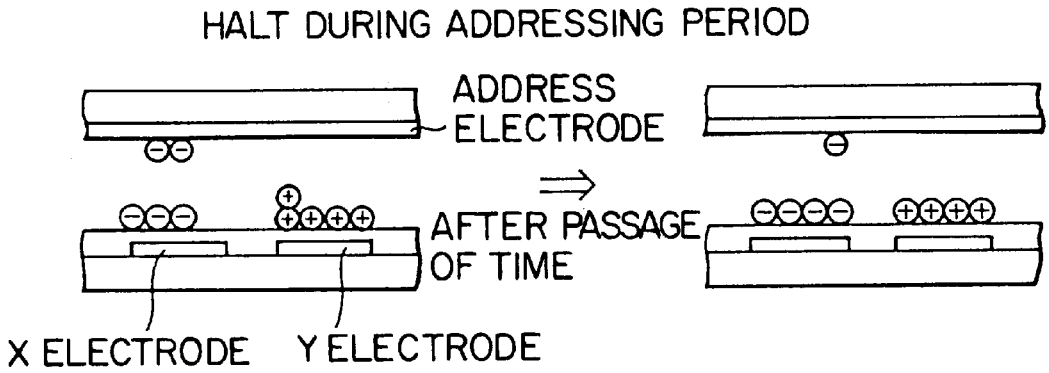
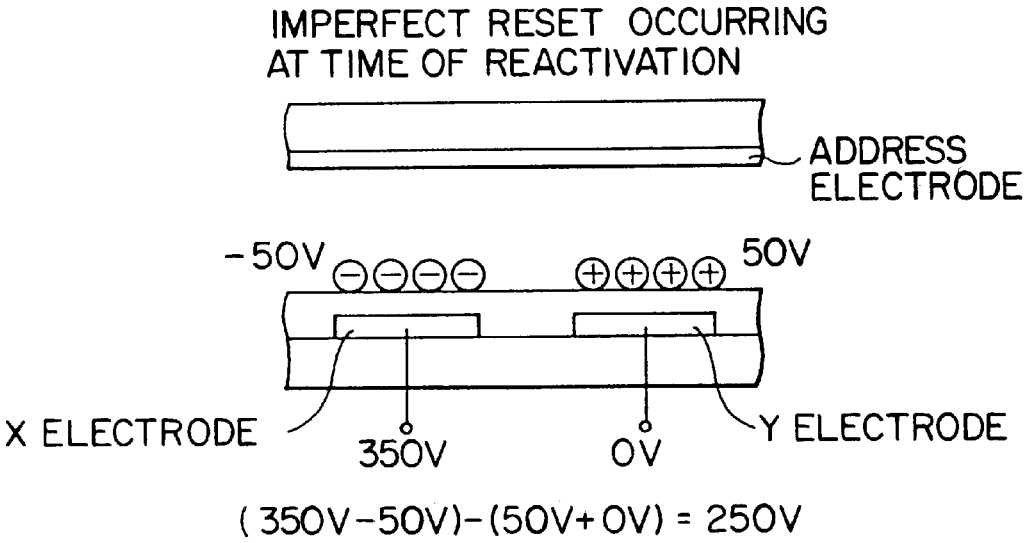
Fig. 7C
(PRIOR ART)

CUTOFF PROCESSING ROUTINE
500

503
IS RESET PERIOD IN PROGRESS ?
YES
NO
504
TERMINATE ADDRESSING WITH APPLICATION OF FULL-SCREEN WRITING PULSE WHICH IS UNDER WAY
505
IS ADDRESSING PERIOD IN PROGRESS ?
YES
2
NO
506
TERMINATE ADDRESSING WITH APPLICATION OF SELECTIVE WRITING PULSE WHICH IS UNDER WAY
EXECUTE SUSTAINING DISCHARGE BY ONE CYCLE
507
EXECUTE ERASURE
508
HALT OPERATIONS
509

ROM DATA
91
A0
D0
D7
A11
ROM
93
D0
Y0
D9
D10
D11
Y11
S
92A
D0
Q0
D9
Q9
LOAD
EN
CLK
CLK
LOAD
94
D0
Q0
D9
Q9
LATCH
CLK
CLK
LATCH
92B
Q0
Q1
Q2
CLK
CLK
95
CLK
STCEN
FREQUENCY
XLATLD
ROMLAT0~6
ROMADSEL
LOAD
LATCH
QBEN
FCLR
ΦB0~9
ΦA0~3
BLANK
Hsync
Vsync

PLASMA DISPLAY WITH IMPROVED REACTIVATION CHARACTERISTIC, DRIVING METHOD FOR PLASMA DISPLAY, WAVE GENERATING CIRCUIT WITH REDUCED MEMORY CAPACITY, AND PLANAR MATRIX TYPE DISPLAY USING WAVE GENERATING CIRCUIT

BACKGROUND OF THE INVENTION

1. Field of the Invention

The present invention relates to a display using a plasma display panel (hereinafter a PDP) in which charges remain according to a state attained when an operation is halted and the charges affect display, to a driving method for the display, to a wave generating circuit for storing data concerning a wave and its generation in a ROM, consecutively reading the stored data, and converting the data into a wave, and to a planar matrix type display including the wave generating circuit.

In recent years, earnest requests have been made for a smaller thickness, more diverse display information and conditions for installation, a larger screen, and higher definition in the field of displays. There is an increasing demand for a display meeting these requests. Thin displays fall into various types which are represented by an LCD, fluorescent character display tube, EL, PDP, and the like. Among these thin displays, a display using a PDP is, above all, drawing attention because of its superb characteristics such as no flicker, ease in making the screen thereof larger, high luminance, a long service life, and the like.

2. Description of the Related Art

In a triple-electrode surface-discharge PDP, after writing is performed so that discharge selectively occurs according to display data between address electrodes and a second electrode which constitute pixels, a common sustaining discharge signal is applied between a first electrode and the second electrode so that sustaining discharge is performed at the pixels that have been discharged during writing, and thus display is achieved. During sustaining discharge, a pulsating signal is applied to the first and second electrodes a plurality of times with the polarity thereof alternated at every application. Discharge is therefore performed for a number of pulses, whereby the brightness of display is defined. After sustaining discharge is completed, a reset is executed in order to bring all pixels to the same state. Thereafter, the above operation is repeated in order to achieve display. In this kind of PDP display, a microcomputer is generally used for the above control operation. When a power switch is turned on, the microcomputer executes initialization in the same manner as an ordinary one. First, self-erasure accompanied by application of a full-screen pulse and sustaining discharge are repeated for several cycles. Thereafter, repetition of a cycle of normal reset, addressing, and sustaining discharge is started.

For driving a PDP, a large power at a voltage that is higher than the voltage needed for a logic circuit including a microcomputer is necessary. A power supply for the PDP is therefore separate from a power supply for the logic circuit. A large-capacitance capacitor or the like that withstands a high voltage is used to stabilize the power supply for the PDP. Therefore, when a power switch is turned off, the voltage of the power supply for the PDP decreases more slowly than that of the power supply for the logic circuit. When the voltage of the logic circuit power supply reaches a level not permitting the logic circuit to operate, outputting control signals cease. The PDP halts in an immediately preceding state. In other words, the state in which the PDP halts is determined according to the timing of stopping the supply of power, but the halt state is not finalized. Since the halt of the PDP is not finalized, the states of cells in the PDP, or more particularly, the states of wall charges vary depending on whether a state immediately before the halt is a reset period, addressing period, or sustaining discharge period. Depending on the halt state, charges remain on the surface of a dielectric membrane. If the cells are left in this state for a prolonged period of time, the gas in the cells is re-bonded with wall charges and neutralized. However, negative and positive wall charges remain on X electrodes and Y electrodes respectively. When these kinds of residual charges exist, there arises a problem that a reset is not achieved normally and an erased state is not attained. When a state preceding a reset period is not erased, normal discharge is not achieved during a succeeding addressing period and sustaining discharge period. Previous display data is displayed until full-screen writing is executed again during a reset period succeeding the sustaining discharge period in order to achieve erasure. When the previous display data is displayed, a problem that an observer of the PDP is given a quite peculiar feeling occurs.

It is conceivable that even if charges remain at the time of a halt, discharge for full-screen erasure is executed reliably by raising the voltage of a full-screen writing pulse. For this purpose, the ability of a cell structure and drive circuit to withstand a high voltage must be improved. This poses a problem that the scale of circuitry increases.

In the aforesaid operations, a pulsating signal is applied between electrodes in order to trigger discharge. As a circuit for generating this kind of pulsating signal, the use of a circuit that stores data representing a signal concerning a wave and its control in a ROM in units of a basic period of wave generation, reads the data consecutively from the ROM, and thus generates the wave is adopted widely. Single reading may not be able to provide a required quantity of data. In this case, data whose cycle is a basic period is split into a plurality of items and then stored. Reading is performed a plurality of times during each basic period so that a required quantity of data can be output.

The present applicant has disclosed, in Japanese Unexamined Patent Publication (Kokai) No. 4-284491, a driving wave generating circuit that is dedicated to a PDP display and that includes a ROM. As a driving method for achieving gray-scale display in a PDP display, a multiple addressing method is adopted generally. According to the multiple addressing method, one display frame is divided into a plurality of subframes; sustaining periods within the subframes, which determine an effective luminance, are set to have a given ratio; and gray-scale data is displayed during subframes, which are weighted differently according to gray-scale levels; thus gray-scale display is achieved. A driving wave and control signals to be applied during one subframe are stored in the ROM. The length of a sustaining period is defined by the repetition frequency of a repetitive component of the driving wave.

In the field of PDP displays, the necessity of controlling driving of a panel by drivers more precisely has been discussed in an effort to further improve display quality and upgrade durability. It is therefore required to produce a more precise driving wave that is supplied to each driver. However, for producing a driving wave more precisely, the storage capacity of a ROM must be expanded and a quantity of data to be read from the ROM during a basic period must be increased. This means that the speed of reading data from the ROM must be raised. However, when an effort is made to raise the speed of reading the ROM, it becomes necessary to use a high-speed ROM. This poses a problem that the cost of a ROM increases. As far as the PDP display is concerned, therefore, a method to produce precise driving waves readily has not been realized.

This situation is not limited to a wave generating circuit used for a PDP display. The same applies to a wave generating circuit used for any other purpose. The foregoing problems occur in common when an attempt is made to produce precise waves.

SUMMARY OF THE INVENTION

The present invention attempts to solve the foregoing problems. The first object of the present invention is to realize a PDP display in which such a problem as previous display data is displayed at the time of activation does not occur. The second object of the present invention is to realize a wave generating circuit capable of generating a complex wave without the necessity of increasing a quantity of ROM data or of raising a reading speed, and to adapt the wave generating circuit to a PDP display so that a driving wave can be produced more precisely without the necessity of increasing the cost of the wave generating circuit.

A plasma display in accordance with the first mode of the present invention is a plasma display panel display comprising a plasma display panel including a plurality of cells that are selectively discharged to glow, a reset means for bringing the plurality of cells to a given state, an addressing circuit for setting the plurality of cells to states associated with display data, and a sustaining discharge circuit for enabling the plurality of cells to glow according to the set states. The plasma display panel display further comprises an operation halt factor detecting circuit for detecting the fact that a factor of halting the operation of the plasma display panel has occurred, and an initializing circuit that when it is detected that the operation halt factor has occurred, initializes memory information in the plasma display panel.

A driving method for a plasma display in accordance with the first mode of the present invention is a driving method for a plasma display panel including a plurality of cells that are selectively discharged to glow, comprising a reset step of bringing the plurality of cells to a given state, an addressing step of setting the plurality of cells to states associated with display data, and a sustaining discharge step of enabling the plurality of cells to glow according to the set states. The driving method for a plasma display panel further comprises an operation halt factor detecting step of detecting the fact that a factor of halting the operation of the plasma display panel has occurred, and an initializing step of initializing memory information in the display panel when it is detected that the operation halt factor has occurred.

In the plasma display in accordance with the first mode of the present invention, when an operation halt factor such as a voltage drop in power to be supplied to the display occurs, after memory information in the display panel is initialized, a halt occurs. Consequently, the state at the time of a halt is a state in which if a reset is executed, discharge for full-screen erasure can be achieved reliably. Such a problem as previous display data appears will not occur.

Power supply stop is, as mentioned above, thought of as an operation halt factor. As far as an existing PDP is concerned, display data that does not require full-screen discharge is written in power save mode in order not to decrease a reactivation speed. In the future, further power saving will presumably be attempted by stopping the power supply to the PDP despite a decrease in reactivation speed. In this case, it is probable that a halt signal is output from a main unit to the PDP and an operation halt factor detecting circuit will detect this halt signal.

When a factor of halting the operation of the plasma display panel occurs, the subsequent setting of the plurality of cells in states associated with display data may be inhibited, or the setting of the plurality of cells in states associated with display data may be inhibited after the passage of a wait time from when the operation halt factor occurs until the first reset is executed. If it is in the midst of addressing or sustaining discharge when the factor of halting the operation of the plasma display panel occurs, initialization may be executed forcibly by applying an erasure pulse used to erase the residual charges from the plurality of cells. If it is in the midst of addressing when the operation halt factor occurs, it is preferred that initialization is executed after sustaining discharge is performed at least by one cycle.

Initialization is achieved by executing self-erasure discharge for which the voltage of an erasure pulse is set high, or by executing short-duration erasure for which the voltage of an erasure pulse is set on a level with the one set for sustaining discharge, and in which after application of an erasure pulse is stopped, charges on a wall surface and charges of gas are neutralized in each cell, or by executing long-duration erasure in which after application of an erasure pulse is stopped, the wall voltage in each cell is determined with the application voltage of an erasure pulse.

A wave generating circuit in accordance with the second mode of the present invention is a wave generating circuit comprising a wave/control signal ROM for storing ROM data concerning a wave and its generation, a ROM data reading circuit for reading ROM data consecutively from the wave/control signal ROM, and a ROM data converting circuit for producing a wave continually on the basis of the ROM data read by the ROM data reading circuit. The wave/control signal ROM stores ROM data split into basic period data that changes at intervals of a basic period (data stored in areas A, B, and C) and long cycle data that changes at intervals of a long period that is an integral multiple of the basic period (data stored in areas D and E). The ROM data reading circuit reads the basic period data and long period data at intervals of associated periods. The ROM data converting circuit converts the basic period data and long period data, which are read by the ROM data reading circuit, at intervals of associated periods.

The ROM data concerning a wave and its generation generally includes not only data whose cycle is a basic period but also data whose cycle is a long period that is longer than the basic period. In the past, all data including the long period data has been stored as basic period data, and then read at intervals of a basic period in order to generate a wave. However, the long period data need not be stored as basic period data and read at intervals of a basic period. The long period data should be stored as long period data whose cycle is matched with a long period, and then read at intervals of the long period. The wave generating circuit in accordance with the present invention splits ROM data into basic period data and long period data, stores the basic period data and long period data independently, reads the basic period data and long period data at intervals of times corresponding to associated periods, and then performs conversion. Assuming that a quotient of a long period by a basic period is X, a storage capacity required to store long period data is a 1/X of that required to store the data at interval of a basic period. A period at intervals of which the ROM reading circuit reads long period data is X times longer than a reading period at intervals of which data stored as basic period data is read. A reading frequency for the long period data is a 1/X of that for the basic period data. Consequently, the storage capacity and reading speed of the wave/control signal ROM can be minimized.

A long period may be any integral multiple of a basic period. Moreover, the long period is not limited to one value. For example, there may be two kinds of long period data whose cycles are twice and three times longer than the basic period. Thus, there may be a plurality of long periods.

Herein, reading is executed most efficiently when a reading frequency by which the ROM data reading circuit reads ROM data from the wave/control signal ROM agrees with a sum of a value calculated by multiplying a frequency of reading basic period data during a basic period by X and a frequency of reading long period data during a long period. In any other case, the ROM data reading circuit must suspend reading; that is, thin out data.

For generating the same wave, when a wave is generated by repeatedly reading part of ROM data stored in the wave/control signal ROM, a minimum unit of a portion of the ROM data corresponding to a repetitive component of a wave that can be generated by repeatedly reading the same data is stored together with data indicating the start and end of the repetitive component and data representing a repetition frequency. The ROM data reading circuit identifies the data indicating the start and end of the repetitive component and the data representing a repetition frequency, and repeats reading of the data corresponding to the repetitive component by the repetition frequency.

In this case, when the repetitive component is in phase with long period data, the portion of the ROM data corresponding to the repetitive component should merely be read repeatedly and there is no problem in particular. However, when the repetitive component is out of phase with the long period data, a problem occurs and that when all the portions of the ROM data that must be output at the start of the repetitive component are read, output cannot be performed in time, and a problem that the cycle of reading ROM data lags. When all the required portions of the ROM data is read, its output cannot be performed in time, a portion of the ROM data coincident with the start of a repetition period is stored, and the stored portion of the ROM data is used at the time of returning from the end of repetition to the start thereof.

BRIEF DESCRIPTION OF THE DRAWINGS

The present invention will be more clearly understood from the description as set below with reference to the accompanying drawings, wherein:

FIGS. 7A to 7C are diagrams for explaining the occurrence of an imperfect reset according to a state set at the time of completion of an operation;

DESCRIPTION OF THE PREFERRED EMBODIMENTS

Figure 1:
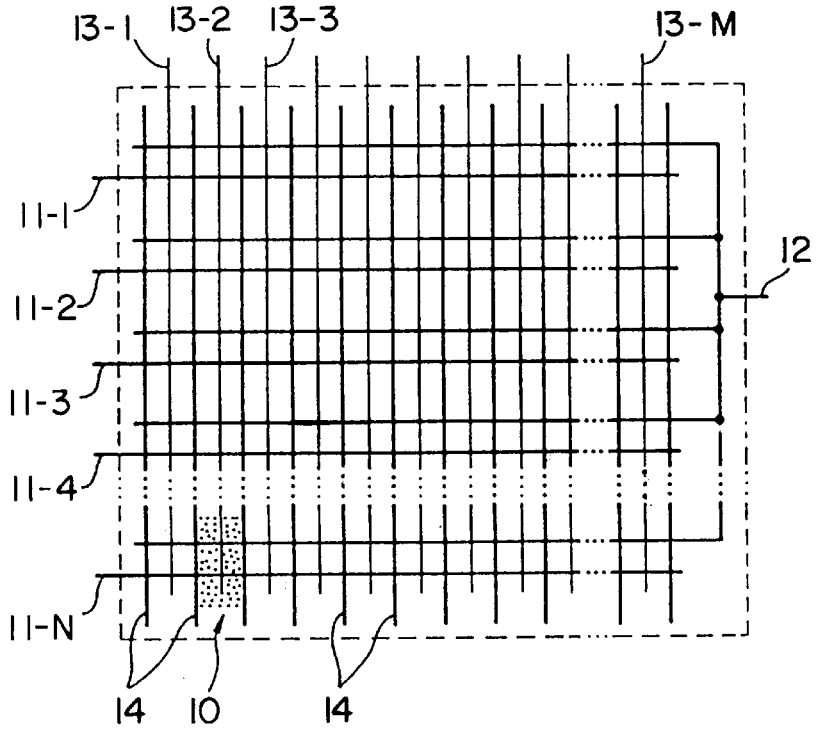
Fig. 1 (PRIOR ART)
FIG. 1 is a schematic plan view of a triple-electrode surface-discharge AC type PDP.

Before proceeding to a detailed description of the preferred embodiments of the present invention, prior art plasma displays such as those in U.S. Pat. Nos. 5,583,527, and 5,420,602 will be described, with reference to the accompanying drawings thereto, for a clearer understanding of the differences between the prior art and the present invention.

PDPs are available as a dual-electrode type in which two kinds of electrodes perform selective discharge (addressing discharge) and sustaining discharge, and a triple-electrode type in which the third electrodes are used to perform addressing discharge. In a color PDP performing gray-scale display, phosphors formed in discharge cells are excited by means of ultraviolet rays stemming from a discharge. The phosphor has a drawback that it is susceptible to the impact of ions that are positive charges also stemming from the discharge. The dual-electrode type has a structure in which the phosphors are hit directly by ions. There is a fear that the service life of the phosphor may be shortened. To avoid this shortening, the color PDP generally adopts a triple-electrode structure utilizing surface discharge. Furthermore, the triple-electrode type is classified into a type in which the third electrodes are formed on a substrate on which the first and second electrodes responsible for sustaining discharge are mounted and a type in which the third electrodes are mounted on another substrate opposed to the substrate containing the first and second electrodes. Moreover, the type in which the three kinds of electrodes are formed on the same substrate is classified into a type in which the third electrodes are placed on the two kinds of electrodes responsible for sustaining discharge and a type in which the third electrodes are placed under the two kinds of electrodes. Furthermore, visible light emanating from a phosphor may be seen as light transmitted by the phosphor (transparent type) or may be seen as light reflected from the phosphor (reflective type). Spatial coupling of a cell to be discharged with an adjoining cell is disconnected by a rib or barrier. The rib or barrier may be formed in four ways in order to enclose a discharge cell and perfectly seal the cell. Alternatively, the rib or barrier may be formed in only one way, and coupling of the cell in any other way is disconnected by optimizing the gap between the cell and another cell.

The present invention can apply to any type of plasma display panel (PDP), but especially effectively applies to a triple-electrode type in which a problem of imperfect display caused by residual charges is likely to occur. Herein, the description will proceed by taking for instance a reflective type panel in which the third electrodes are formed on a substrate opposed to a substrate containing electrodes responsible for sustaining discharge, each barrier is formed only in a vertical direction (that is, each barrier is orthogonal to a first electrode and second electrode and parallel to third electrodes), and part of each sustaining electrode is formed with a transparent electrode.

Figure 2:
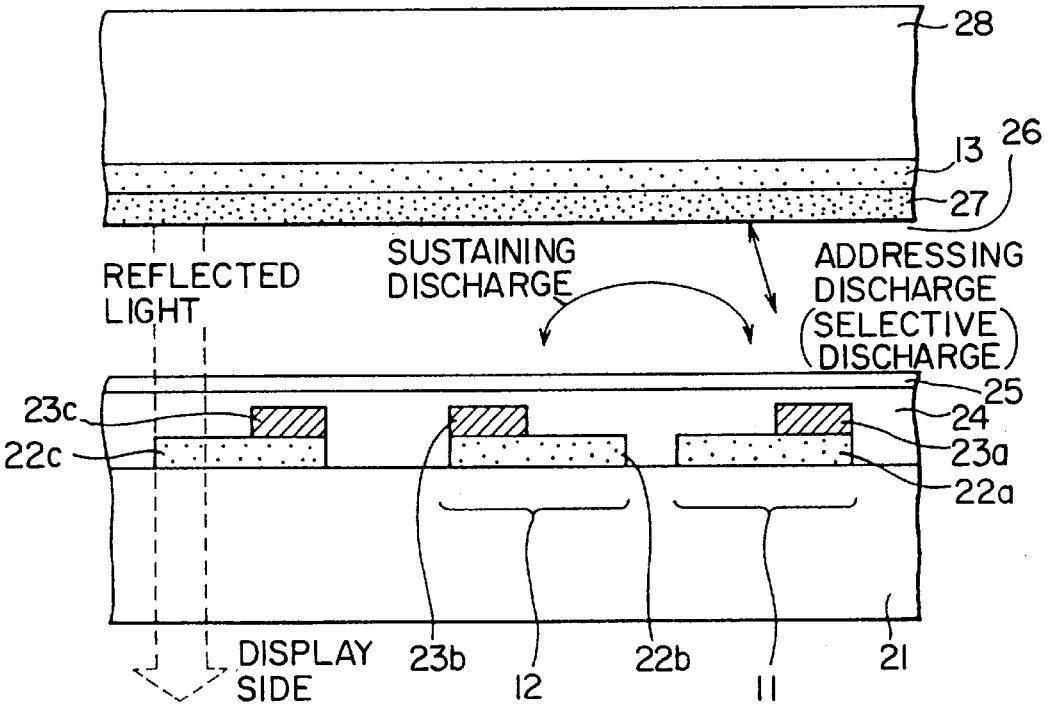
Fig. 2 (PRIOR ART)
FIG. 2 is a schematic sectional view of the triple-electrode surface-discharge AC type PDP.
Figure 3:
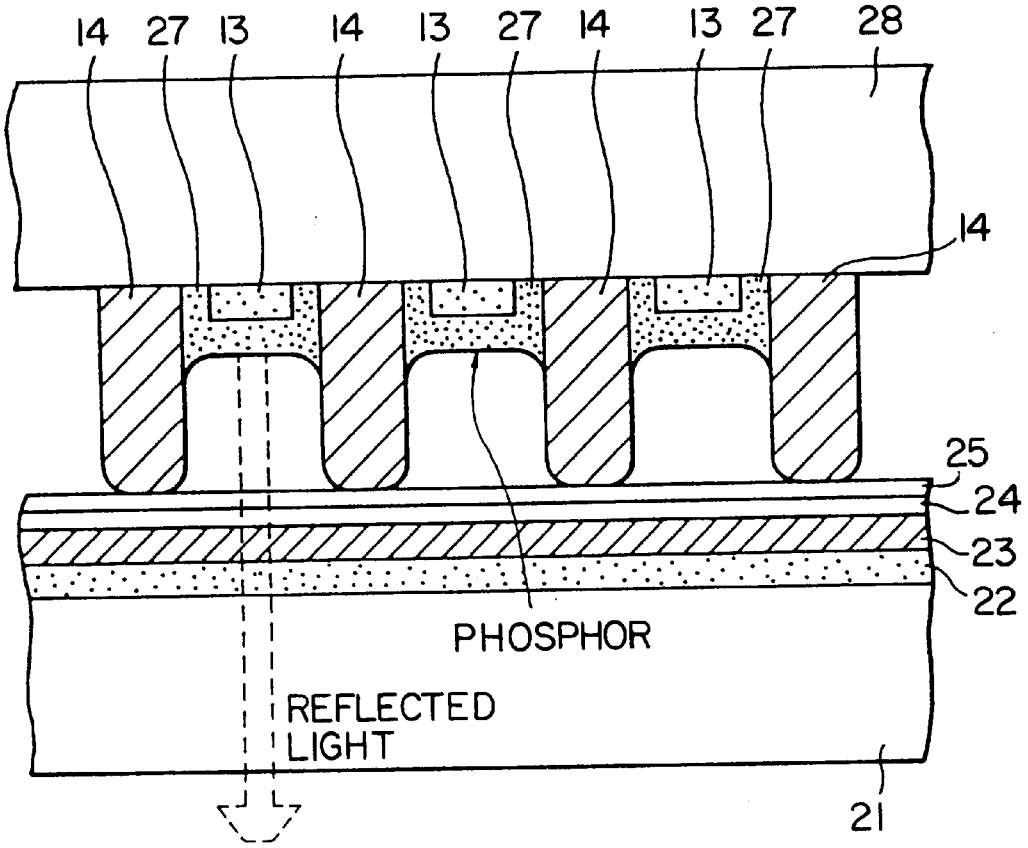
Fig. 3 (PRIOR ART)
FIG. 3 is a schematic sectional view of the triple-electrode surface-discharge AC type PDP.

Shown in the schematic plan view of FIG. 1 is a known triple-type surface-discharge PDP. FIG. 2 is a schematic sectional view (vertical direction) of one cell in the panel shown in FIG. 1. FIG. 3 is a schematic sectional view showing the cell in a horizontal direction. In the drawings referred to below, the same functional components will be assigned the same reference numerals.

A panel is composed of two glass substrates 21 and 28. The first substrate 21 has a first electrode (X electrode) 12 serving as parallel sustaining electrodes and second electrodes (Y electrodes) 13. These electrodes are formed with transparent electrodes 22*a* and 22*b* and bus electrodes 23*a* and 23*b*. The transparent electrode fills the role of transmitting light reflected from a phosphor and is therefore formed with an ITO (transparent conducting membrane made mainly of indium oxide) or the like. The bus electrode must be formed to have a low resistance in order to prevent a voltage drop caused by electrical resistance, and is therefore made of chrome (Cr) or copper (Cu). Furthermore, the electrodes are covered with a dielectric layer (glass) 24. A magnesium oxide (MgO) membrane 25 is formed as a protective membrane on a discharge side. Third electrodes (address electrodes) 13 are formed on the second substrate 28 opposed to the first glass substrate 21 so that the third electrodes are orthogonal to the sustaining electrodes. A barrier 14 is formed between each pair of the address electrodes. A phosphor 27 covering each address electrode and having the characteristic of glowing in red, green, and blue is formed between each pair of the barriers 14. The two glass substrates are assembled so that the ridges of the barriers 14 come into contact with the MgO surface 25. Spaces defined by the phosphors 27 and MgO surface 25 are discharge spaces 26.

Figure 4:
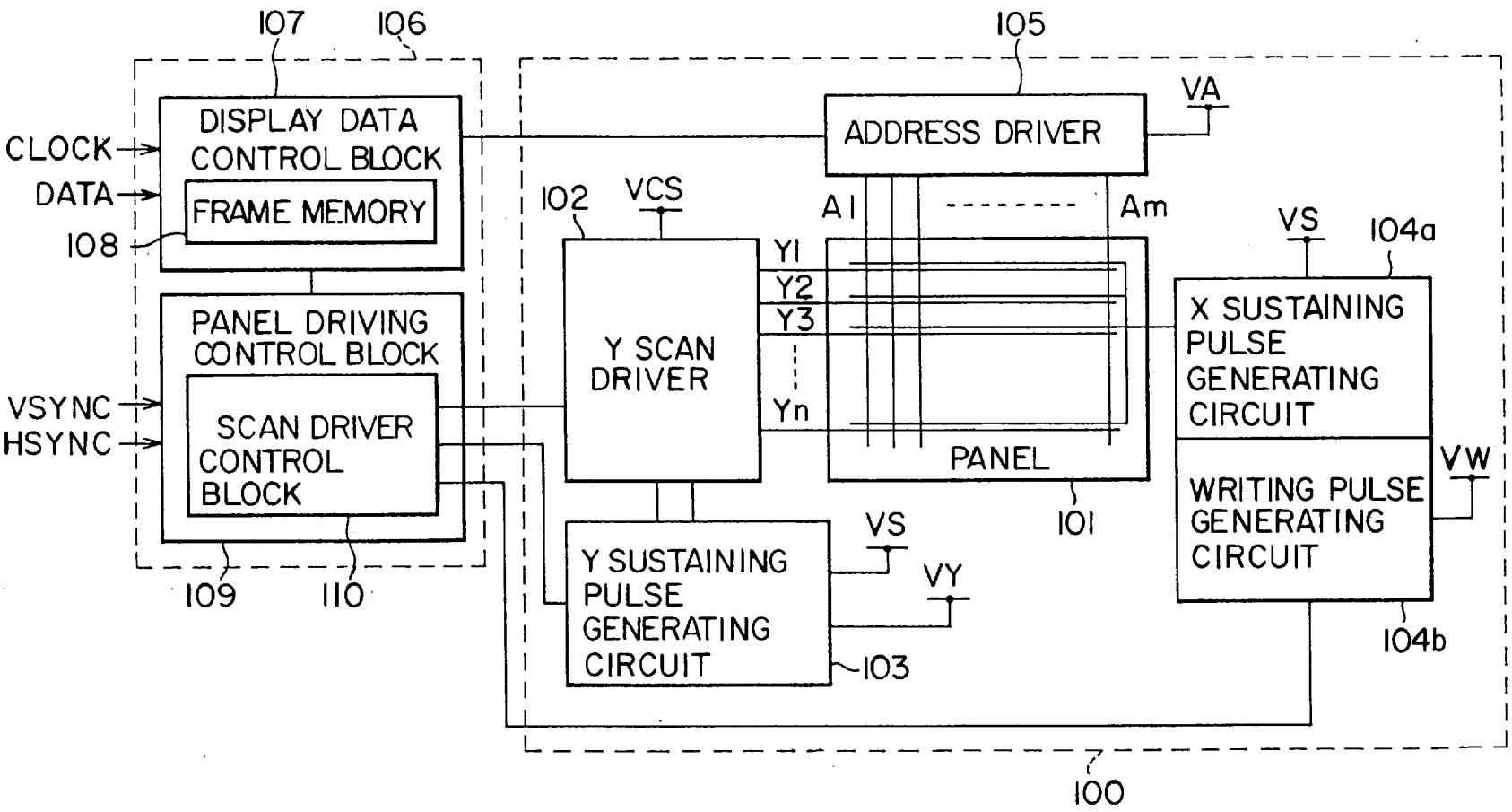
Fig. 4 (PRIOR ART)
FIG. 4 is a block diagram of a drive circuit for the triple-electrode surface-discharge AC type PDP.

FIG. 4 is a schematic block diagram showing peripheral circuits for driving the PDP shown in FIGS. 1 to 3. The address electrodes 13-1, 13-2, etc. are connected one by one to an address driver 105. The address driver 105 applies an addressing pulse during addressing discharge. The Y electrodes Y1, Y2, etc. are connected to a Y scan driver 102. The Y scan driver 102 is connected to a Y sustaining pulse generating circuit 103. During addressing discharge, a pulse is generated by the Y scan driver 102, and a sustaining pulse or the like is generated by the Y sustaining pulse generating circuit 103. The generated pulse is then applied to the Y electrodes via the Y scan driver 102. The X electrode 12 is connected in common along all display lines on the panel. An X sustaining pulse generating circuit 104 generates a writing pulse, sustaining pulse, and the like. The X sustaining pulse generating circuit 104*a* is connected to a writing pulse generating circuit 104*b*. A sustaining discharge pulse is generated by the X sustaining pulse generating circuit 104*a*. A writing pulse used for reset is generated by the writing pulse generating circuit 104*b*, and applied to the X electrode via the X sustaining pulse generating circuit 104*a*. These drivers are controlled by a control unit 106. The control unit is controlled by sync signals (VSYNC, HSYNC, and CLOCK) and a display data signal (DATA) which are input externally to the display.

Figure 5:
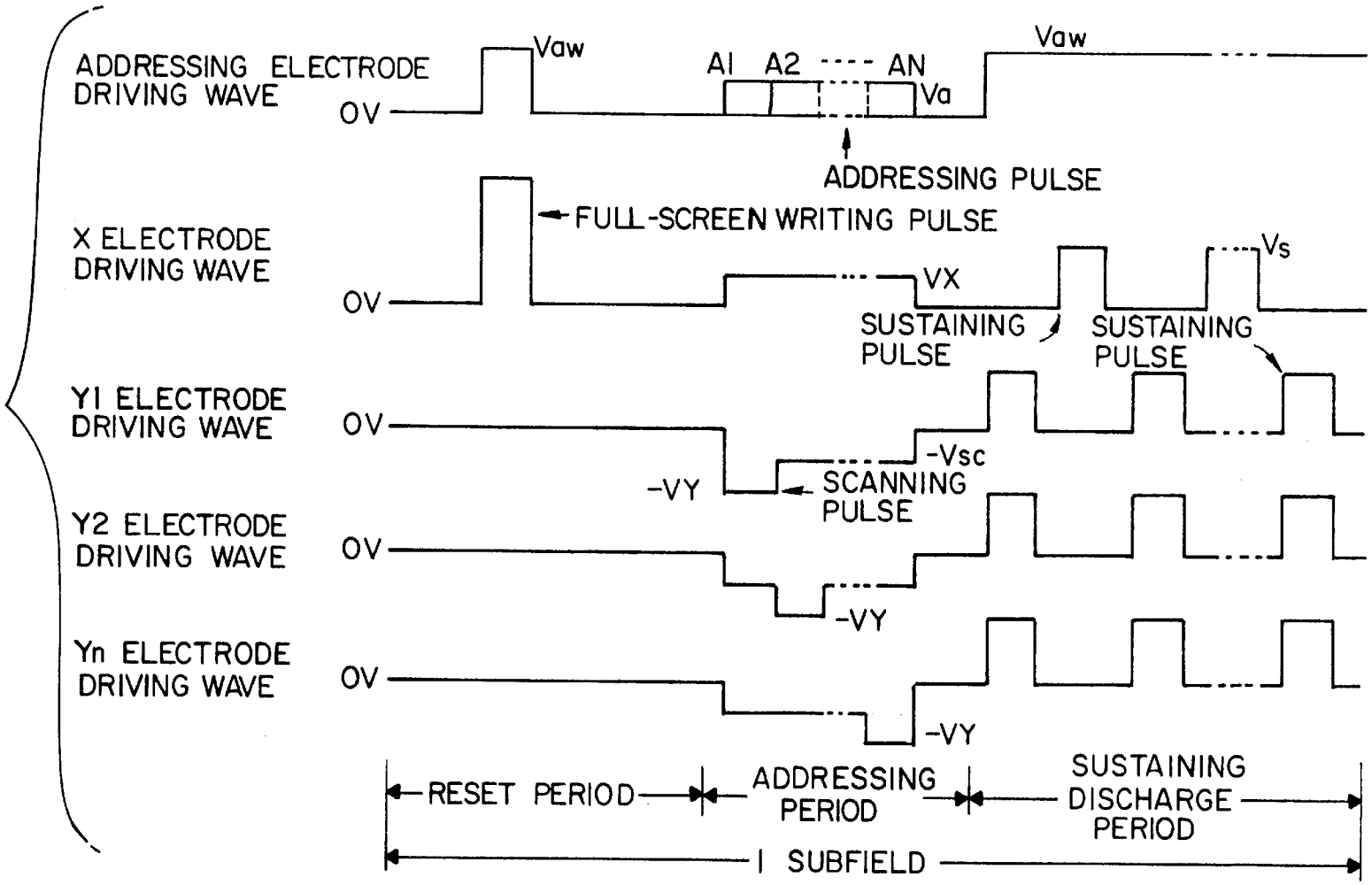
Fig. 5 (PRIOR ART)
FIG. 5 is a diagram showing known driving waves.

FIG. 5 is a waveform diagram showing a known method of driving the PDP shown in FIGS. 1 to 3 using the circuits shown in FIG. 4. FIG. 5 shows driving waves applied during one subfield according to a so-called known "addressing/sustaining discharge separated type writing addressing system." In this example, one subfield is divided into a reset period, addressing period, and sustaining discharge period. During the reset period, first, all the Y electrodes are driven to be 0V. At the same time, a full-screen writing pulse of a voltage Vs+Vw (approximately 330V) generated by the writing pulse generating circuit 104*b* is applied to the X electrode. All cells constituting all display lines are discharged irrespective of the previous display state. At this time, the potential at the address electrodes is approximately 100V (Vaw). Thereafter, the potentials at the X electrode and address electrodes are lowered to 0V. The voltages of the wall charges themselves in all the cells exceed a discharge start voltage, whereby discharge is started. The discharge causes self-neutralization and ceases. This is called a self-erasure discharge. The self-erasure discharge brings the states of all the cells in the panel to a homogeneous state with no wall charge. The reset period exerts the effect of bringing all the cells to the same state irrespective of the glowing state during the preceding subfield. The reset is executed in order to achieve the succeeding addressing (writing) discharge in a stable manner.

Next, during an addressing period, addressing discharge is executed line-sequentially in order to turn on or off the cells according to display data. First, a scanning pulse of a −VY level (approximately −150V) is applied to the Y electrodes. At the same time, an addressing pulse of a voltage Va (approximately 50V) is applied selectively to the address electrodes specifying the cells to be enabled to glow. Discharge occurs between each pair of the address electrodes and a Y electrode which specify the cells to be enabled to glow. This discharge acts as priming and causes the X electrode (voltage Vx=50V) and Y electrode to discharge. Consequently, a quantity of wall charge permitting sustaining discharge is accumulated on the MgO surface over the electrodes.

Thereafter, the same operation is performed on the other display lines. New display data is then written on all the display lines.

Thereafter, when a sustaining discharge period starts, a sustaining pulse of a voltage Vs (approximately 180V) is applied alternately to the Y electrodes and X electrode. Sustaining discharge is then executed. Image display for one subfield is carried out. At this time, a voltage Vaw of approximately 100V is applied to the address electrodes in order to prevent discharge from occurring between the address electrodes and X electrode or Y electrodes.

In the "addressing/sustaining discharge separated type writing addressing system," a brightness of display is determined by the length of a sustaining discharge period that is, the number of sustaining pulses.

Figure 6:
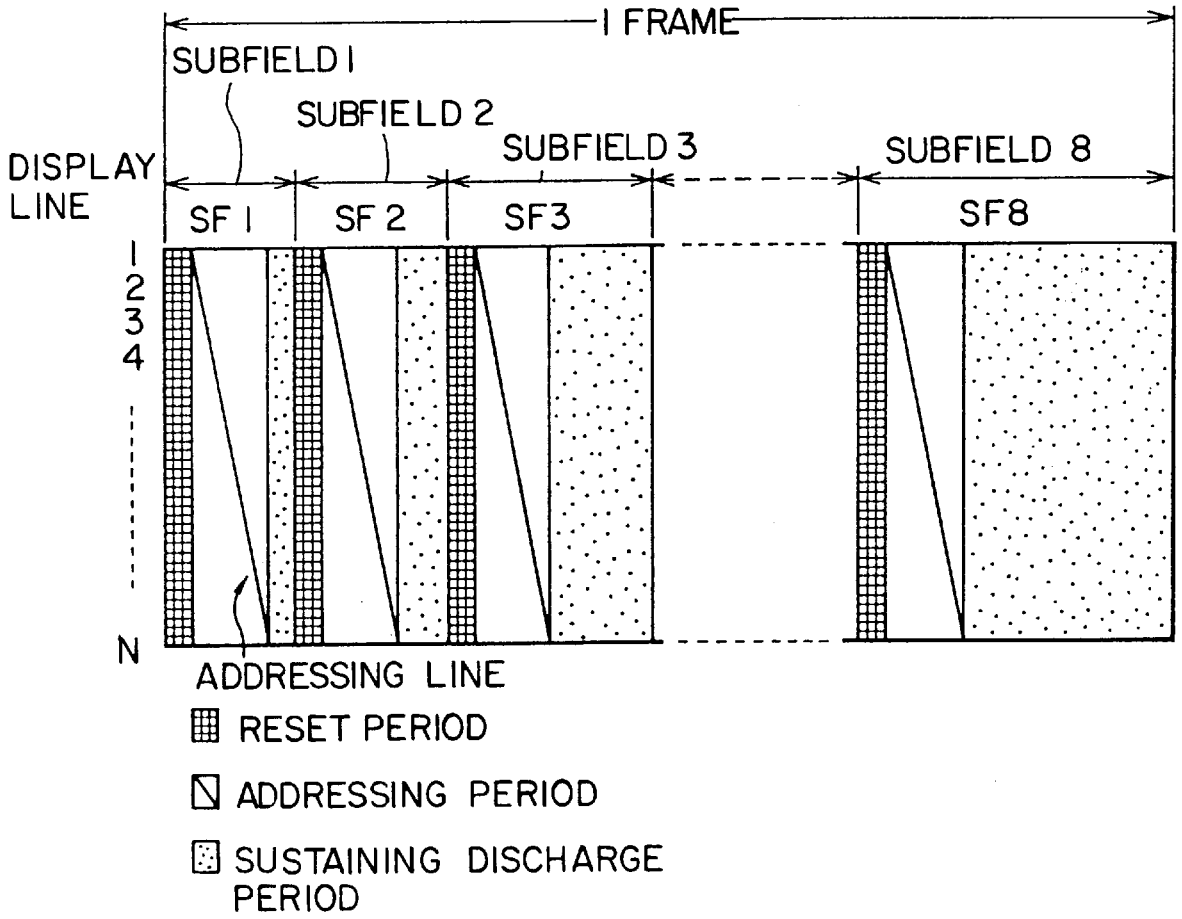
Fig. 6 (PRIOR ART)
FIG. 6 is a timing chart concerning an addressing/sustaining discharge separated type addressing system for enabling a PDP to perform gray-scale display.

In a PDP display, one screen is displayed during one frame. One frame is divided into a plurality of subframes that are weighted differently to have different lengths. Bits of a bit data stream constituting gray-scale data are displayed during subframes to which corresponding weights have been applied, whereby gray-scale display is achieved. More particularly, a driving method used for 256-level gray-scale display is shown as an example of multilevel gray-scale display in FIG. 6. In this example, one frame is divided into eight subframes SF1 to SF8. Reset periods and addressing periods within these subframes SF1 to SF8 have the same lengths. The lengths of sustaining discharge periods have the ratio of 1:2:4:8:16:32:64:128. A difference in luminance among 256 gray-scale levels from level 0 to 255 can be displayed by selecting the subframes during which each cell is enabled to glow.

A general PDP display has been summarized so far. This kind of PDP display usually employs a microcomputer for performing the aforesaid control operations. When a power switch is turned on, the microcomputer performs initialization in the same manner as an ordinary microcomputer does. First, self-erasure accompanied by application of a full-screen writing pulse and sustaining discharge are executed by several cycles. Thereafter, repetition of the normal cycle of reset, addressing, and sustaining discharge shown in FIG. 5 is started.

Moreover, a large power with a voltage higher than that needed for logic circuits including a microcomputer is needed for driving a PDP. A power supply for the PDP and a power supply for the logic circuit are installed separately. A large-capacitance capacitor that withstands a high voltage is used to stabilize the power supply for the PDP. Due to this structure, when a power switch is turned off, the voltage at the power supply for the PDP falls more slowly than that of the power supply for the logic circuit. When the voltage at the logic circuit power supply reaches a predetermined level disabling circuits from operating, outputting of control signals ceases. The PDP halts in an immediately preceding state. In other words, the state in which the PDP halts is determined according to the timing of stopping power supply. The halt state is not finalized.

As mentioned above, the halt of the PDP is not finalized. Therefore, the states of cells in the PDP, or more particularly, the states of wall charges vary depending on whether the state immediately preceding the halt is a reset period, addressing period, or sustaining discharge period.

FIGS. 7A to 7C are diagrams for explaining a distribution of wall charges in an operating state attained when a PDP halts, causing the foregoing problem.

FIG. 7A shows a state in which the PDP comes to a halt during a reset period during which a full-screen writing pulse is applied or immediately after the completion of the reset period. In this state, since a full-screen writing pulse has been applied, no charge is accumulated on the address electrodes, X electrode, and Y electrodes alike.

FIG. 7B shows a state in which the PDP comes to a halt during an addressing period or immediately after the completion of the addressing period. In this state, as illustrated, positive charges remain on the surface of the dielectric membrane over the Y electrodes, and negative charges remain on the surface of the dielectric membrane over the address electrodes and X electrode. These residual charges remain unless some kind of erasure is executed. When the halt state lasts for a short period of time, since the cells have gas ionized due to discharge and are retained in the states analogous to those attained after the completion of sustaining discharge, once a full-screen writing pulse is applied, discharge is started. Normal operations can be performed thereafter.

However, when the PDP is left intact in the state shown in FIG. 7B for a prolonged period of time, gas in the cells is neutralized by the re-bonding of wall charges. Negative and positive charges remain over the X electrode and Y electrodes. As shown in FIG. 7C, assuming that the voltages induced by the residual charges over the X electrode and Y electrodes in the above state are −50V and +50V respectively, when reset is executed so that a full-screen writing pulse of 350V is applied to the X electrode and the Y electrodes are held at 0V, a voltage actually applied between the X electrode and Y electrodes comes to 250V owing to the residual charges. In this state, there arises a problem that discharge for full-screen writing is not carried out and an erased state is not attained. Furthermore, since the discharge occurring during an addressing period varies depending on display data, and the states of the residual charges differs from cell to cell. This leads to a problem of inhomogeneity where the erased state is different from cell to cell. When erasure is not achieved during a reset period, discharge is not performed normally during a succeeding addressing period and sustaining discharge period. Previous display data appears until erasure is achieved by performing full-screen writing during a reset period succeeding the sustaining discharge period. When previous display data appears, a problem, in that an observer of the PDP is given a peculiar feeling, occurs.

Even if charges remain at the time of a halt, discharge intended for full-screen erasure may be performed reliably by raising the voltage of a full-screen writing pulse. For this purpose, the ability of a cell structure and drive circuit to withstand a high voltage must be improved. This leads to a problem that the scale of circuitry increases. The first mode of the present invention attempts to solve this kind of problem.

Figure 8:
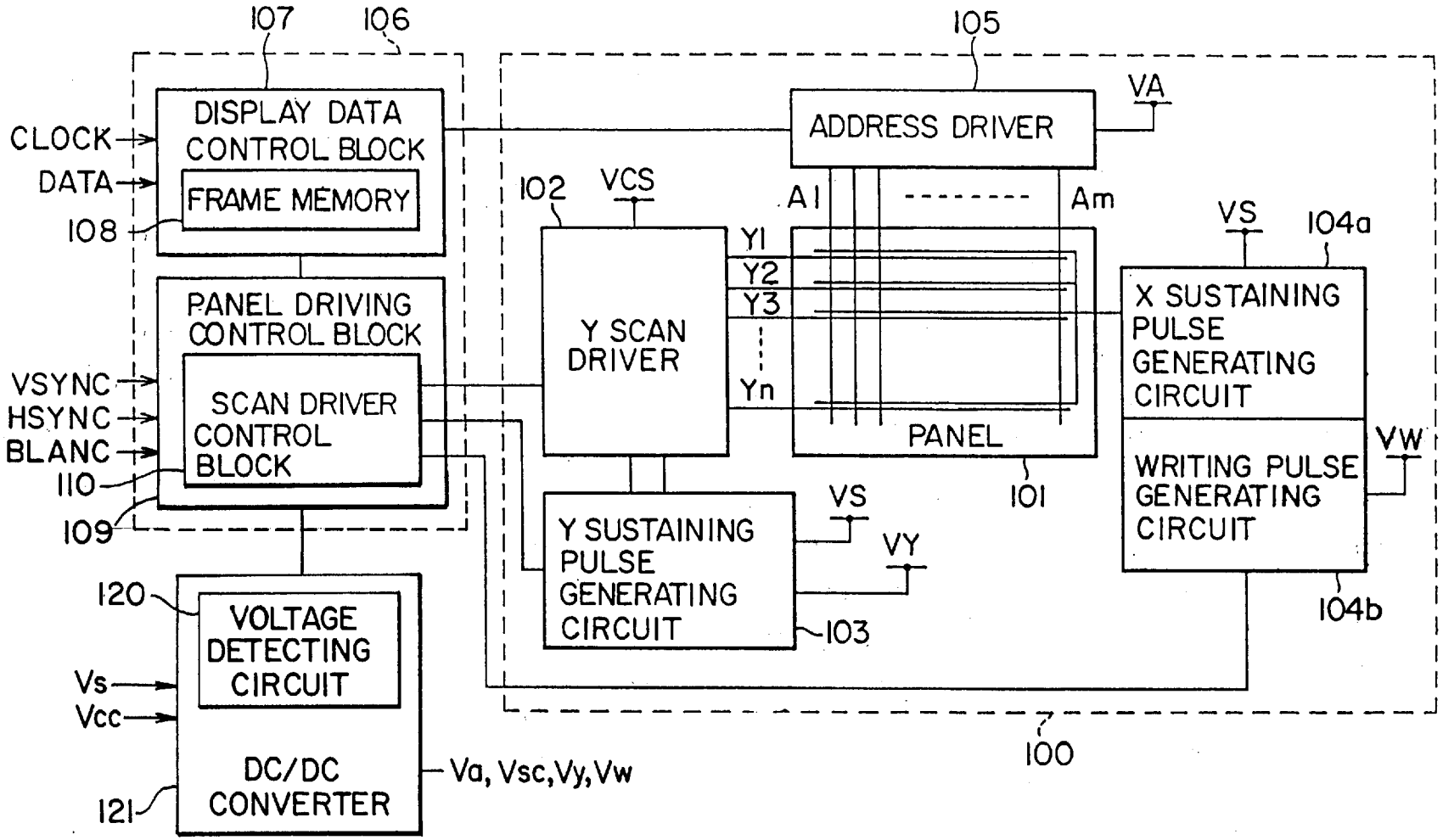
FIG. 8 is a diagram showing the overall configuration of a PDP of the first embodiment.

FIG. 8 is a diagram showing the overall configuration of a PDP display of the first embodiment of the present invention.

As is apparent from the comparison of FIG. 8 with FIG. 4, differences from the known display line in the point that a DC/DC converter 121 including a voltage detecting circuit 120 is installed, and the point that the control unit 106 is further provided with a control that is given in response to a detection signal sent from the voltage detecting circuit 120. Consequently, herein, the differences from the known display will be described. The description of components identical to those of the known display will be omitted or will be brief.

Figure 9:
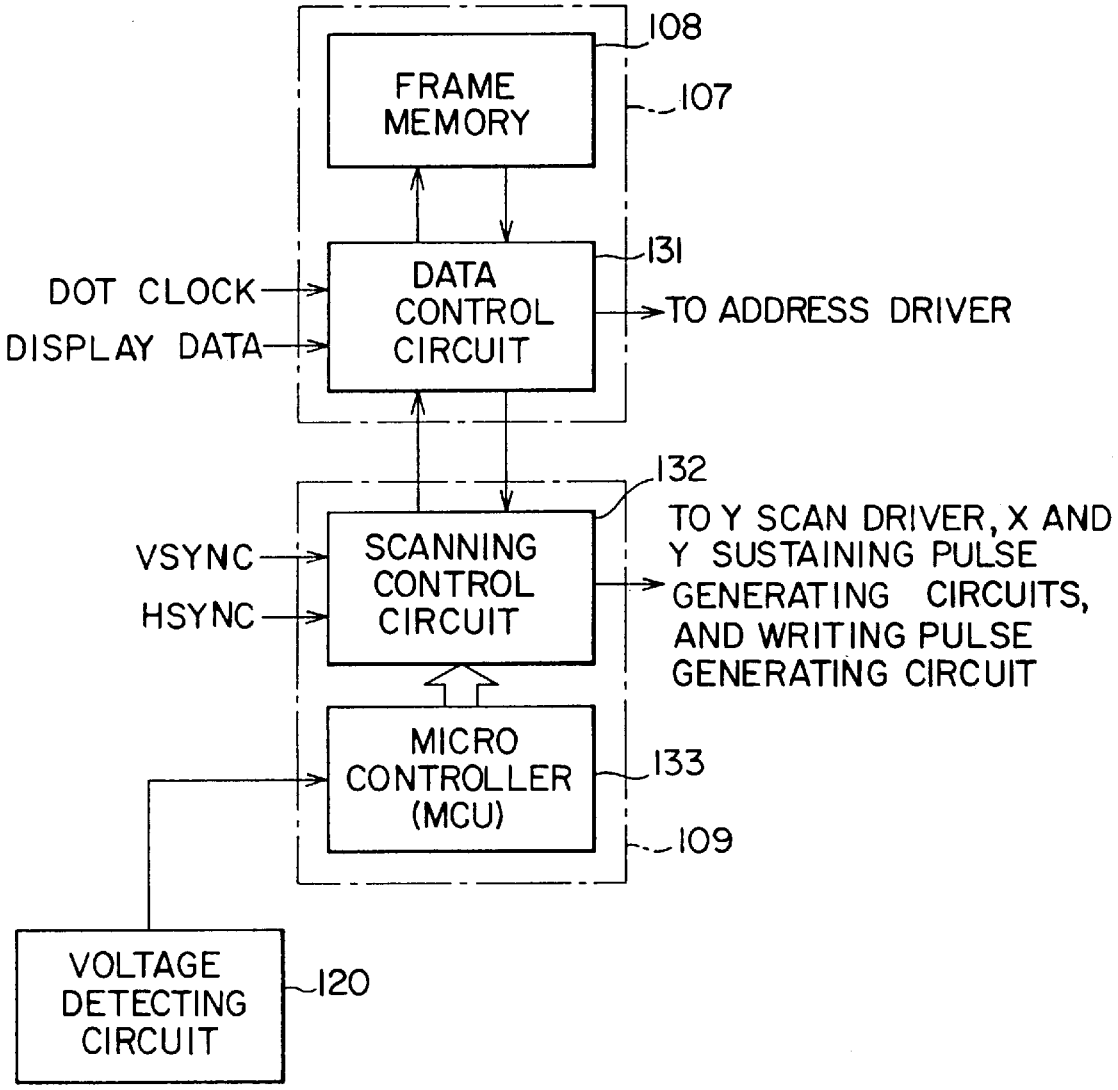
FIG. 9 is a diagram showing the circuitry of a control unit in the first embodiment.

FIG. 9 is a diagram showing the configuration of the control unit 106.

As shown in FIG. 9, a display data control block 107 is composed of a frame memory 108 and data control circuit 131. A panel driving control block 109 (scan driver control block 110) is composed of a scanning control circuit 132 and microcontroller (MCU) 133. The display data control block 107 has the same circuitry as the one in the known display. Synchronously with sync signals VSYNC and HSYNC and a clock CLOCK, which are supplied via the panel driving control block 109, a display data signal DATA supplied externally is temporarily stored in the frame memory 108. During the next frame, the data stored in the frame memory 108 is supplied to the address driver 105 synchronously with a start signal being supplied from the panel driving control block 109 and indicating the start of an addressing period within each subframe. Moreover, during a reset period and sustaining discharge period, all address electrodes are fixed to a given voltage Vaw (approximately 100V). The scanning control circuit 132 has the circuitry shown in FIG. 10 and is controlled by the MCU 133.

Figure 10:
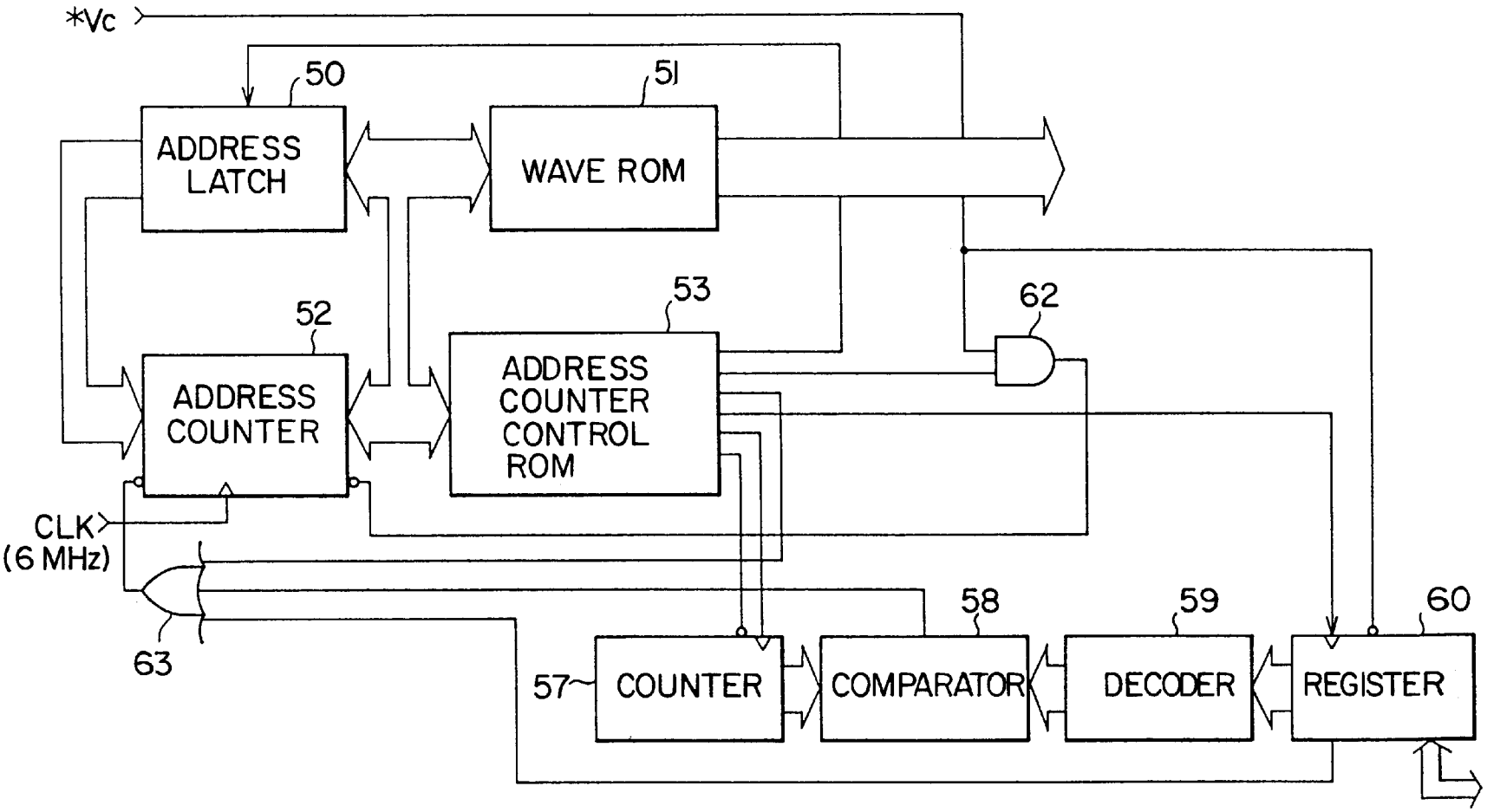
FIG. 10 is a diagram showing in detail a scanning control circuit in the first embodiment.

In the circuitry shown in FIG. 10, pulsating waves to be applied to the X electrode and Y electrodes during respective operating periods are stored in a wave ROM 51. The waves are read in order to produce waves during the operating periods. Only the smallest unit of a pulsating wave to be applied during each operating period is stored in the wave ROM 51. When the same component of the wave is repeated, for example, during an addressing period or sustaining discharge period, an address signal used to loop corresponding data of the smallest unit contained in the wave ROM 51 is output from an address counter 52. Thus, a required wave is produced. Specifically, when a Vc (Vsync Clear) signal is input, each block is reset and the address counter 52 is actuated. In this state, first, data corresponding to a pulsating wave to be applied during a reset period is read out. When an address at which data corresponding to a pulsating wave to be applied during an addressing period is stored is indicated, data corresponding to a shift pulsating wave to be applied during an addressing period is output from in the wave ROM 51. At this time, the first address is latched by an address latch 50. When an address containing the corresponding data of the end of the smallest unit is indicated, the latched first address is loaded into the address counter 52. This operation is repeated. The operation continues until a count value provided by a counter 57 agrees with the repetition frequency of the smallest unit of the pulsating wave to be applied during an addressing period which has been held and is output by a register 60, and loading an output of the address latch 50 into the address counter 52 is inhibited by an output signal from a comparator 58. Thus, a required number of shift pulses are produced during an addressing period.

When the loading is inhibited, the address counter 52 quits the cycle of producing a pulse for an addressing period and initiates the cycle of producing a pulse for a sustaining discharge period. At this time, the counter 57 is reset by a signal sent from an address counter control ROM 53. The register 60 is switched to output a repetition frequency of the smallest unit of a pulsating wave to be applied during a sustaining discharge period. Consequently, the operation similar to that to be performed during an addressing period is carried out, and the pulsating wave to be applied during a sustaining discharge period is repeated at a required frequency.

After a required pulsating wave is repeated during the sustaining discharge period, if the count value provided by the counter 57 agrees with the repetition frequency of the smallest unit of a pulsating wave to be applied during a sustaining discharge period, loading an output of the address latch 50 into the address counter 52 is inhibited by an output signal from the comparator 58. When the address value indicated by the address count 52 is incremented accordingly, a reset is executed immediately by the address counter control ROM 53. The operation is then restarted at an address containing data corresponding to a pulse to be produced during the first reset period. At this time, the counter 57 is reset by a signal sent from the address counter control ROM 53, and the register 60 is also reset to output the first value.

The microcontroller 133 can access the address counter 52, address counter control ROM 53, and counter 57 and can detect their states, though it is not illustrated. The microcontroller 133 can load a given value into the counter. Moreover, the microcontroller 133 can access the register 60 and set a given value in the register 60. When an interrupt is generated by the voltage detecting circuit 120, the microcontroller 133 immediately accesses the above units to check their states, and thus detects a current driving period at any instant. The microcontroller 133 executes cutoff processing, which will be described later, according to the detected states. For example, a given address is loaded into the address counter 52. Setting is done so that data corresponding to a pulsating wave used for cutoff processing and being stored separately in the wave ROM 51 can be read out, and so that when the reading of the data corresponding to a pulse used for cutoff processing is completed, the address counter control ROM 53 halts the operation of the address counter 52.

Figure 11:
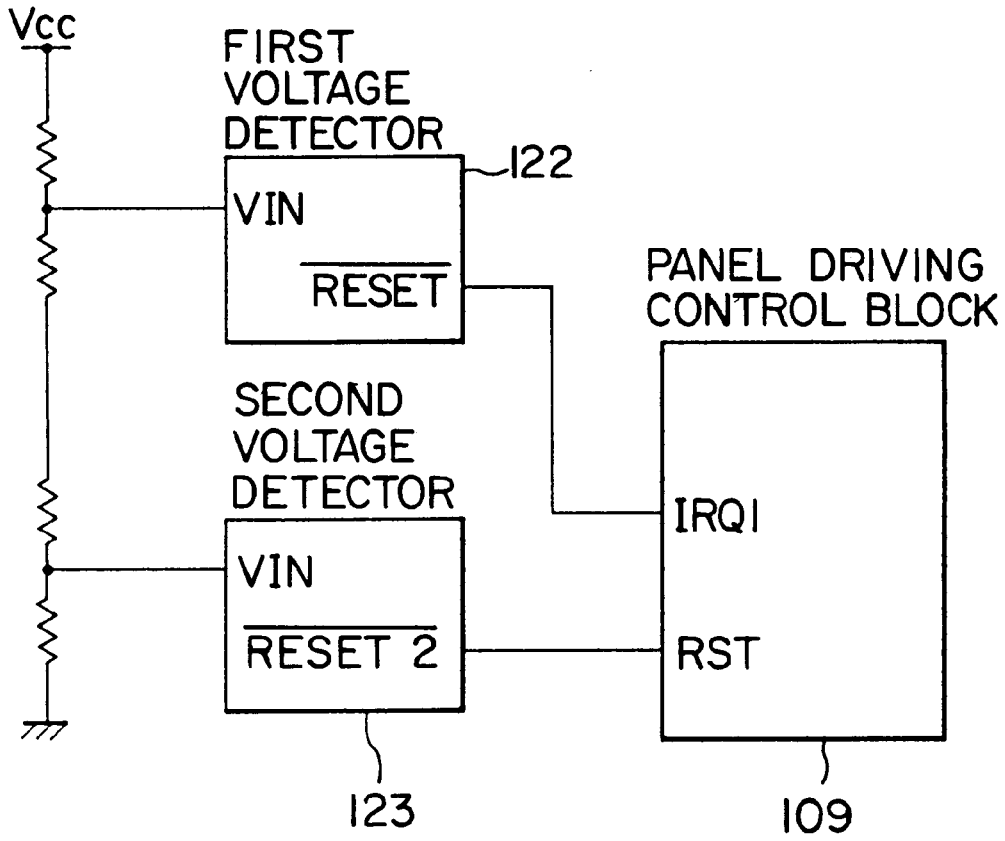
FIG. 11 is a diagram showing the configuration of a voltage detecting circuit in the first embodiment.

FIG. 11 shows the configuration of the voltage detecting circuit shown in FIG. 8. First and second voltage detectors 122 and 123 are different in threshold level from each other and have the same circuitry as that shown in FIG. 12.

Figure 12:
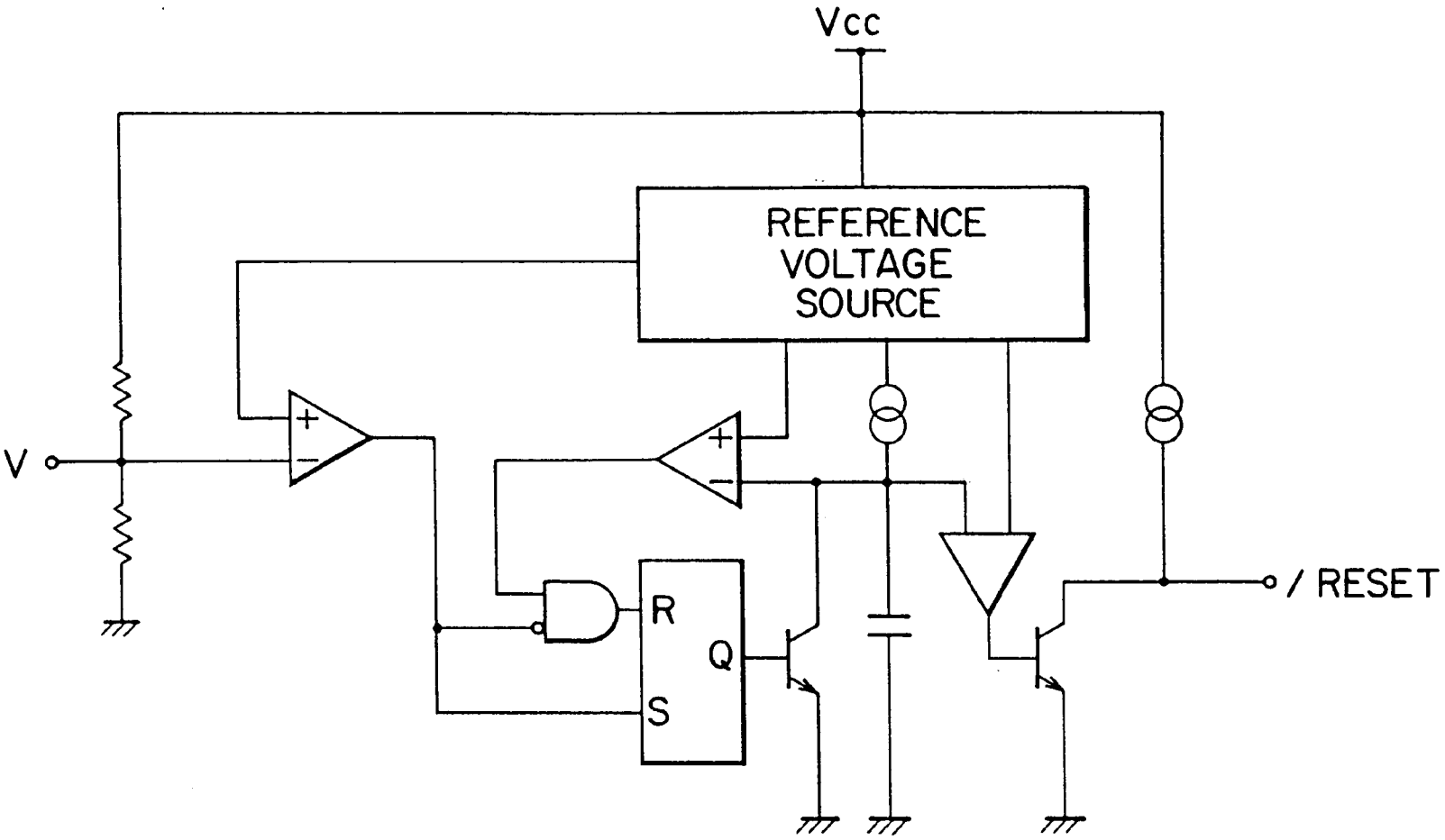
FIG. 12 is a detailed circuit diagram of a voltage detector employed in the configuration of the first embodiment.

The voltage detector shown in FIG. 12 is a comparator that exhibits a hysteresis relative to a detection voltage. When an input Vin becomes equal to or higher than a given voltage Vs+Vhis, an output /RESET goes high. This causes detection to start. When the Vin becomes lower than the Vs, the /RESET is driven high.

The voltage detecting circuit shown in FIG. 11 includes two voltage detectors each having the circuitry shown in FIG. 12. In the first voltage detector 122, when the input voltage Vin becomes equal to or lower than a value Vth1, an output /RESET1 makes a high-to-low transition. In the second voltage detecting circuit 123, when the input voltage Vin becomes equal to or lower than a value Vth2, an output /RESET2 makes a high-to-low transition. Herein the values Vth1 and Vth2 have the relationship of Vth1>Vth2. When a voltage drop occurs, a detection signal is output with a different voltage level and input to the panel driving control block 109.

In the panel driving control block 109, an interrupt occurs at a trailing edge of the output /RESET1. A current driving period is then identified and control is soon passed to cutoff processing. When the output /RESET2 makes a high-to-low transition, all operations are halted.

Figure 13:
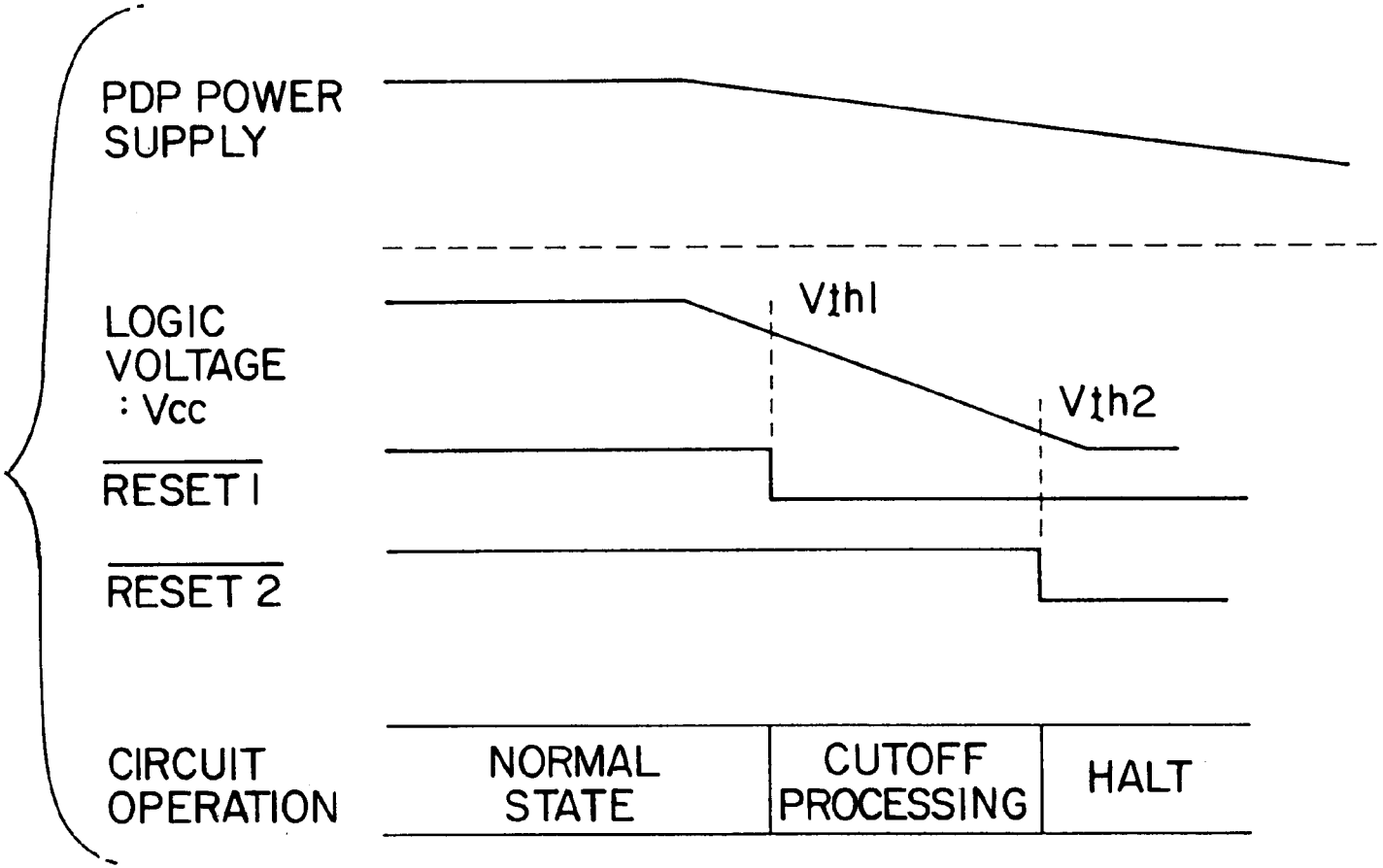
FIG. 13 is a diagram showing a sequence to be followed in case of cutoff in the embodiment.

FIG. 13 is a diagram showing a sequence to be followed in case of power cutoff in this embodiment. As described previously, a large-capacitance capacitor is included in the PDP driving high-voltage power supply. For this and other reasons, when power cutoff occurs because AC power supply is stopped externally, the voltage at the logic power supply starts decreasing but the voltage at the PDP driving high-voltage power supply does not decrease immediately. In this embodiment, a drop in the voltage Vcc at the logic power supply is always monitored by the voltage detecting circuit. When the voltage at the logic power supply starts decreasing and becomes equal to or lower than the value Vth1, a signal /RESET1 is input to the panel driving control block 109. An interrupt request is generated at a trailing edge of the signal /RESET1. Cutoff processing is executed immediately. Thereafter, when the voltage Vcc at the logic power supply becomes equal to or lower than the value Vth2, a signal /RESET2 is input. All operations are then halted.

Cutoff processing is available in various sequences. The simplest is such that after the signal /RESET1 is input, display data not causing discharge is selected on a fixed basis so that the cells can be set according to externally-input display data. As mentioned above, since the voltage at the PDP driving high-voltage power supply decreases more slowly than the one at the logic power supply, reset, addressing, and sustaining discharge are executed successively. All that is written is data not causing discharge. A state with no wall charges attained after full-screen writing is performed by executing reset is sustained.

Another cutoff processing is such that: whatever operation is in progress at the time of input of a signal /RESET1, the operation and the succeeding reset are carried out; and when the reset is completed, the PDP is halted.

Figure 14:
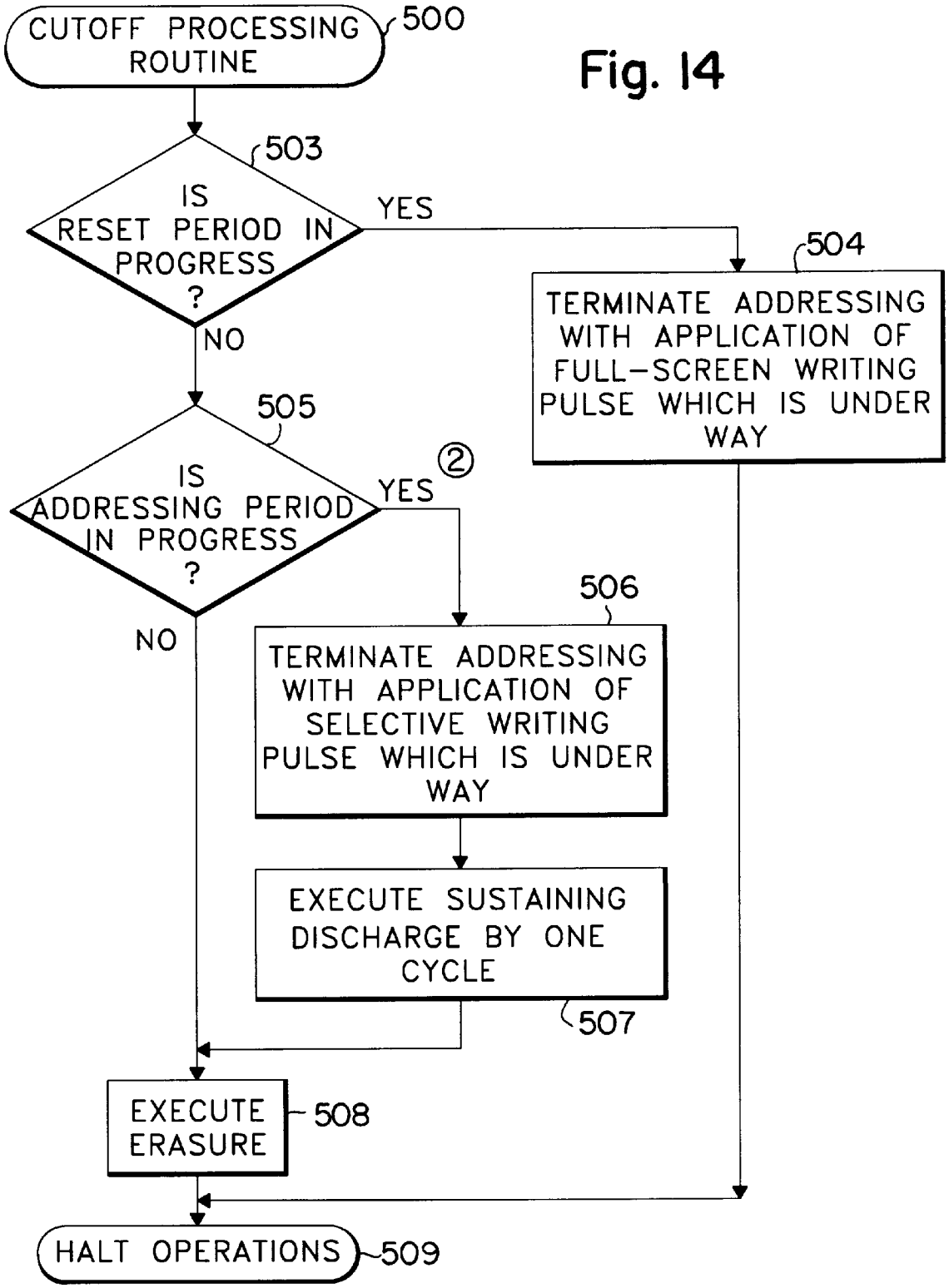
FIG. 14 is a flowchart describing cutoff processing accompanied by application of an erasure pulse.

The foregoing sequences of cutoff processing pose no problem as long as a voltage drop at the PDP driving high-voltage power supply is slower than that at the logic power supply. When the voltage drop at the PDP driving high-voltage power supply is rather fast, there arises a problem that erasure cannot be achieved. Moreover, when it is requested to achieve erasure as quickly as possible, cutoff processing is such that: the ongoing operations are halted immediately; and if wall charges are accumulated, an erasure pulse is applied to bring all the cells to a homogeneous state without any wall charges. FIG. 14 is a flowchart describing this sequence.

The voltage detecting circuit 120 detects a voltage drop at the logic power supply. An interrupt is generated because power cutoff is detected; that is, a signal /RESET1 to be input to the microcontroller (MCU) 13 makes a high-to-low transition. Accordingly, the MCU 13 activates a cutoff processing routine 500. At step 503, it is judged if a reset period is in progress. If a reset period is in progress, control is passed to step 504. Application of a full-screen writing pulse which is under way is continued to the end. Thereafter, the PDP is halted. If a reset period is not in progress, it is judged at step 505 if an addressing period is in progress. If an addressing period is in progress, control is passed to step 506. At step 506, addressing is terminated with selective writing onto a line which is under way. At step 507, sustaining discharge is executed for one cycle. This step is intended to fix the polarities of remaining charges and thus erase the accumulated charges more reliably. Control is then passed to step 508. If the judgment made at step 505 is that an addressing period is not in progress, a sustaining discharge period is in progress. Control is therefore passed directly to step 508. At step 508, erasure is executed for full-screen writing. Thereafter, the PDP is halted.

Figure 15:
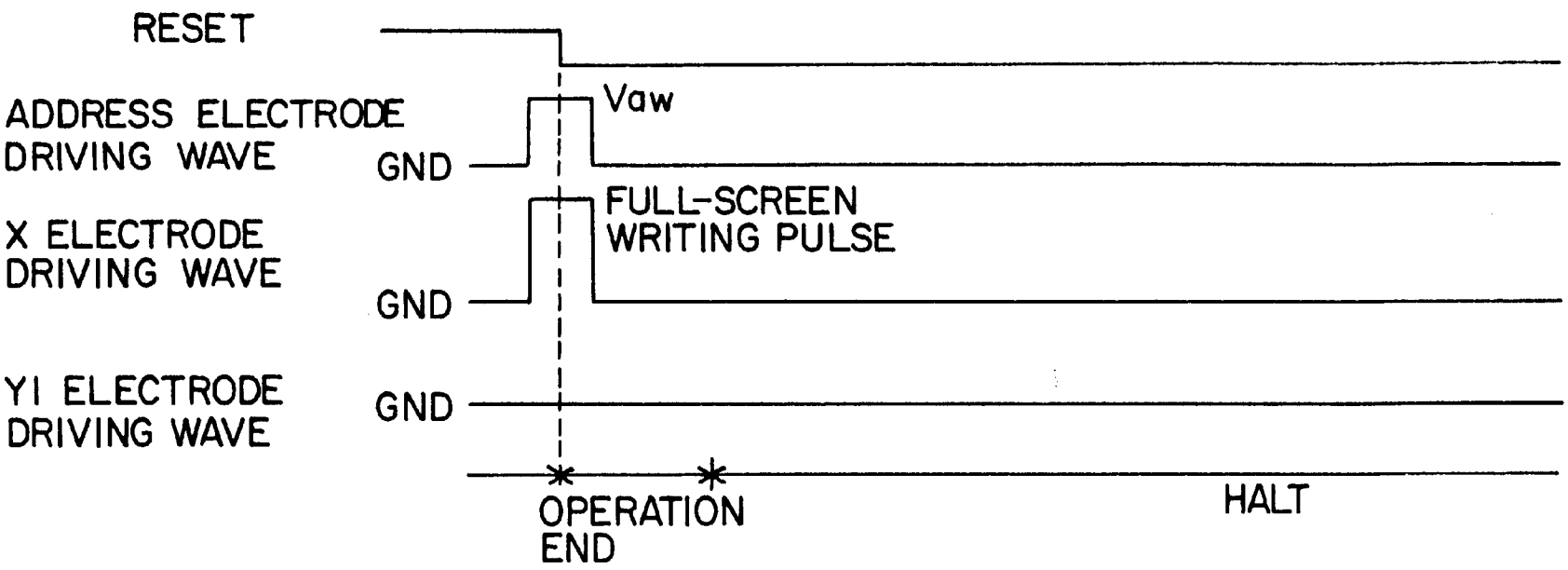
FIG. 15 is a timing chart for cutoff processing executed when a voltage drop is detected during a reset period.
Figure 16:
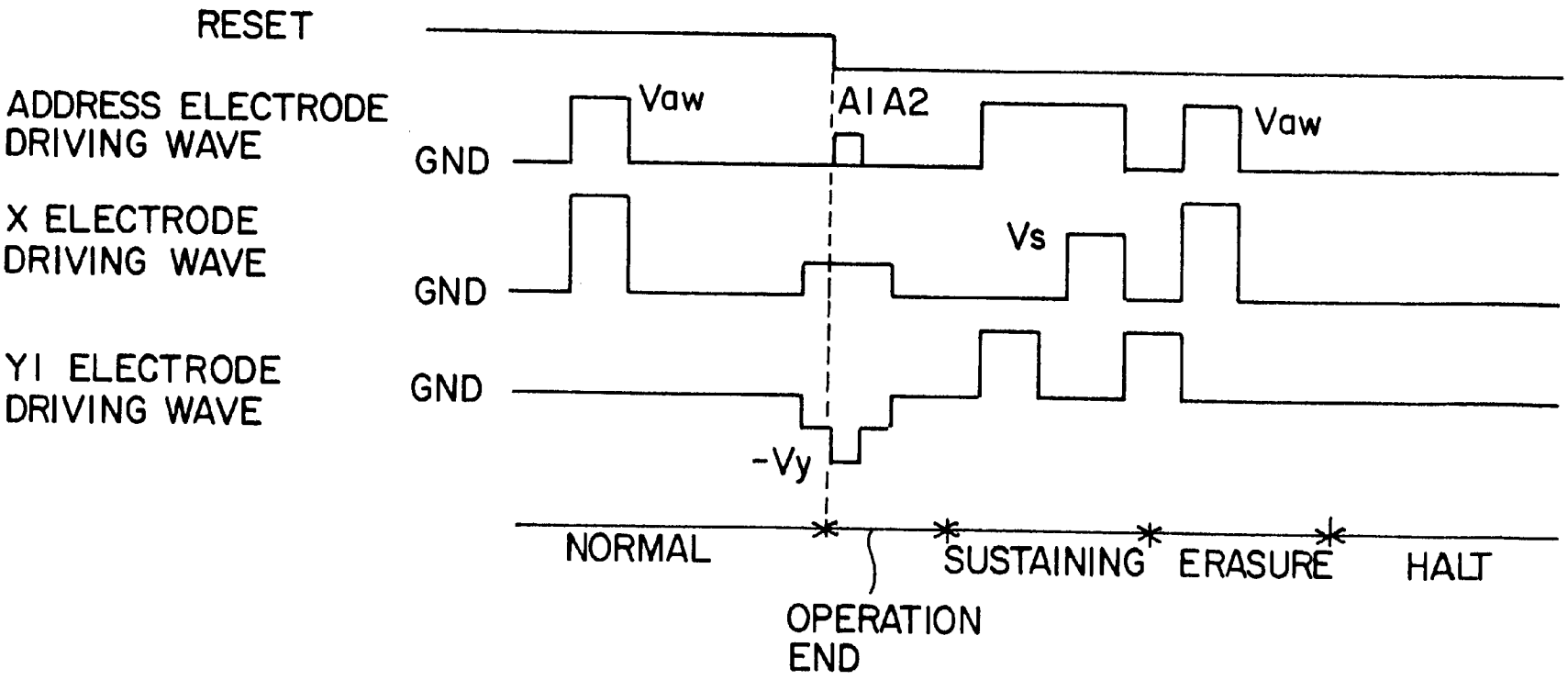
FIG. 16 is a timing chart for cutoff processing executed when a voltage drop is detected during an addressing period.
Figure 17:
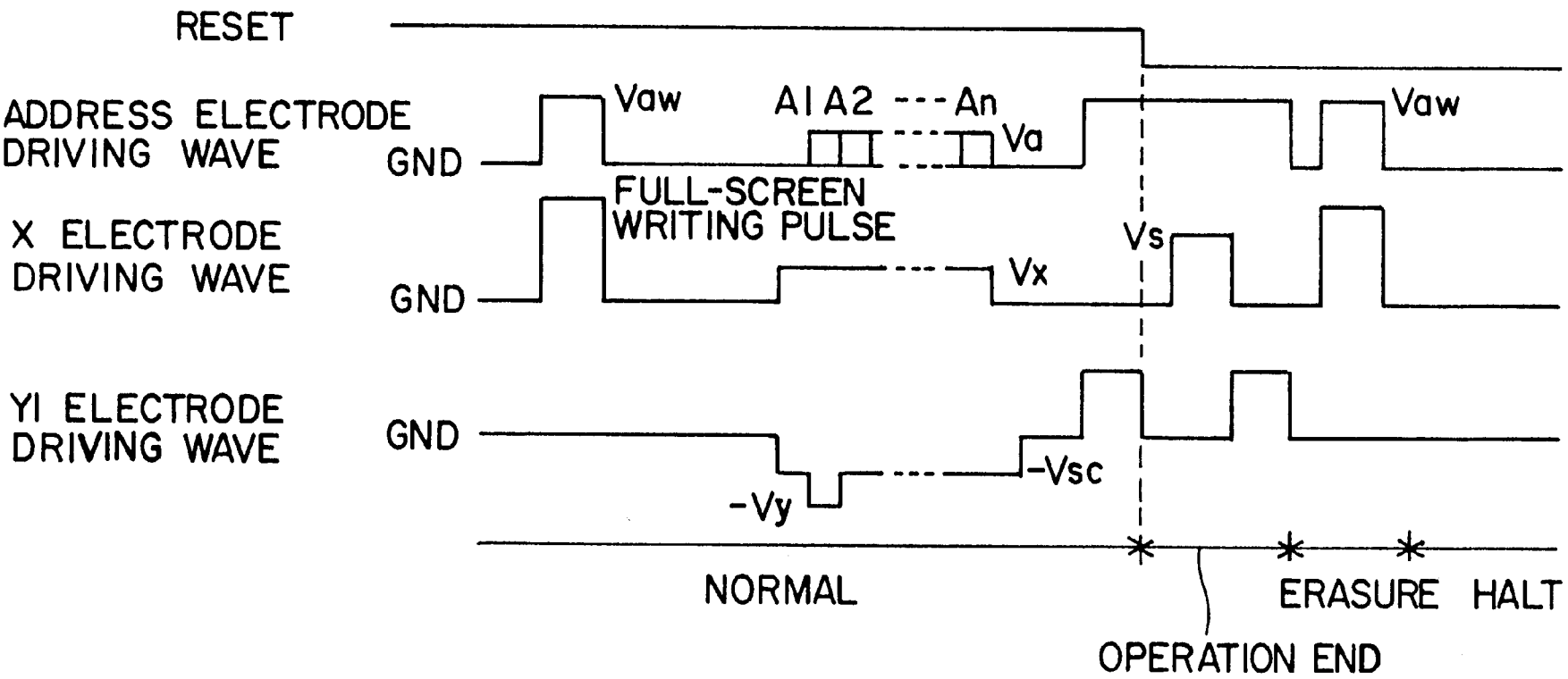
FIG. 17 is a timing chart for cutoff processing executed when a voltage drop is detected during a sustaining discharge period.

FIGS. 15 to 17 are timing charts concerning the cutoff processing. FIG. 15 shows the processing to be performed when a reset period is in progress at the high-to-low transition of the signal /RESET1. FIG. 16 shows the processing to be performed when an addressing period is in progress. FIG. 17 shows the processing to be performed when a sustaining discharge period is in progress.

When a reset period is in progress at the high-to-low transition of the signal /RESET1, as shown in FIG. 15, application of a full-screen writing pulse which is under way at that time is completed. Operations are then halted.

When an addressing period is in progress at the high-to-low transition of the signal /RESET1, application of a shift pulse to a Y electrode, application of a data signal to an address electrode, and application of a given voltage to the X electrode, which are under way at that time, are completed. Subsequent applications of pulses are canceled. Thereafter, sustaining discharge is executed by one cycle in order to stabilize residual charges. Thereafter, an erasure pulse resembling a full-screen writing pulse is applied in order to halt operations. In FIG. 16, two erasure pulses of opposite polarities are applied. This is intended to reliably erase wall charges of opposite polarities.

When a sustaining discharge period is in progress at the high-to-low transition of the signal /RESET1, as soon as application of a sustaining discharge pulse that is under way at that time is completed, subsequent applications of pulses are canceled. Thereafter, an erasure pulse is applied.

By executing the foregoing sequence of cutoff processing, the states of all the cells in the PDP 100 can be brought to a homogeneous state without any wall charge.

In the above example, self-erasure discharge in which a high-voltage pulse resembling a full-screen writing pulse is applied as an erasure pulse is executed. Alternatively, the aforesaid short-duration erasure or long-duration erasure will do.

As mentioned above, according to the first mode of the present invention, the influence of a state attained at the time of a halt upon the subsequent activation is nullified. Such a problem that previous display data appears at the time of activation will not occur.

A PDP of the first mode of the present invention has been described so far. For producing a driving signal in this kind of PDP, a circuit, in which data representing a signal concerning a wave and its control is stored in a ROM in units of a basic period of wave generation, and data stored in the ROM is read out consecutively in order to generate a wave, is widely adopted. This kind of circuit is not confined to the PDP but is adopted widely. Next, an embodiment of the second mode of the present invention concerning a wave generating circuit including the ROM will be described. Prior to that, a known wave generating circuit will be described briefly.

Figure 18:
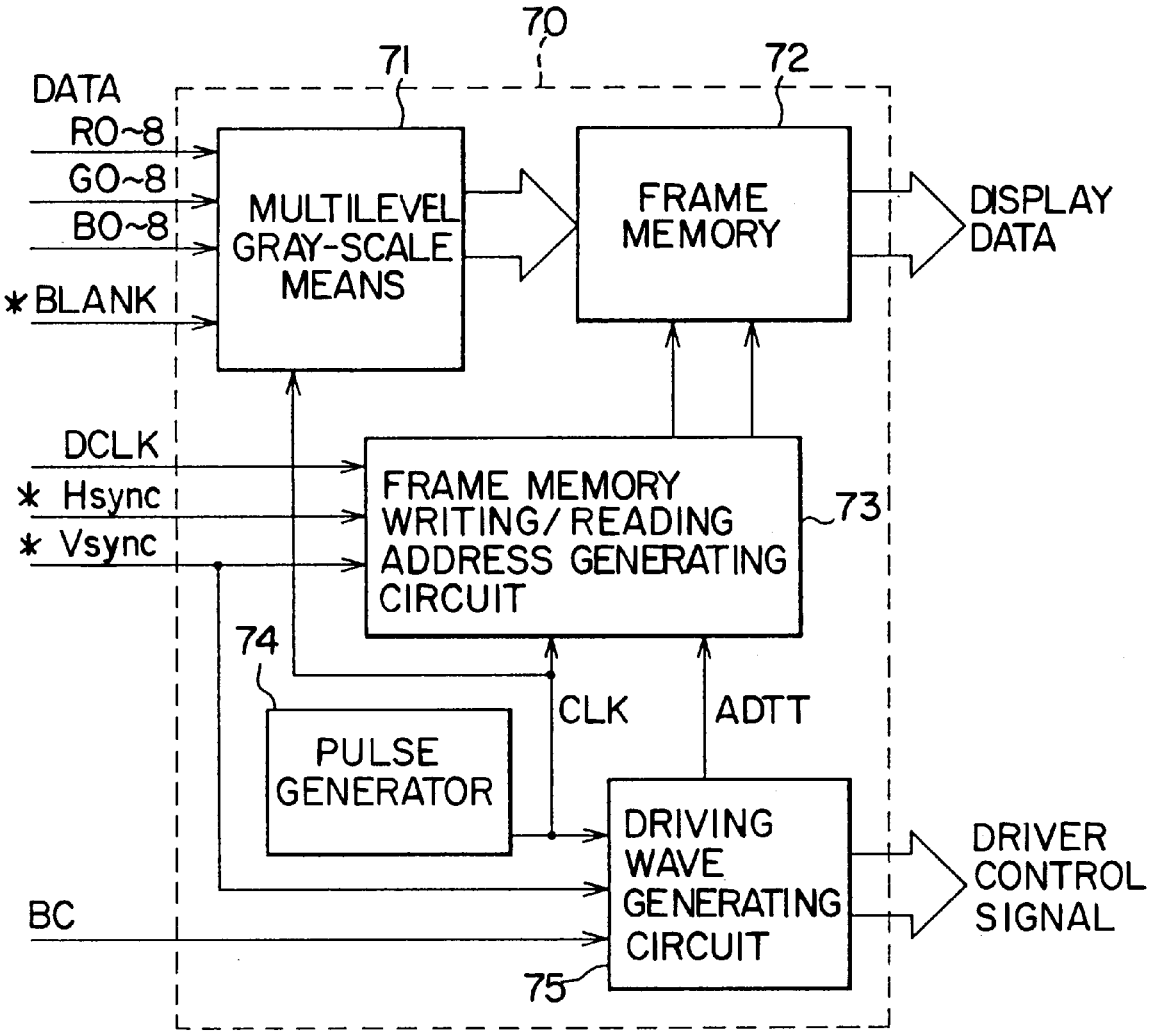
FIG. 18 is a block circuit diagram of a control unit for a color plasma display.
Figure 19:
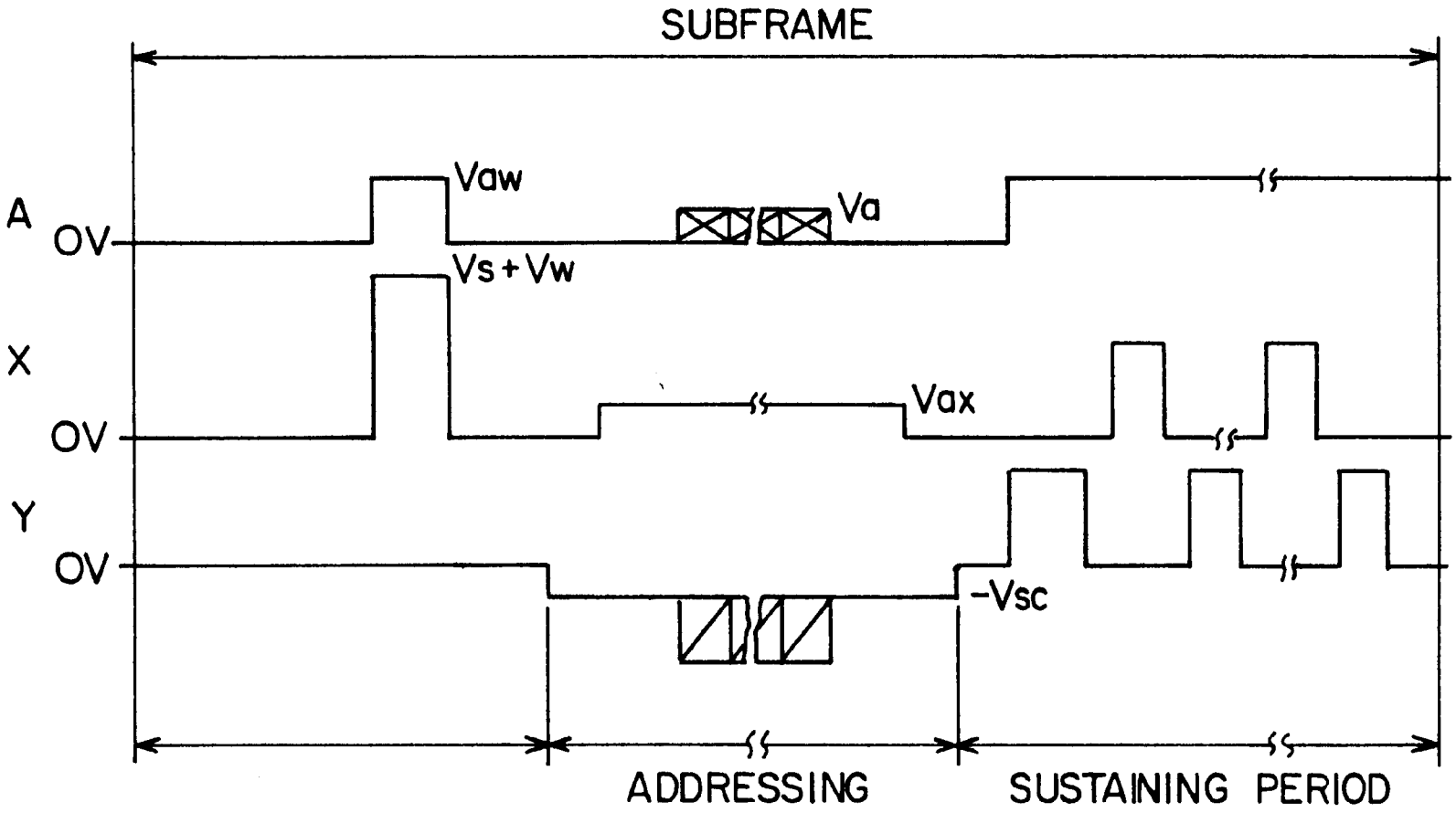
FIG. 19 is a timing chart showing driving waves employed in the plasma display.
Figure 20:
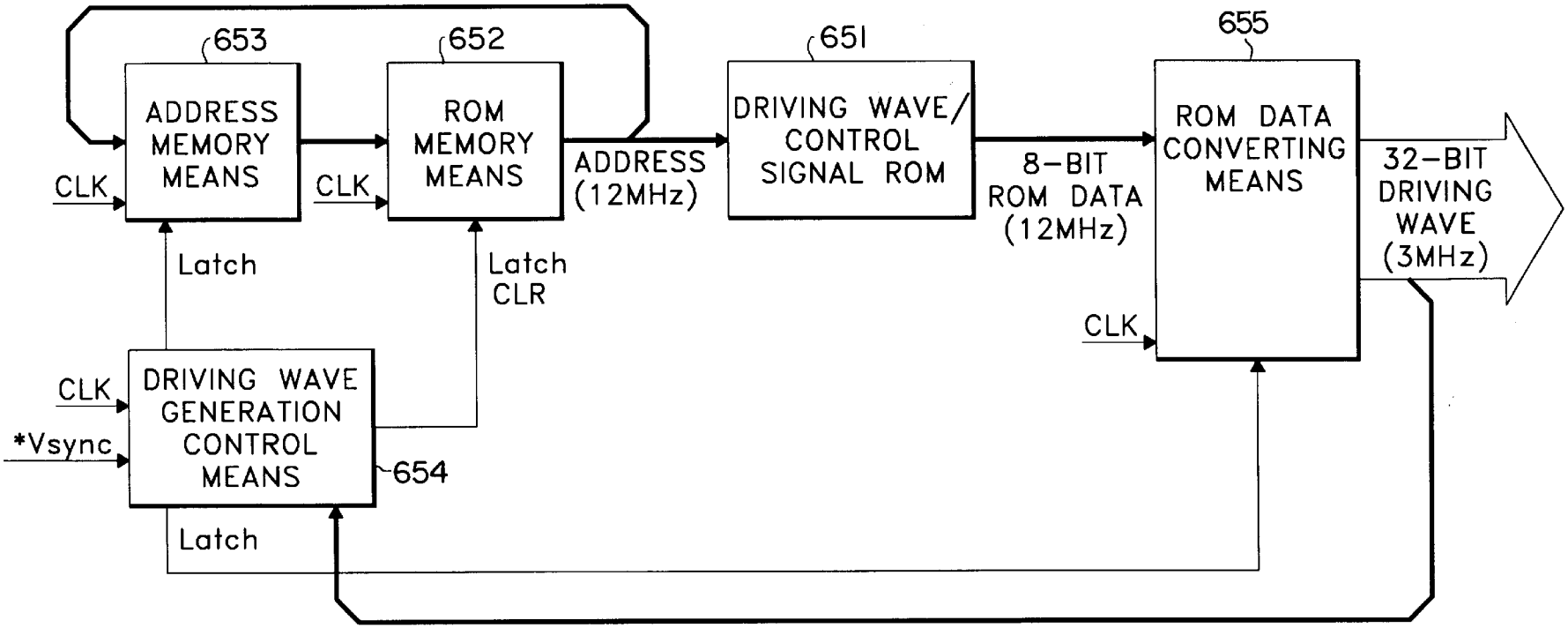
FIG. 20 is a block circuit diagram of a known driving wave generating circuit.

FIG. 18 is a block diagram showing the configuration of a control circuit for a known color plasma display. FIG. 19 is a timing chart showing examples of driving waves. FIG. 20 is a block circuit diagram of a driving wave generating circuit. A driving wave generating circuit for a known color PDP display will be described briefly with reference to FIGS. 18 to 20.

As shown in FIG. 18, a control circuit 70 comprises a multilevel gray-scale means 71, a frame memory 72, a frame memory writing/reading address generating circuit 73, a pulse generator 74, and a driving wave generating circuit 75.

FIG. 19 shows driving signals generated by the control circuit 70. A signal A shown at an uppermost position in FIG. 19 is a signal to be applied to address electrodes by the address driver 105. An intermediate signal X is a signal to be applied to the X electrode by the X driver. A lowermost signal Y is a signal to be applied to the Y electrodes by the Y scan driver 102. In FIG. 19, a signal Va that is a component of the signal A to be applied to the address electrodes and that is applied during an addressing period represents display data. The other signals are generated by the driving wave generating circuit 75.

As a circuit for generating a wave such as the driving wave generating circuit 75, a circuit in which data representing a signal concerning a wave and its control is stored in a ROM in units of basic period of wave generation and the data stored in the ROM is read consecutively in order to generate a wave is widely adopted. When a required quantity of data cannot be acquired by single reading, data required during each basic period is split into a plurality of portions and then stored. Reading is executed a plurality of times during each basic period, whereby the required quantity of data is output.

The present applicant has disclosed a driving wave generating circuit for a PDP display in Japanese Unexamined Patent Publication (Kokai) No. 4-284491. FIG. 20 shows an example of the configuration of a known driving wave generating circuit 75 disclosed in the publication. As shown in FIG. 20, the known driving wave generating circuit 75 comprises a driving wave/control signal ROM 651, a ROM address counter 652, an address memory means 653, a ROM data converting means 655, a driving wave generation control means 654 for outputting a control signal to the ROM address counter 652, address memory means 653, and ROM data converting means 655.

Figure 21:
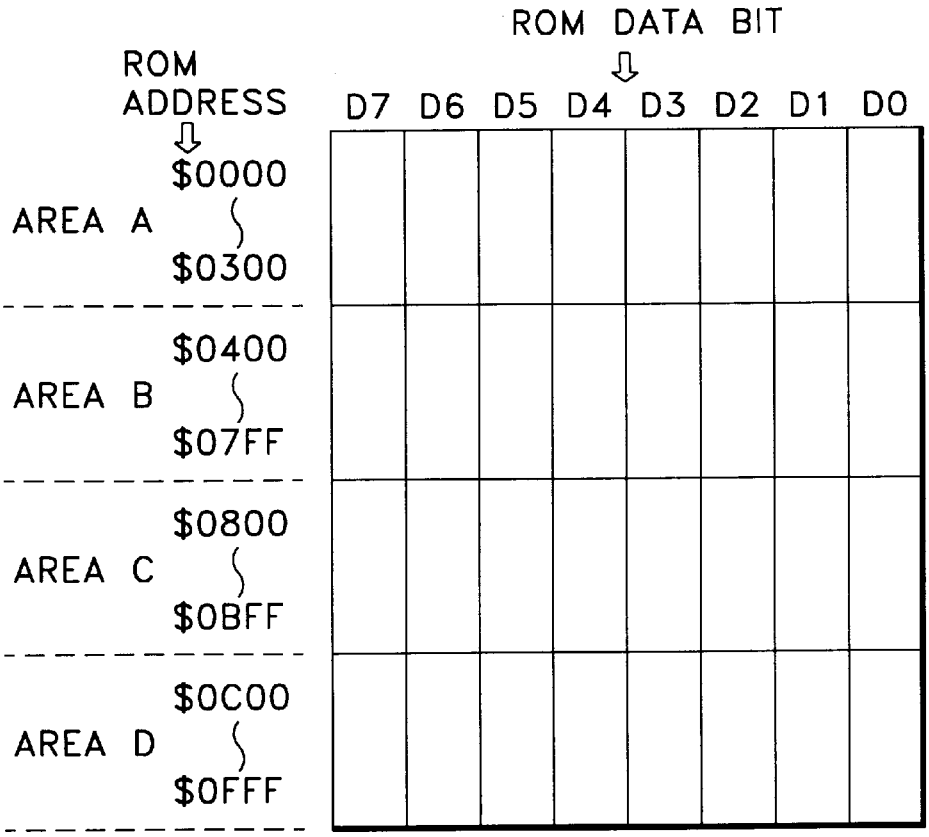
FIG. 21 is a diagram showing a known ROM memory map.

As a driving method for enabling gray-scale display in a PDP display, a multiple addressing method is adopted generally. According to the multiple addressing method, one display frame is divided into a plurality of subframes; sustaining periods (sustaining discharge periods) within the subframes which determine an effective luminance have the ratio of 1:2:4:8:16:etc.; gray-scale data is displayed during subframes to which weights associated with gray-scale levels are applied; and thus gray-scale display is achieved. Data representing a driving wave to be applied during one subframe and a control signal to be output to the driving wave generation control means 654 is stored in the driving wave/control signal ROM 651. The length of a sustaining period is determined by a repetition frequency of a repetitive component of the driving wave that will be described later. As shown in FIG. 19, one subframe is divided into a reset period, addressing period, and sustaining period. If the data representing a driving wave and control signal to be applied during one subframe were all stored, the driving wave/control signal ROM 651 would need a large storage capacity. For a component of the driving wave that is repeated, the same address is read repeatedly in order to generate the same component repeatedly. As far as the driving signals shown in FIG. 19 are concerned, the same components are repeated during an addressing period and sustaining period. For enabling production of the components, only the data corresponding to the smallest unit of the repetitive component of the driving wave is stored. A leading address of an area in the driving wave/control signal ROM 651 in which the data corresponding to the smallest unit of the repetitive component of the driving wave, which is output by the ROM address counter 652, is held in the address memory means 653 at the start of repetitive component of the driving wave. When the driving wave/control signal ROM 651 handles data 8 bits long, since 8-bit data is insufficient to produce a required driving wave, data sets are converted into data of more than 8 bits long by the ROM data converting means 655. For example, when 32-bit data representing a driving wave and its control signal and having a frequency of 3 MHz is needed in order to produce a required driving wave, data sets are stored in the form of a memory map shown in FIG. 21 in the driving wave/control signal ROM 651 that handles data of 8 bits long. Areas A, B, C, and D are then read in that order at a frequency of 12 MHz. The ROM data converting means 655 converts four sets of read data into 32-bit data having a frequency of 3 MHz. The ROM data output by the ROM data converting means 655 is output as a driver control signal to each of the address driver 2, X driver 3, Y scan driver 4, and Y driver 5 except a control signal ADTT to be fed to the frame memory writing/reading address generating circuit is input to the driving wave generation control means 654. Each driver is provided with a circuit for producing a signal of a given voltage which is to be applied to associated electrodes in response to a supplied control signal. Signals such as those shown in FIG. 19 are then produced in order to drive the panel 1. The above operation is repeated by the number of subframes, whereby display of one screen is completed.

In PDP displays, there is the necessity of controlling more precisely the driving of a panel by drivers in an effort to further improve display quality and durability. For coping with the necessity, it is required to produce more precisely a driving wave to be supplied to the drivers. However, for producing a driving wave more precisely, the capacity of the driving wave/control signal ROM 651 must be expanded, and a quantity of data to be read from the driving wave/control signal ROM 651 during each basic period must be increased. This means that a speed of reading data from the driving wave/control signal ROM 651 must be raised. However, when an attempt is made to raise the speed of reading a ROM, a high-speed ROM must be used. This poses a problem that the ROM cost increases. In the PDP displays, therefore, producing a more precise driving wave cannot be realized readily.

This problem is not limited to a wave generating circuit to be employed in PDP displays but is also observed in a wave generating circuit to be used for any other purpose. The problem commonly occurs in situations where numerous waves must be generated and that a precise wave must be generated. The second mode of the present invention attempts to solve this kind of problem.

Figure 22:
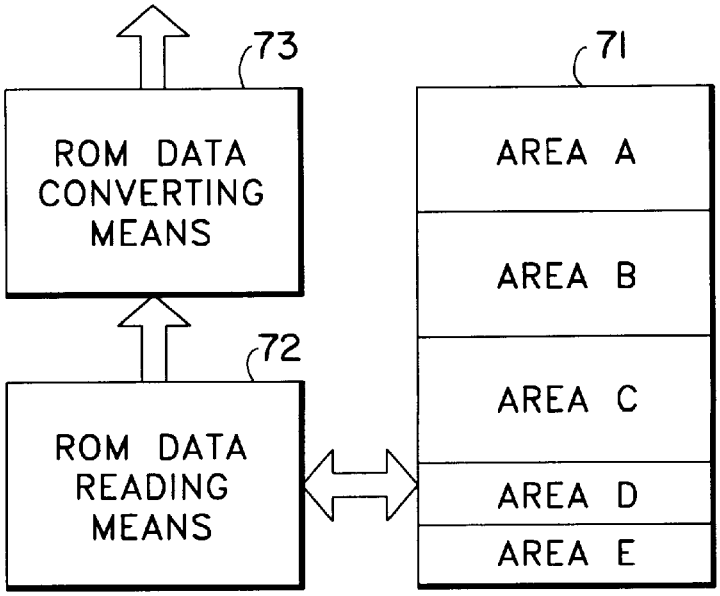
FIG. 22 is a diagram showing the principles and configuration of the second mode of the present invention.

FIG. 22 is a diagram showing the principles and configuration of the second mode of the present invention.

As shown in FIG. 22, a wave generating circuit of the present invention comprises a wave/control signal ROM 71 for storing ROM data concerning a wave and its generation, a ROM data reading means 72 for reading consecutively the ROM data from the wave/control signal ROM 71, and a ROM data converting means 73 for producing a wave continually on the basis of the ROM data read by the ROM data reading means 72. The wave/control signal ROM 71 stores ROM data with it split into basic period data (data to be stored in areas A, B, and C) that changes at intervals of a basic period and long period data (data to be stored in areas D and E) that changes at intervals of a long period that is an integral multiple of the basic period. The ROM data reading means 72 reads the basic period data and long period data at intervals of associated periods. The ROM data converting means 73 converts the basic period data and long period data, which are read by the ROM data reading means 72, at intervals of associated periods.

The ROM data concerning a wave and its generation generally includes not only basic period data but also long period data that changes at intervals of a period longer than the basic period. In the past, all data including the long period data has been stored as basic period data, and read at intervals of the basic period in order to generate a wave. However, the long period data need not be stored as basic period data and read at intervals of the basic period. The long period data should merely be stored as data that is to be read at intervals of a long period coincident with the cycle of the data, and read at intervals of the long period. In a wave generating circuit of the present invention, ROM data is split into basic period data and long period data and then stored. The basic period data and long period data are read at intervals of periods coincident with the cycles of the data, and then converted into a wave. Consequently, assuming that a quotient of a long period by a basic period is X, a storage capacity required to store long period data is a 1/X of a storage capacity required to store the data at intervals of a basic period. A period at intervals of which the ROM data reading means 72 reads long period data is X times longer than a reading period at intervals of which the data is read when stored as basic period data. A reading frequency is 1/X of that by which the data is read when stored as basic period data. Consequently, the storage capacity and reading speed of the wave/control signal ROM 71 can be minimized.

In FIG. 22, basic period data has a data size that is three times larger than a data length handled by the wave/control signal ROM 71, and is stored in areas A, B, and C. Long period data changes at intervals of a period that is twice longer than a basic period, has a data size that is twice larger than the data length handled by the wave/control signal ROM 71, and is stored in areas D and E. Aside from these definitions, the other various definitions are conceivable. For example, basic period data may have a data size that is twice larger than the data length. Long period data may change at intervals of a period that is three times longer than a basic period, and have a data size that is twice larger than the data length. Moreover, long period data is not limited to one kind of data. Alternatively, a plurality of kinds of long period data may exist; that is, two kinds of long period data; data whose cycles are twice and three times longer than a basic period may exist.

Herein, reading is achieved most efficiently when a frequency by which the ROM data reading means 12 reads ROM data from the wave/control signal ROM 71 during a long period agrees with a sum of a value calculated by multiplying a frequency of reading basic period data during a basic period by X and a frequency of reading long period data during the long period. In any other case, the ROM data reading means 72 must suspend reading; that is, thin out data.

Figure 23A:
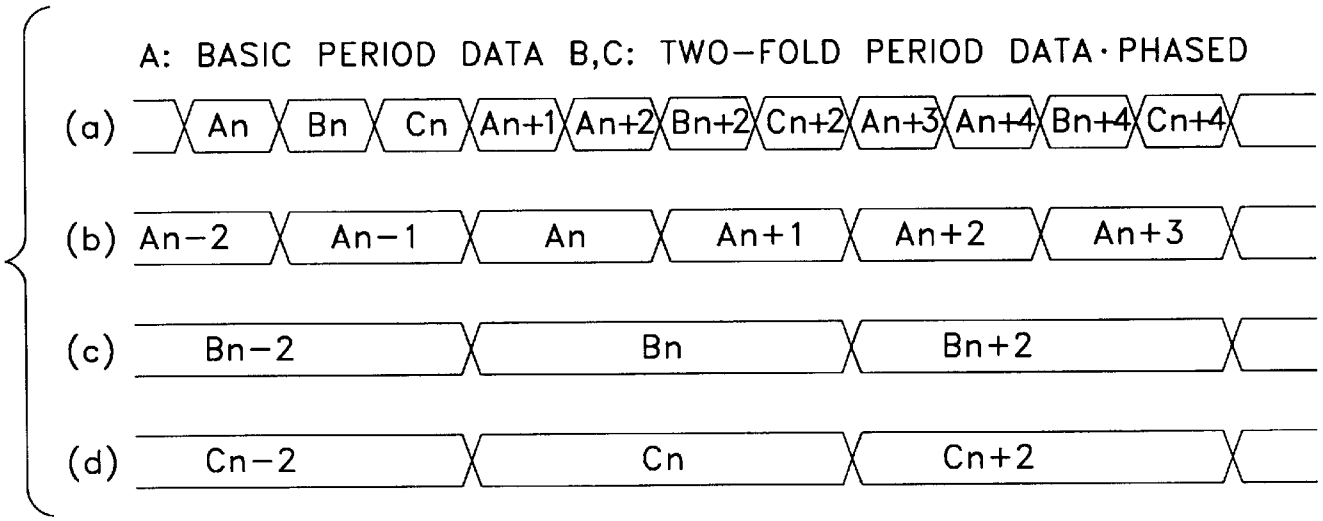
FIGS. 23A and 23B are diagrams for explaining an operation performed when a long period is a twofold period.
Figure 23B:
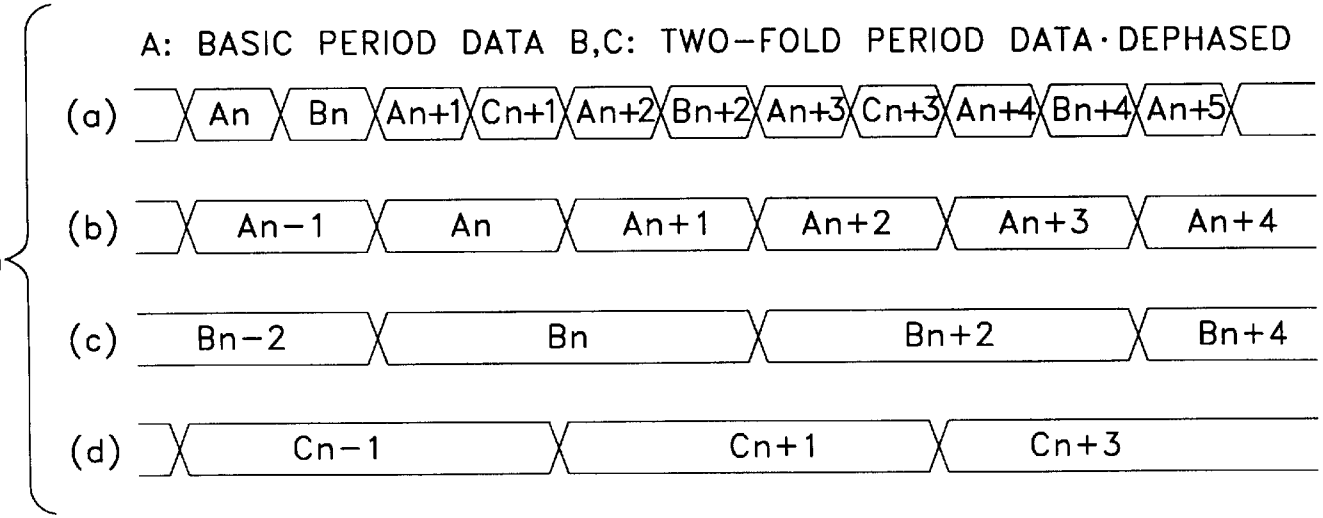
Figure 24:
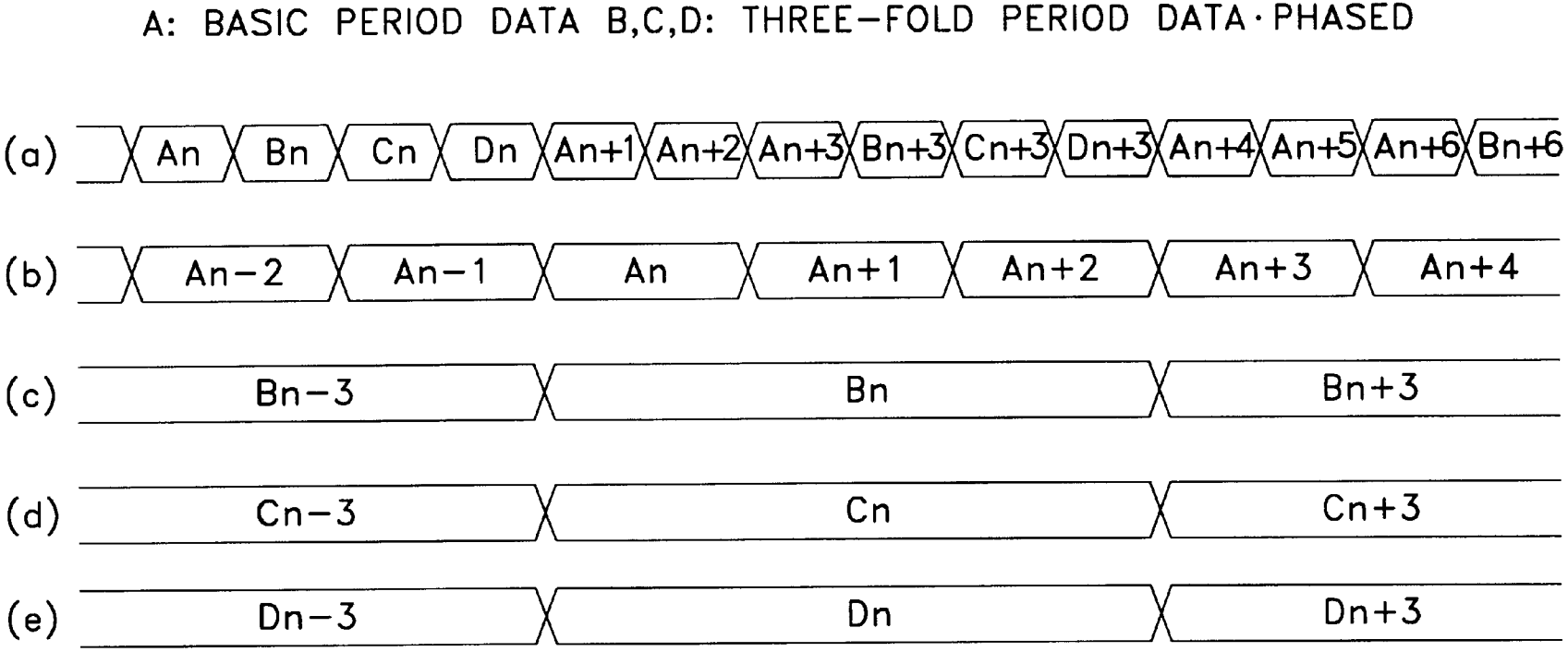
FIG. 24 is a diagram for explaining an operation performed when a long period is a three-fold period.

FIGS. 23A, 23B, and 24 are diagrams for explaining the operation of the ROM data reading means 72 in a wave generating circuit in accordance with the present invention for reading ROM data from the wave/control signal ROM 71.

In FIGS. 23A and 23B, basic period data includes only data A that have the same length as the data length handled by the wave/control signal ROM 71 and that are stored in area A. Long period data includes data B and C that are twofold period data whose cycle is twice longer than a basic period, that are twice larger than the data length handled by the wave/control signal ROM 71, and that are stored in areas B and C. In FIG. 23A, data B and C are in phase with each other. In FIG. 23B, data B and C are mutually out of phase with the basic period. Thus, a basic period T is a cycle at intervals of which data A is output. A long period is therefore expressed as a 2T. A cycle at intervals of which the ROM data reading means 72 reads data from the wave/control signal ROM 71 is expressed as a 1/2T.

As shown in FIG. 23A, when data B and C are in phase with each other, first, the ROM data reading means 72 reads data An, Bn, and Cn in that order and outputs them to the ROM data converting means 73. When the three kinds of data are collected, the ROM data converting means 73 outputs them in parallel. The ROM data converting means 73 therefore needs a register for holding input data. Specifically, when the data length handled by the wave/control signal ROM 71 is 8 bits, the ROM data converting means 73 converts three sets of 8-bit data into 24-bit data and outputs the 24-bit data. The ROM data reading means 72 then reads the next data An+1 and outputs it to the ROM data converting means 73. At this time instant, only a 1/2T has elapsed since data An is output. The ROM data converting means 73 holds the data An+1 for another 1/2T, and then outputs data An+1 instead of data An. In the meantime, data Bn and Cn are kept output as they are. While the ROM data converting means 73 is holding data An+1, the ROM data reading means 72 outputs the next data An+2. For this purpose, the ROM data converting means 73 must include a two-stage holding register for holding data A so that the ROM data converting means 73 can receive the next data An+2 while holding data An+1.

After outputting data An+1 to the ROM data converting means 73, the ROM data reading means 72 repeats the foregoing operation so as to output data An+2, Bn+2, Cn+2, and An+3. In other words, the ROM data reading means 72 accesses areas A, B, C, and A in the wave/control signal ROM 71 in that order, and repeats reading of consecutive data. The time required to read data from areas A, B, and C is a 3/2T, and the time required to read data from area A next is a 1/2T. The times come to a 2T. In short, during a period 2T that is twice longer than the basic period, reading from area A is executed twice, and reading from each of areas B and C is executed once.

As shown in FIG. 23B, when data B and C are mutually out of phase, areas A, B, A, and C in the wave/control signal ROM 71 are accessed in that order in order to read data consecutively.

In FIG. 24, basic period data includes only data A. Long period data is three-fold period data whose cycle is three times longer than the basic period, and has a data size that is three times larger than the data length handled by the wave/control signal ROM 71. The long period data includes data B, C, and D. In this case, a cycle at intervals of which the ROM data reading means 72 reads data from the wave/control signal ROM 71 is a 1/2T. Data A must be held by the ROM data converting means 73 for a 2T at longest. The ROM data converting means 73 must therefore include a three-stage holding register for holding data A.

As described in conjunction with FIG. 20, for generating the same wave component, part of ROM data stored in the wave/control signal ROM 71 is read out repeatedly. The present invention can apply to a wave generating circuit for repeatedly reading part of ROM data so as to generate the same wave component.

In this kind of wave generating circuit, the wave/control signal ROM 71 stores a portion of ROM data corresponding to a repetitive component of a wave, which can be generated by repeatedly reading the same data, together with data indicating the start and end of the repetitive component and data representing a repetition frequency. The ROM data reading means 72 identifies the data indicating the start and end of the repetitive component and data representing the repetition frequency, and repeats reading of the portion of ROM data corresponding to the repetitive component by the repetition frequency.

In this case, if the repetitive component is in phase with long period data, the corresponding repetitive portion of ROM data is just read repeatedly. There is no problem. However, when the repetitive component is out of phase with the long period data, a problem that when all ROM data that must be output is read at the start of the repetitive component, output is not performed in time, or a problem that a cycle of reading ROM data lags takes place.

Figure 25:
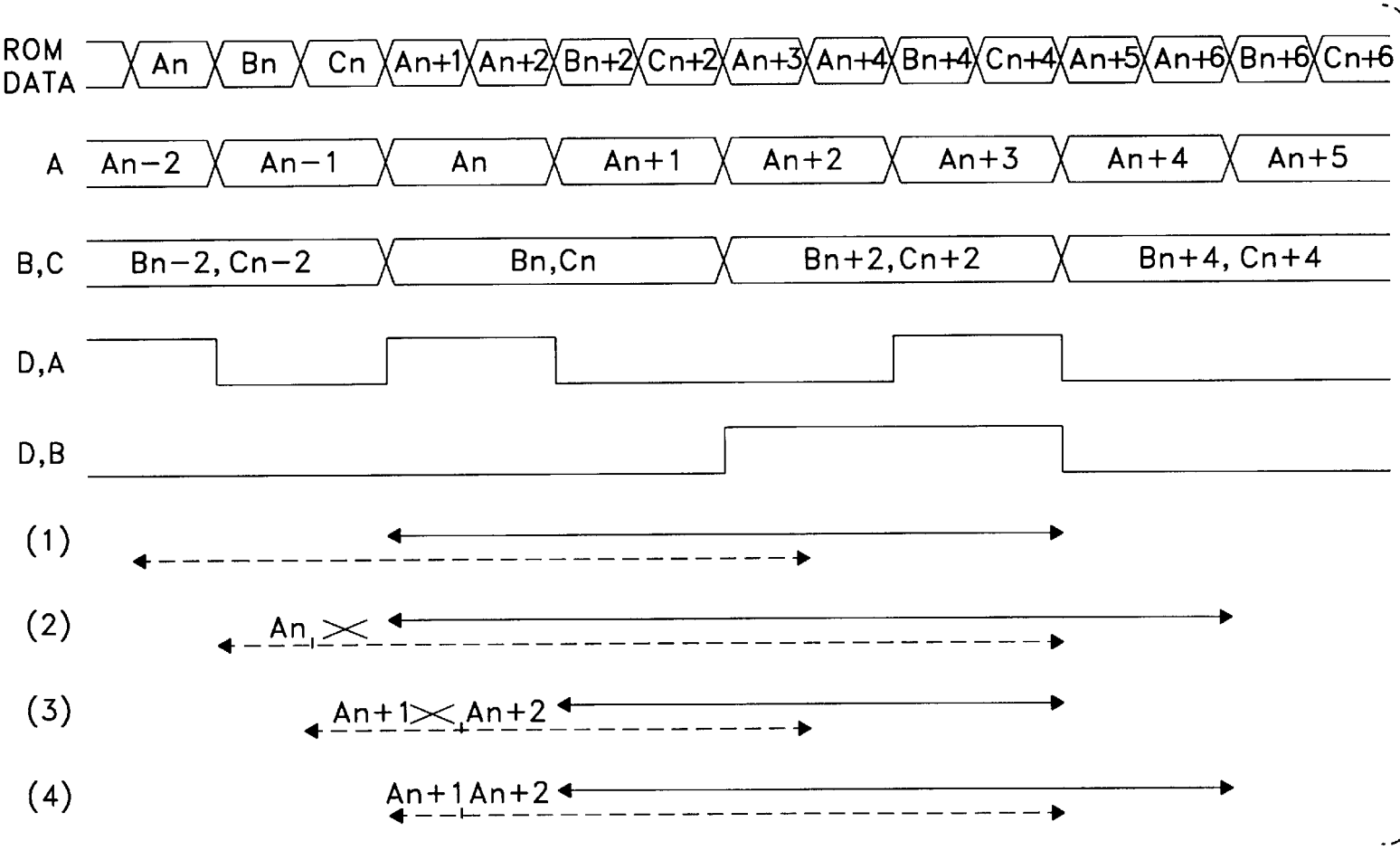
FIG. 25 is a diagram for explaining repetition.

FIG. 25 is a diagram for explaining the necessity of changing reading according to the relationship between the phases of a repetitive component and long period data.

Assume that ROM data is read and converted under the conditions shown in FIG. 23A, and that a generated wave whose cycle is a basic period is wave WA and a wave whose cycle is a twofold period is wave WB. The phases of a repetitive component and wave WB whose cycle is a twofold period may have, as shown in FIG. 25, a relationship (1) that the start and end of the repetitive component are in phase with wave WB, a relationship (2) that the start of the repetitive component is in phase with wave WB but the end thereof is out of phase with a relationship (3), that the start of the repetitive component is out of phase with wave WB but the end thereof is in phase therewith, or a relationship (4) that the start and end of the repetitive component are out of phase with wave WB.

Solid lines indicate the repetitive durations of a wave having the above respective relationships. Reading ROM data and outputting a result of conversion are carried out as illustrated. A repetition period during reading is indicated with a dashed line. When the relationship (1) is established, the repetition period is restarted at the completion of reading data An+3. The time required to complete output of the repetitive component of a wave after the completion of reading data An+3 is a 3/2T (where T denotes a basic period). Since the time is equal to a time 3/2T required to start output of the repetitive component after the start of reading data An at the start of the repetitive component, data read at the start of the repetitive component is used.

When the relationship (2) is established, the repetition period is restarted at the completion of reading data Cn+4. The time required to complete output of the repetitive component of a wave after the completion of reading data Cn+4 is a T. It takes a 3/2T to start output of the repetitive component after the start of reading data at the start of the repetitive component. If data An, Bn, and Cn were read, the start of the repetitive component of the wave would not be output in time. Twofold period data Bn and Cn, which are output at the time when data indicating that the repetitive component starts is detected, are stored. When the repetition period is restarted at the completion of reading data Cn+4, data An alone is read, and stored data is used as data Bn and Cn. In this case, it takes only a 1/2T to complete reading data An. Reading is suspended for the remaining 1/2T.

When the relationship (3) is established, it is necessary to output data An+1, Bn, and Cn at the start of the repetitive component of a wave. The timing of reading data Bn comes a 2T earlier than the start of the repetitive component. If the repetition period were restarted according to the timing of reading data Bn, the start of the repetitive component could not be output in time. The data stored as mentioned above is used as twofold period data Bn and Cn, and data An+1 alone is read out. After the data An+1 is read out, reading is suspended for a 1/2T. Thereafter, reading data An+2 is started.

When the relationship (4) is established, if the repetition period were restarted according to the timing of reading data Bn, the start of the repetitive component could not be output in time. Therefore, stored data is used as twofold period data Bn and Cn, and data An+1 alone is read out. In this case, reading data An+2 is started immediately after the completion of reading data An+1.

Figure 26:
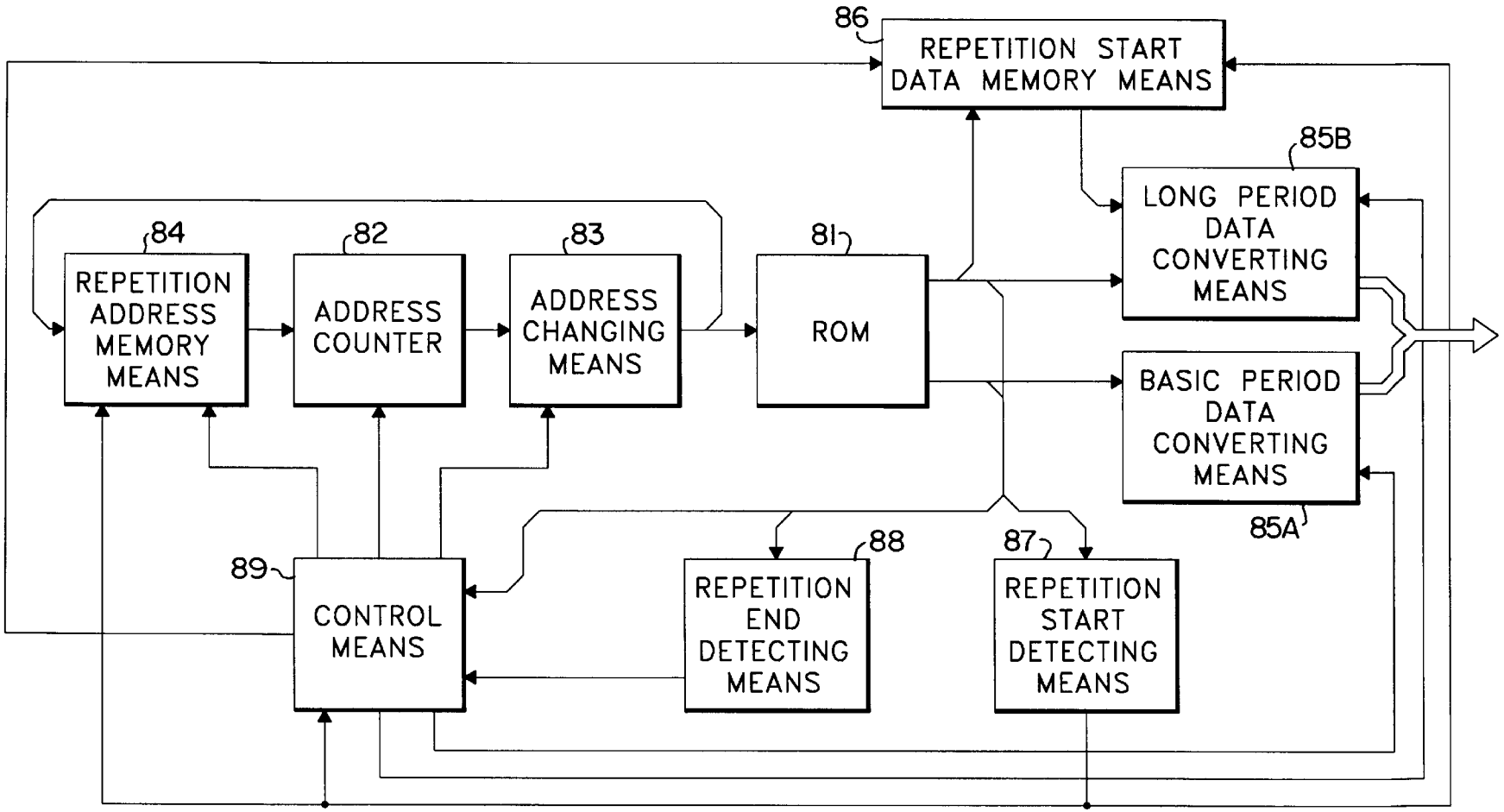
FIG. 26 is a diagram showing the basic configuration of a driving wave generating circuit having a repetition facility.
Figure 27A:
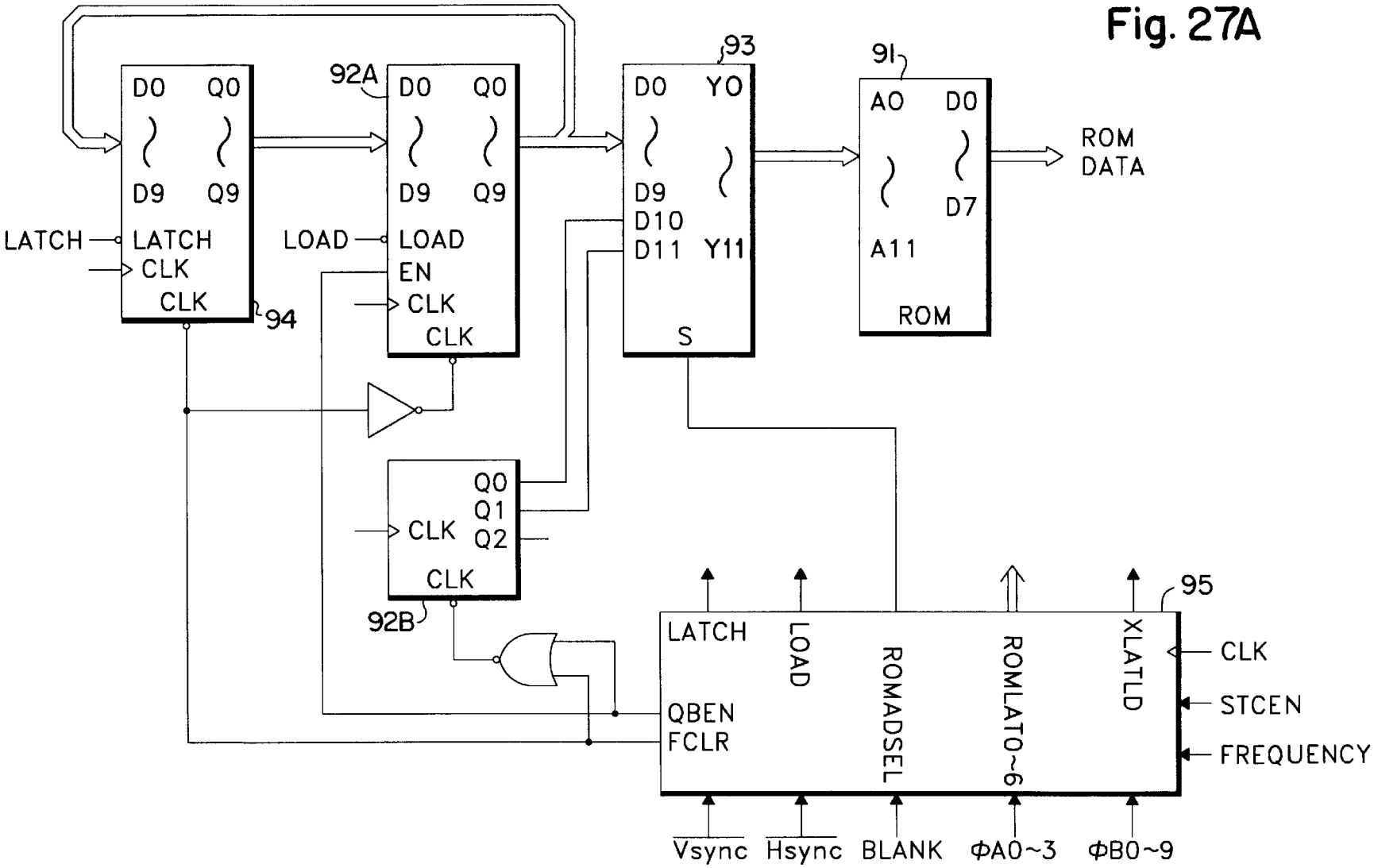
FIGS. 27A, 27B, 27C, and 27D are diagrams showing a driving wave generating circuit of the second embodiment.
Figure 27B:
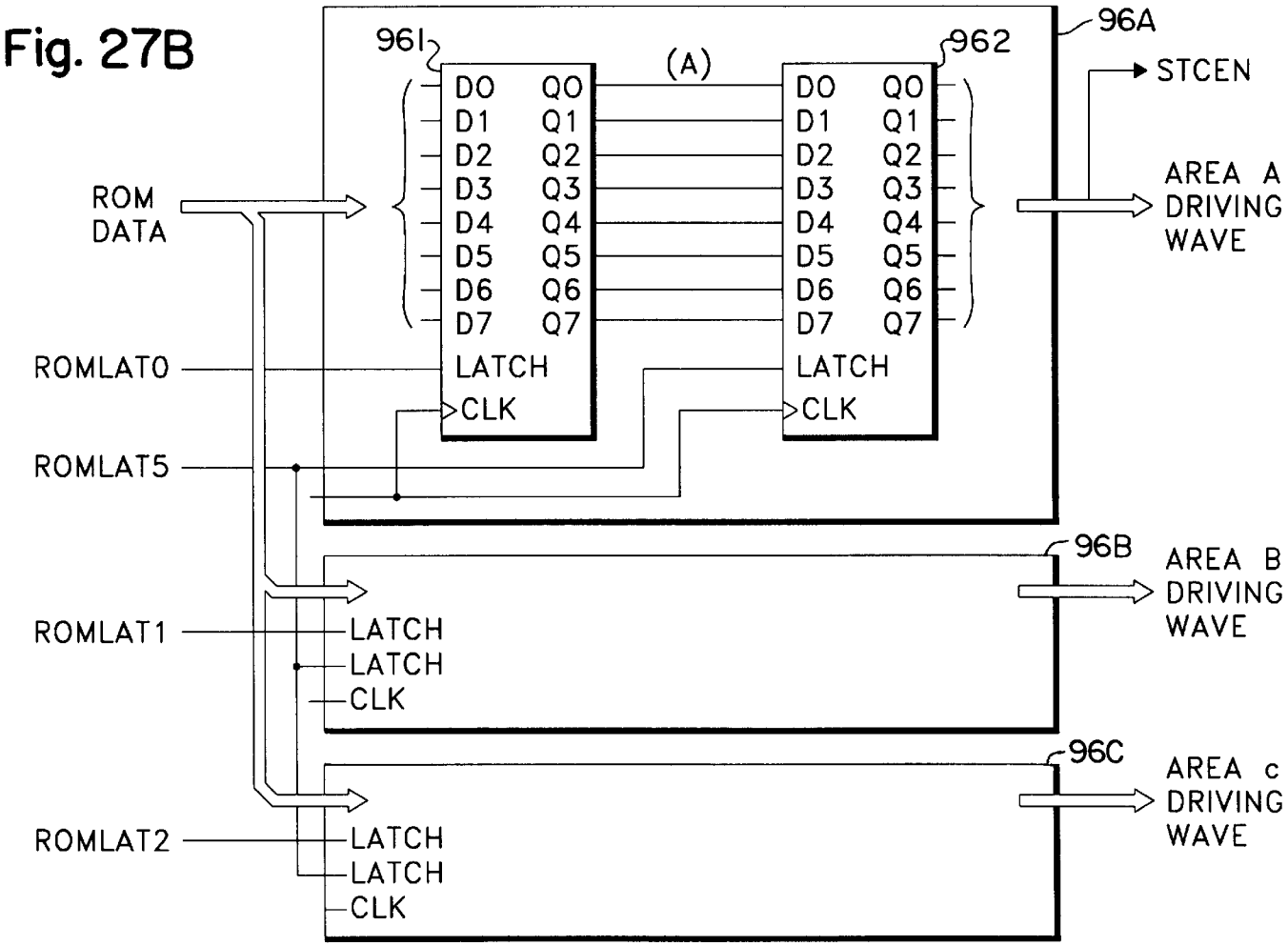
Figure 27C:
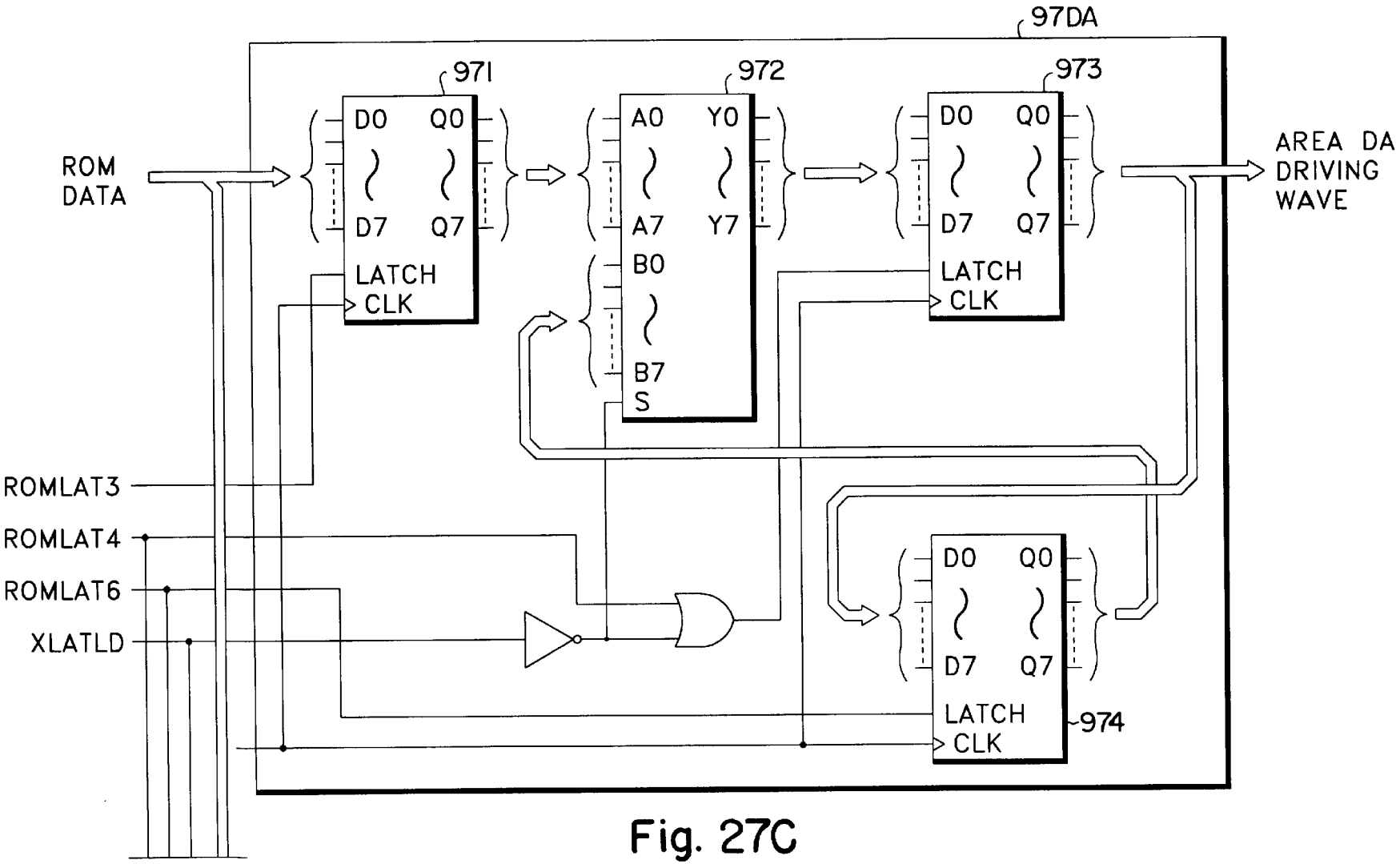
Figure 27D:
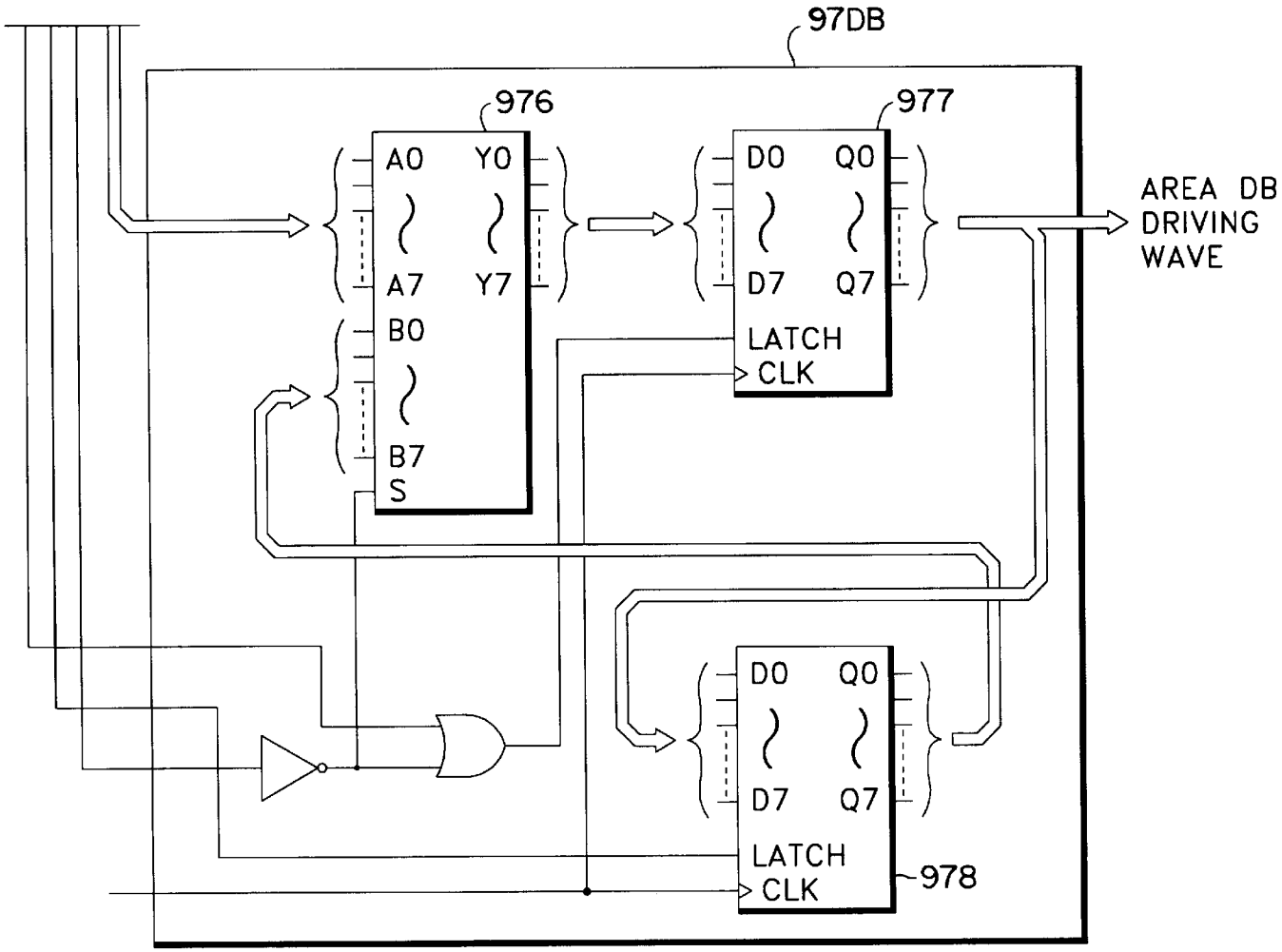

FIG. 26 is a diagram showing a basic configuration in which the present invention applies to a wave generating circuit for repeatedly reading part of the ROM data in the reading order shown in FIG. 23A and then generating a wave.

As shown in FIG. 26, the wave generating circuit comprises: a wave/control signal ROM 81 for storing ROM data concerning a wave and its generation with the data split into basic period data and long period data; an address counter 82 for generating an address signal used to consecutively read ROM data stored in the wave/control signal ROM 81; an address changing means 83 for changing an address signal output from the address counter 82 according to which of the basic period data and long period data is read; a repetitive address memory means 84 for storing a leading address in an area that contains data corresponding to a repetitive component of a wave; a basic period data converting means 85A for converting basic period data; a long period data converting means 85B for converting long period data; a repetition start data memory means 86 for storing long period data at the start of the repetitive component; a repetition start phase judging means 87 for judging if the start of the repetitive component of a wave is in phase with the long period data; a repetition end phase judging means 88 for judging if the end of the repetitive component of a wave is in phase with the long period data; and a control means 89.

In case either the start or end of the repetitive component of a wave is out of phase with long period data, or in case both the start and end of the repetitive component thereof are out of phase therewith, when the repetitive component moves from the end thereof back to the start thereof during generation of the wave, the ROM data converting means 73 continually generates the wave according to data stored in a start long period data memory means.

Furthermore, in case either the start or end of the repetitive component of a wave is out of phase with long period data, when the repetitive component moves from the end thereof back to the start thereof during generation of the wave, the ROM data reading means 72 suspends reading of ROM data from the wave/control signal ROM 71 and thus adjusts timing.

Owing to the foregoing configuration, whatever phase the repetitive component of a wave has in relation to long period data, repetition can be achieved.

Figure 28:
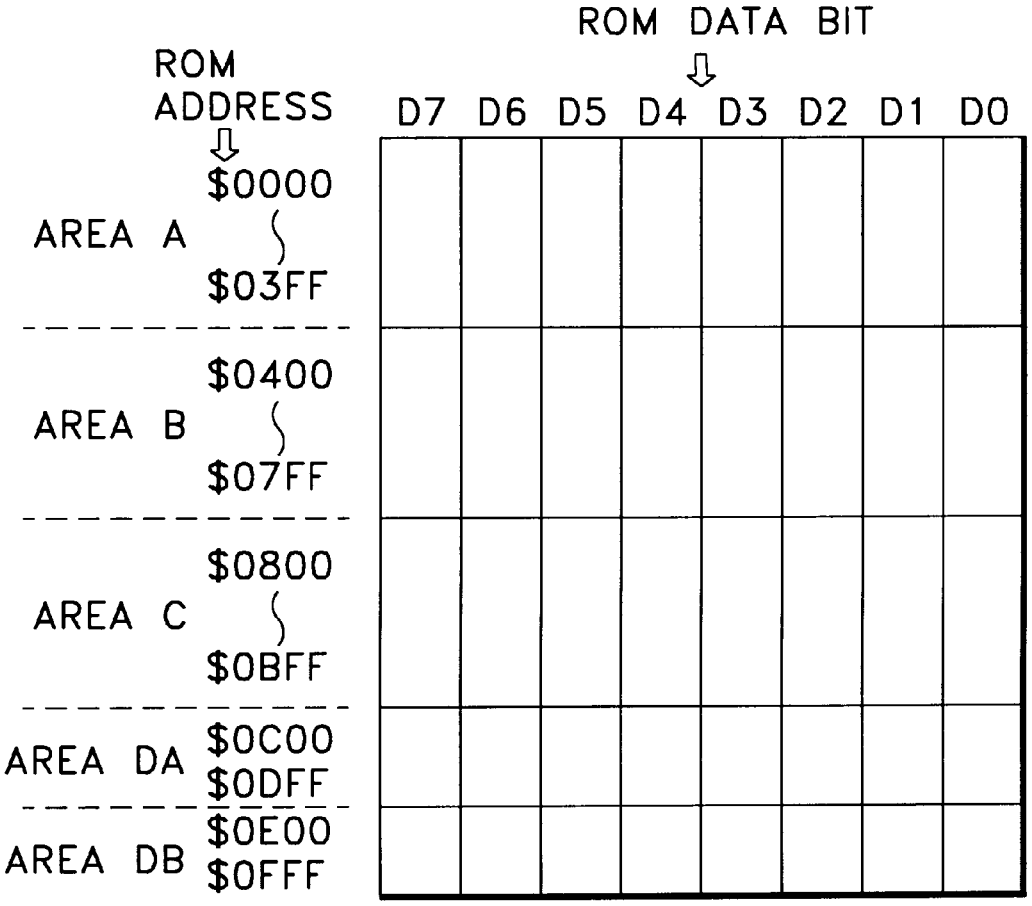
FIG. 28 is a diagram showing a ROM memory map in the embodiment.

FIGS. 27A to 27D are diagrams showing the configuration of a second embodiment in which the present invention applies to a driving wave generating circuit for the color plasma display panel (PDP) display shown in FIG. 18. FIG. 28 shows a memory map for ROM data stored in a driving wave/control signal ROM of this embodiment. The driving wave/control signal ROM handles a data length of 8 bits. The basic period data of the ROM data, which must be read at a frequency of 3 MHz, is split and stored in areas A, B, and C. Twofold period data that can be read at a frequency of 1.5 MHz is split and stored in areas DA and DB. It can therefore be said that the basic period data has a data length of 17 bits or larger and 24 bits or smaller, and the twofold period data has a data length of 9 bits or larger and 16 bits or smaller. Reading ROM data is performed at a frequency of 12 MHz. Two areas DA and DB are read once while three areas A, B, and C are being read twice. Furthermore, the twofold period data stored in areas DA and DB are in phase with each other and must be output simultaneously.

A driving wave generating circuit of the second embodiment comprises: a driving wave/control signal ROM 91 for storing data representing a driving wave and control data used to control generation of the driving wave in this circuit; two address counters 92A and 92B for generating an address signal to be supplied to the ROM 91; an address changing unit 93 for converting address signals output from the address counters 92A and 92B into an appropriate address during reading of ROM data; an address memory unit 94 for holding a leading address of data at the start of the repetitive component of a driving wave; a control unit 95 responsible for various kinds of control; and ROM data converting units 96A to 96C and 97DA and 97DB for latching ROM data output from the driving wave/control signal ROM 91 according to signals ROMLAT0 to 6 sent from the control unit 5. Furthermore, the ROM data converting unit 96A includes two stages of latches 961 and 962 for holding ROM data. The ROM data converting units 96B and 96C have the same circuitry as the ROM data converting unit 96A except for the point that the latched signals are different. The ROM data converting unit 97A includes three latches 971, 973, and 974 and a selector 972. The ROM data converting unit 97DB has the same circuitry as the ROM data converting unit 25DA except that the latch 971 is excluded. A selector 976 corresponds to the selector 972, and latches 977 and 978 correspond to the latches 973 and 974.

The relationship of correspondence between the basic circuitry shown in FIG. 26 and the configuration of FIGS. 27A to 27D is such that: the wave/control signal ROM 81 corresponds to the driving wave/control signal ROM 91; the address counter 82 corresponds to the address counters 92A and 92B; the address changing means 83 corresponds to the address changing unit 93; the repetition address memory means 84 corresponds to the address memory unit 94; the basic period data converting means 85A corresponds to the ROM data converting units 96A to 96C; the long period data converting means 85B corresponds to the ROM data converting units 97DA and 97DB; and the repetition start data memory means 86 corresponds to the latches 974 and 978. The start phase judging means 87, repetition end phase judging means 88, and control means 89 are realized by the control unit 95.

FIGS. 29A to 29D, 30A to 30D, 31A to 31D, and 32A to 32D are timing charts showing the operation of the driving wave generating circuit of this embodiment. FIGS. 29A and 29B, 29C and 29D, 30A and 30B, 30C and 30D, 31A and 31B, 31C and 31D, 32A and 32B, and 33C and 33D are each halves of a timing chart divided because of a large number of signals must be illustrated. Each pair shares the same time axis. Moreover, the pairs of FIGS. 29A and 29B and FIGS. 29C and 29D, the pairs of FIGS. 30A and 30B and FIGS. 30C and 30D, the pairs of FIGS. 31A and 31B and FIGS. 31C and 31D, and the pairs of FIGS. 32A and 32B and FIGS. 33C and 33D are each mated. The mated pairs show the start and end of the repetitive component of a wave under the conditions corresponding to the relationships between the phases of the repetitive component and long period data. FIGS. 29C and 29D, FIGS. 30C and 30D, FIGS. 31C and 31D, and FIGS. 33C and 33D show the same signals as FIGS. 29A and 29B, FIGS. 30A and 30B, FIGS. 31A and 31B, and FIGS. 32A and 32B respectively.

Referring to the above drawings, the operation will be described. In the drawings, CLK denotes a clock with a frequency of 12 MHz. FCLR denotes a signal that is output from the control unit 95 at the start of operation and clears the address counters 92A and 92B and address memory 94. QA0, QA1, and QA2 denote signals output from the address counter 92B. QB0 to QB9 denote signals that are output from the address counter 92B and input as signals D0 to D9 to the address changing unit 93. ROM Address means address signals Y0 to Y11 output from the address changing unit 93. ROM Data means data output from the driving wave/control signal ROM 91. A, B, and C each denote data existing between each pair of latches in the ROM data converting units 96A to 96C. DA denotes data existing between the latches 961 and 962 in the ROM data converting unit 97DA. A0 to A7, B0 to B7, C0 to C7, DA0 to DA7, and DB0 to DB7 denote outputs from the ROM data converting units 96A to 96C, 97DA, and 97DB. Address Memory means an address stored in the address memory unit 94. Incidentally, address values are all expressed in hexadecimal notation. As mentioned above, twofold period data stored in areas DA and DB are in phase with each other and must be read simultaneously. Reading is therefore achieved by repeating the reading of areas A, B, C, DA, DB, A, B, and C in that order.

Figure 29A:
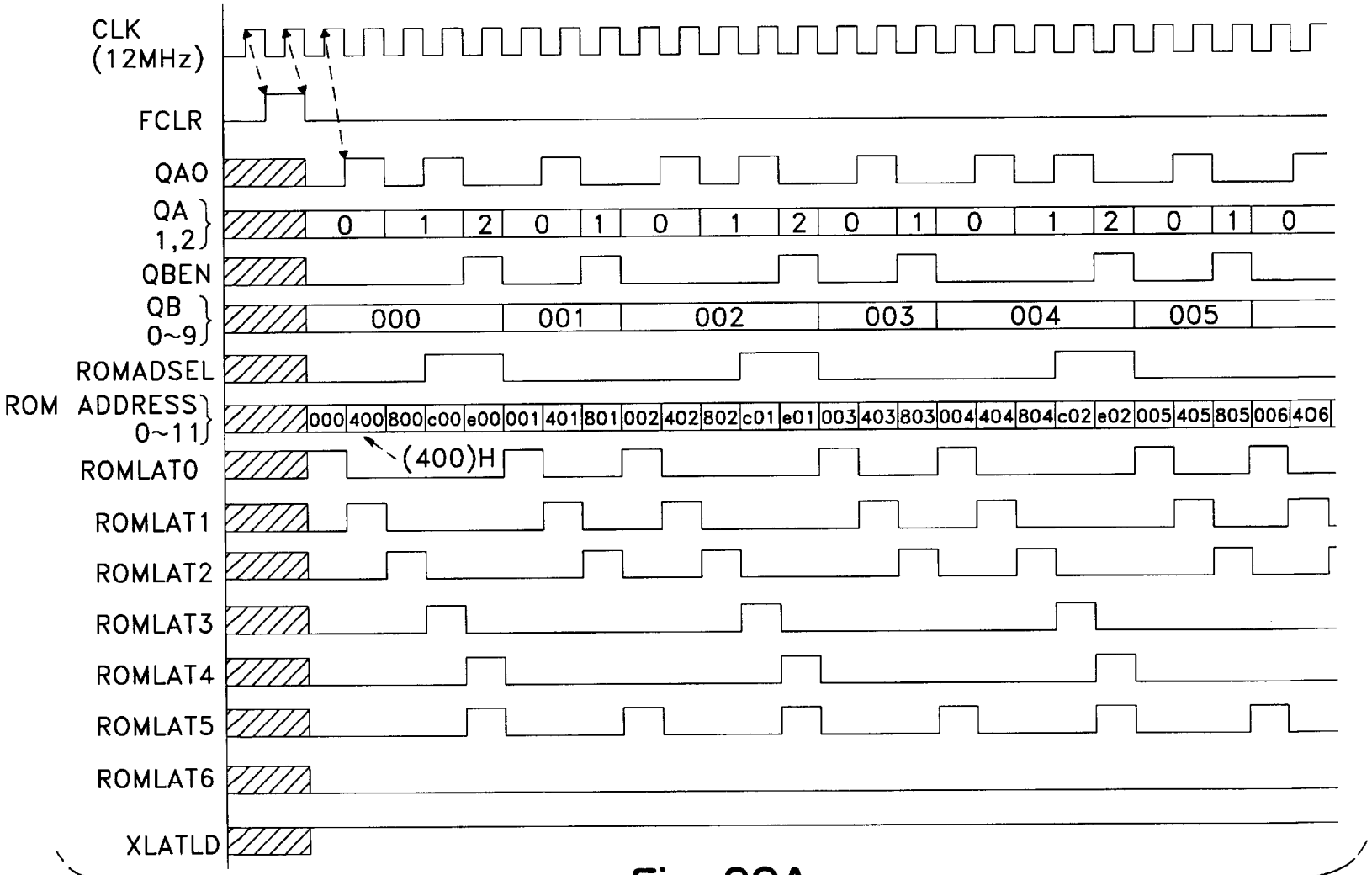
FIGS. 29A and 29B are timing charts showing an operation to be performed in a normal state in the embodiment.
Figure 29B:
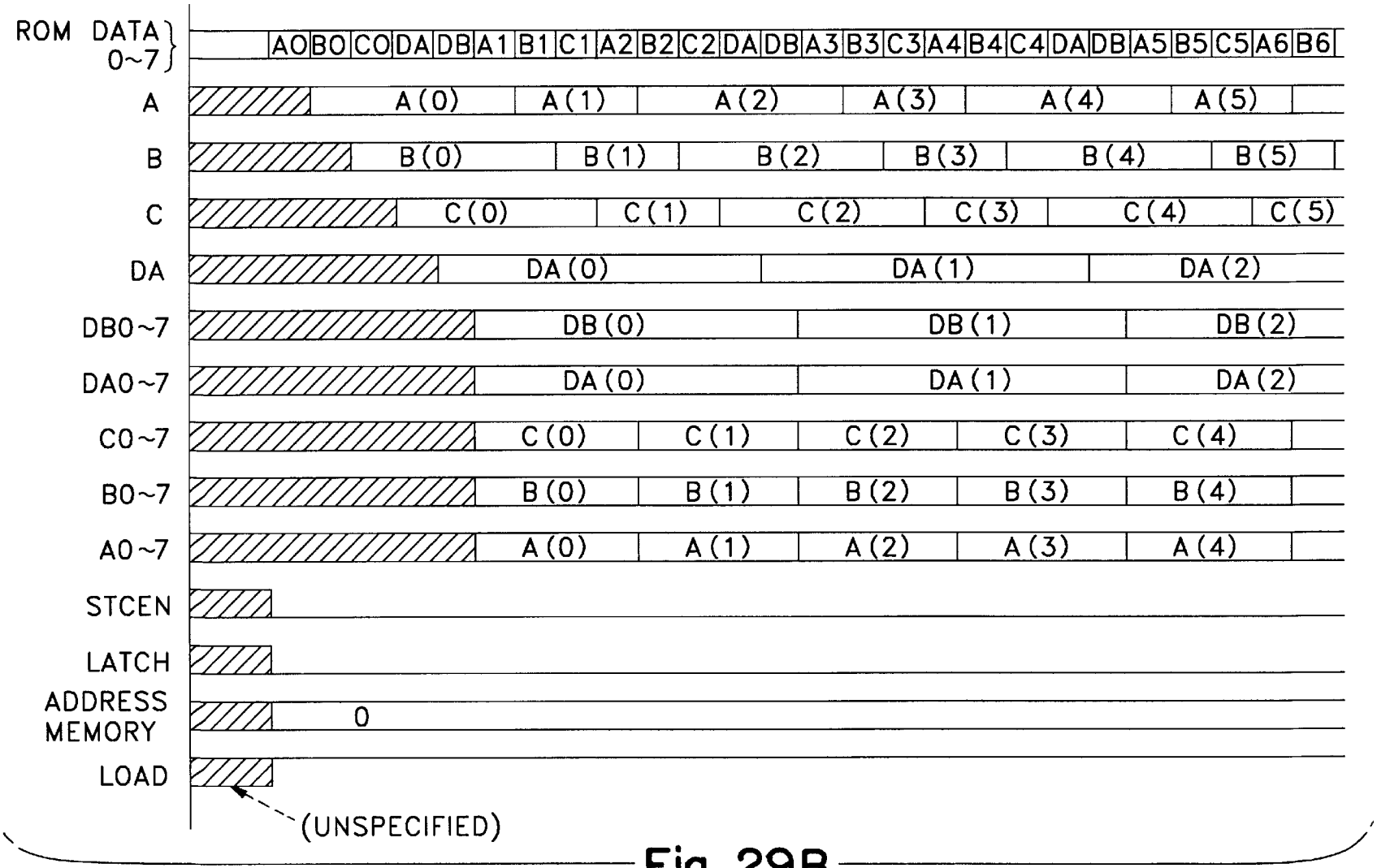
Figure 30A:
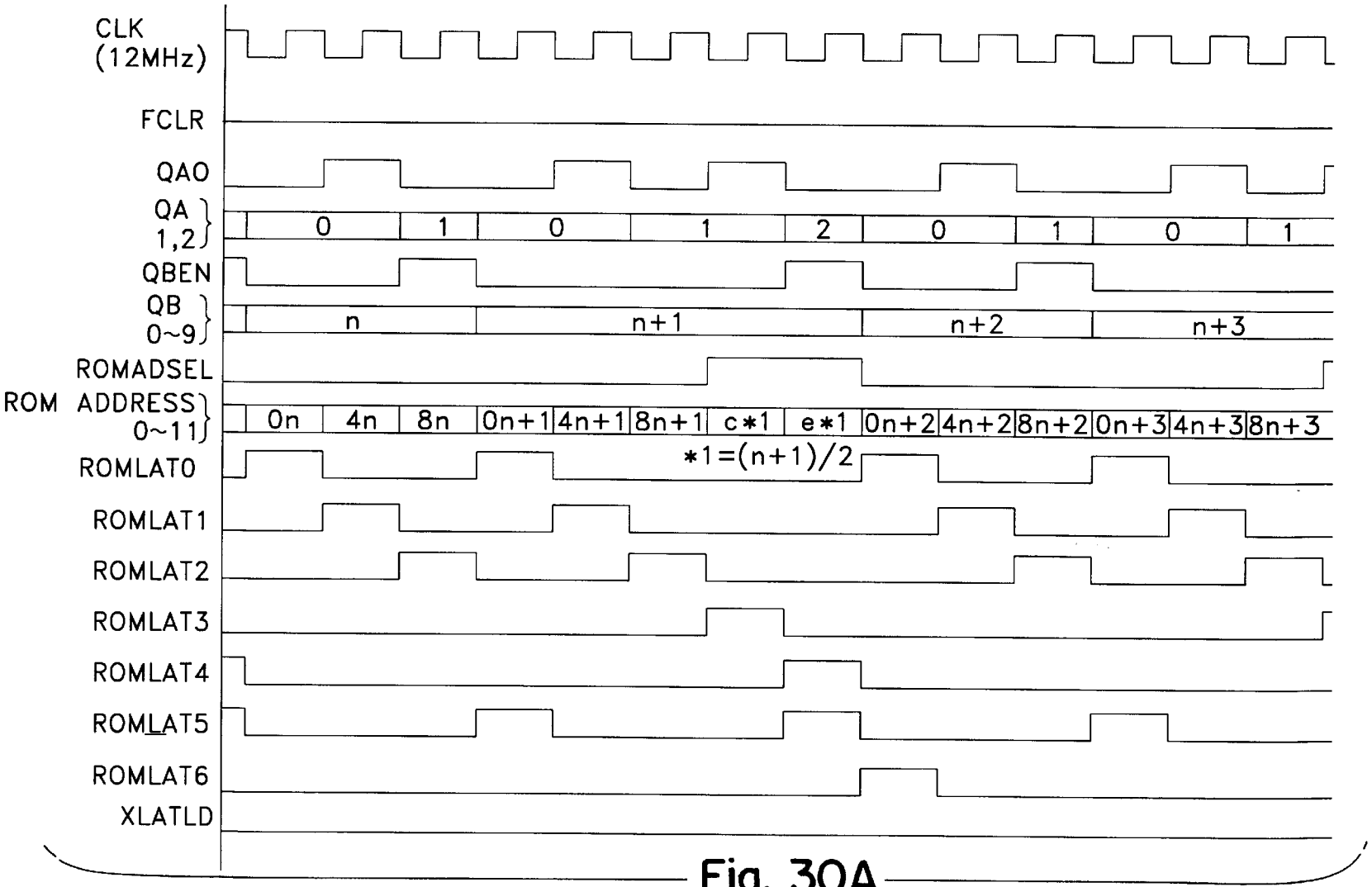
FIGS. 30A, 30B, 30C, and 30D are timing charts showing an operation to be performed when both the start and end of a repetitive component of a wave are in phase with long period data in the embodiment.
Figure 30B:
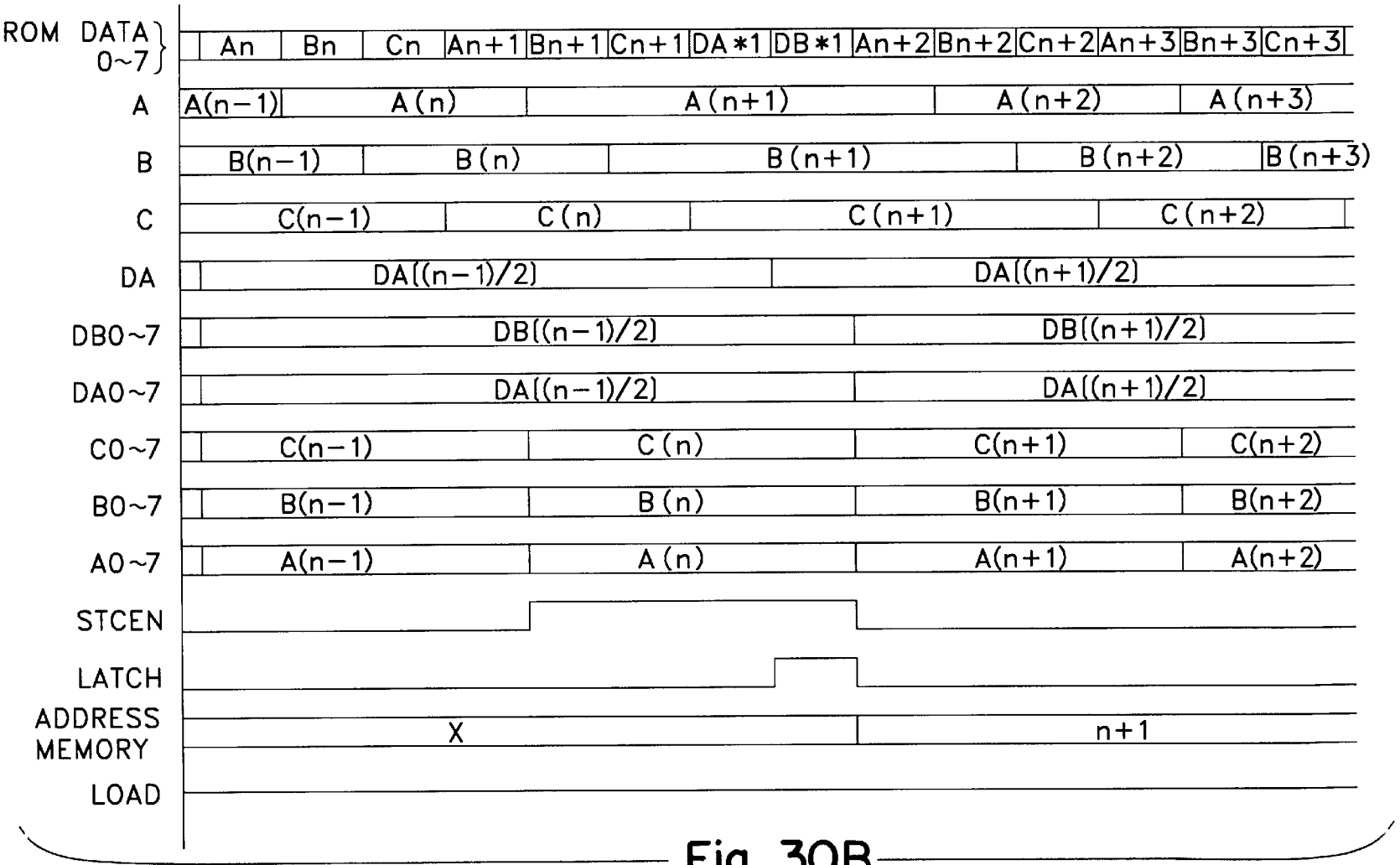
Figure 30C:
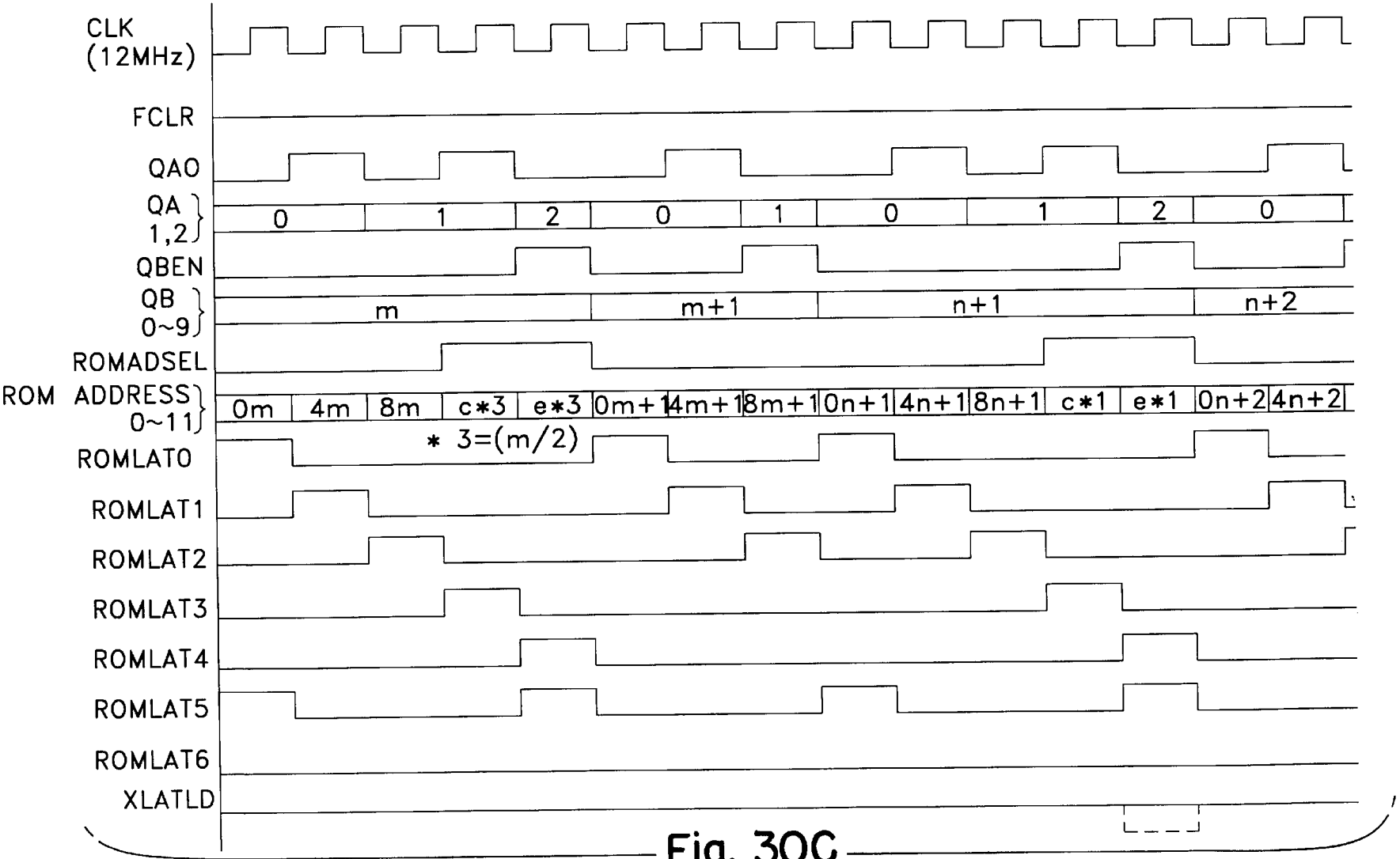
Figure 30D:
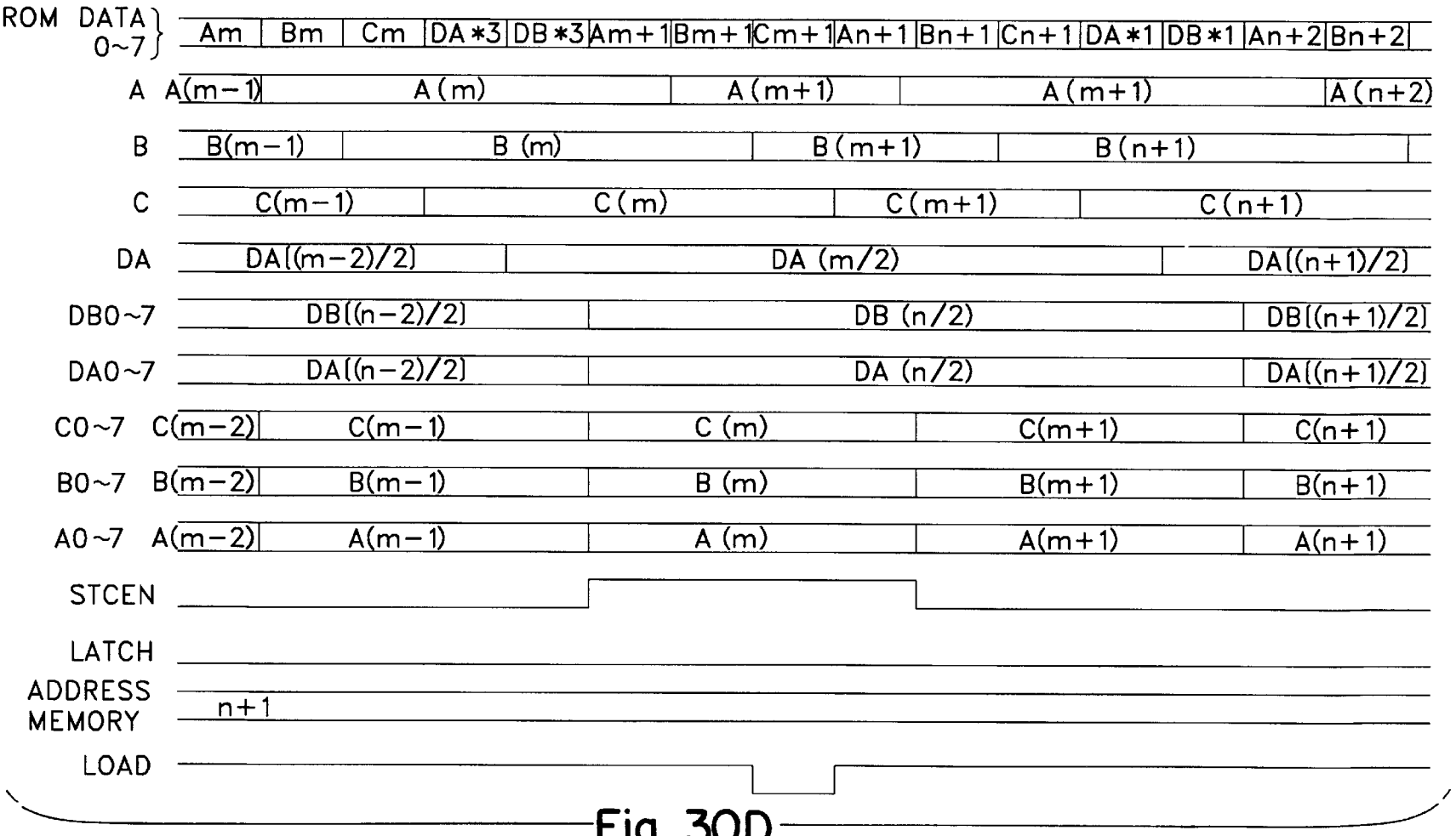

FIGS. 29A and 29B are timing charts showing an normal operation in which repetition is not made. The ROM address counter 92B is controlled to repeat the operation of counting up from 0 to 4 and the operation of counting up from 0 to 2 in response to a signal QBEN. An output QA0 or QA1 of the address counter 92B is input as a high-order bit to the address changing unit 93. When the count value provided by the ROM address counter 92B ranges from 0 to 2, the address changing unit 93 outputs input values D0 to D11 as signals Y0 to Y11 in their entireties. When the count value provided by the ROM address counter 92B is 3 or 4, a signal ROMADSEL output by the control unit 95 is driven high. Accordingly, the address changing unit 93 causes signals Y10 and Y11 to go high. The address changing unit 93 shifts the input values D0 to D9 rightward by one bit; that is, halves an indicated number and outputs the halved number in the form of the signals Y0 to Y8. At the same time, the address changing unit 93 reverses the input value D10 and outputs a resultant value in the form of the signal Y9. When the count value is 3, the signal Y9 is driven low. When the count value is 4, the signal Y9 is driven high. When the ROM address counter 92B counts up from 0 to 4, the count value serves as an address signal used to access areas A, B, C, DA, and DB in an orderly manner. When the ROM address counter 92B counts up from 0 to 2, the count value serves as an address signal used to access areas A, B, and C in an orderly manner. The ROM address counter 92A produces an address signal used to access addresses in each area in an orderly manner. Thus, data is read from areas A, B, C, DA, DB, A, B, and C in that order. Read data is held as signals ROMLAT0 to 3 in the respective latches on the first stages in the ROM data converting units 96A to 96C and 97DA. When all the data in areas A, B, C, DA, and DB are read out, signals ROMLAT4 and ROMLAT5 are output, held in the respective latches on the second stages in the ROM data converting units 96A to 96C, 97DA, and 97DB, and then output. In case areas DA and DB are not read, when all the data in areas A, B, and C are read out, the signal ROMLAT5 is output, held in the latches on the second stages in the ROM data converting units 96A to 96C, and then output. In short, only the outputs of the ROM data converting units 96A to 96C change, but the outputs of the ROM data converting units 97DA and 97DB do not change. As mentioned above, data are read from areas A, B, C, DA, DB, A, B, and C in that order, whereby a wave is generated. FIGS. 29A and 29B does not illustrate a repetitive component of a wave. A signal STCEN whose value is stored in the driving wave/control signal ROM 91, is read and then output by the ROM data converting unit 96A, and indicates that the repetitive component remains low.

FIGS. 30A to 30D are timing charts for explaining repetition performed when the start and end of a repetitive component of a wave are coincident with the cycle of twofold period data; that is, when the repetitive component is in phase with the twofold period data. As mentioned above, data is read from areas A, B, C, DA, DB, A, and B in that order. Herein, assume that after basic period data is read from an even address in the respective areas, twofold period data is read succeedingly. As illustrated, a value of the signal STCEN indicating the start of the repetitive component is stored in an odd address n in area A, while a value thereof indicating the end of the repetitive component is stored at an even address m in area A. After data A(n−1), B(n−1), C(n−1), DA((n−1)/2), and DB((n−1)/2) are read out and output altogether, data A(n), B(n), and C(n) are read out and output. Data A(n) contains the value driving the signal STCEN high. While data A(n) is being output, the signal STCEN remains high. In response to the signal STCEN, the control unit 95 outputs a latch signal Latch to the address memory unit 94 during the duration of the last one of clocks output while data A(n) is being output. Accordingly, the address memory unit 94 latches an address signal n+1 being output at that time and holds the address signal. When the signal STCEN is output at the start of the repetitive component, the control unit 95 outputs a signal ROMLAT6. The latches 974 and 978 hold data DA((n+1)*2) and DB((n+l)*2) respectively according to the signal ROMLAT6.

As reading data corresponding to the repetitive component goes on, data A(m) containing the value of the signal STCEN indicating the end of the repetitive component is read out. The signal STCEN remains high while data A(m) is being output. In response to the signal STCEN, the control unit 95 outputs a signal Load to the address counter 32A during reading of data C(m). In response to the signal Load, the address counter 92A loads an address signal n+1 output from the address memory unit 94. After reading data C(m+1) is completed, reading data A(n+1), B(n+1), C(n+1), DA((n+1)/2), and DB((n+1)/2) in that order is started. At the same time, data A(m+1), B(m+1), and C(m+1) that have already been read are output after the passage of one cycle of the clock. Thereafter, data A(n+1), B(n+1), C(n+1), DA((n+1)/2), and DB((n+1)/2) are output. The above operation is repeated at a repetition frequency. Consequently, data DA((n+1)*2) and DB((n+1)*2) that are held in the latches 974 and 978 remain unused.

Figure 31A:
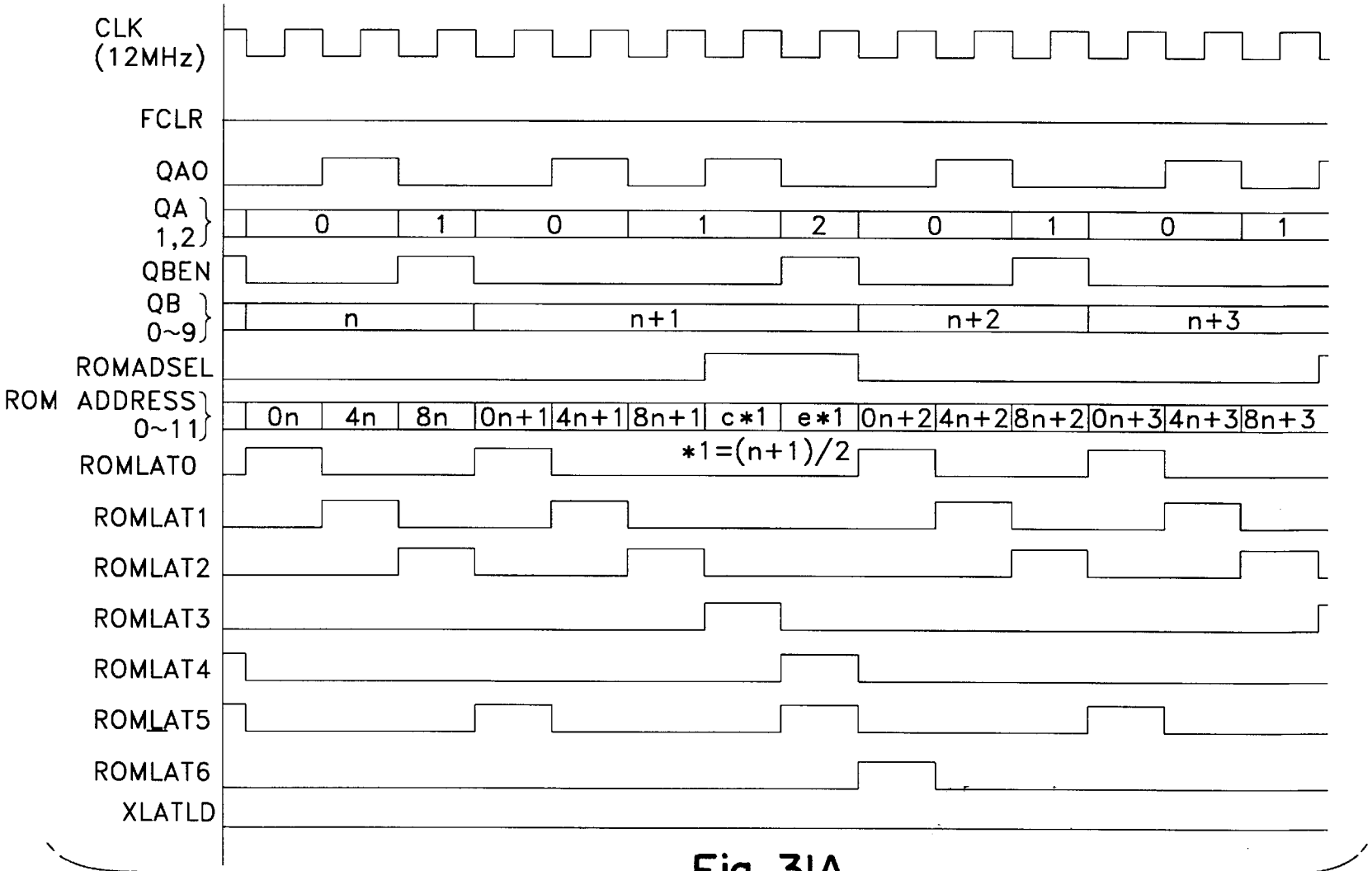
FIGS. 31A, 31B, 31C, and 31D are timing charts showing an operation to be performed when the start of the repetitive component is in phase with the long period data but the end thereof is out of phase therewith in the embodiment.
Figure 31B:
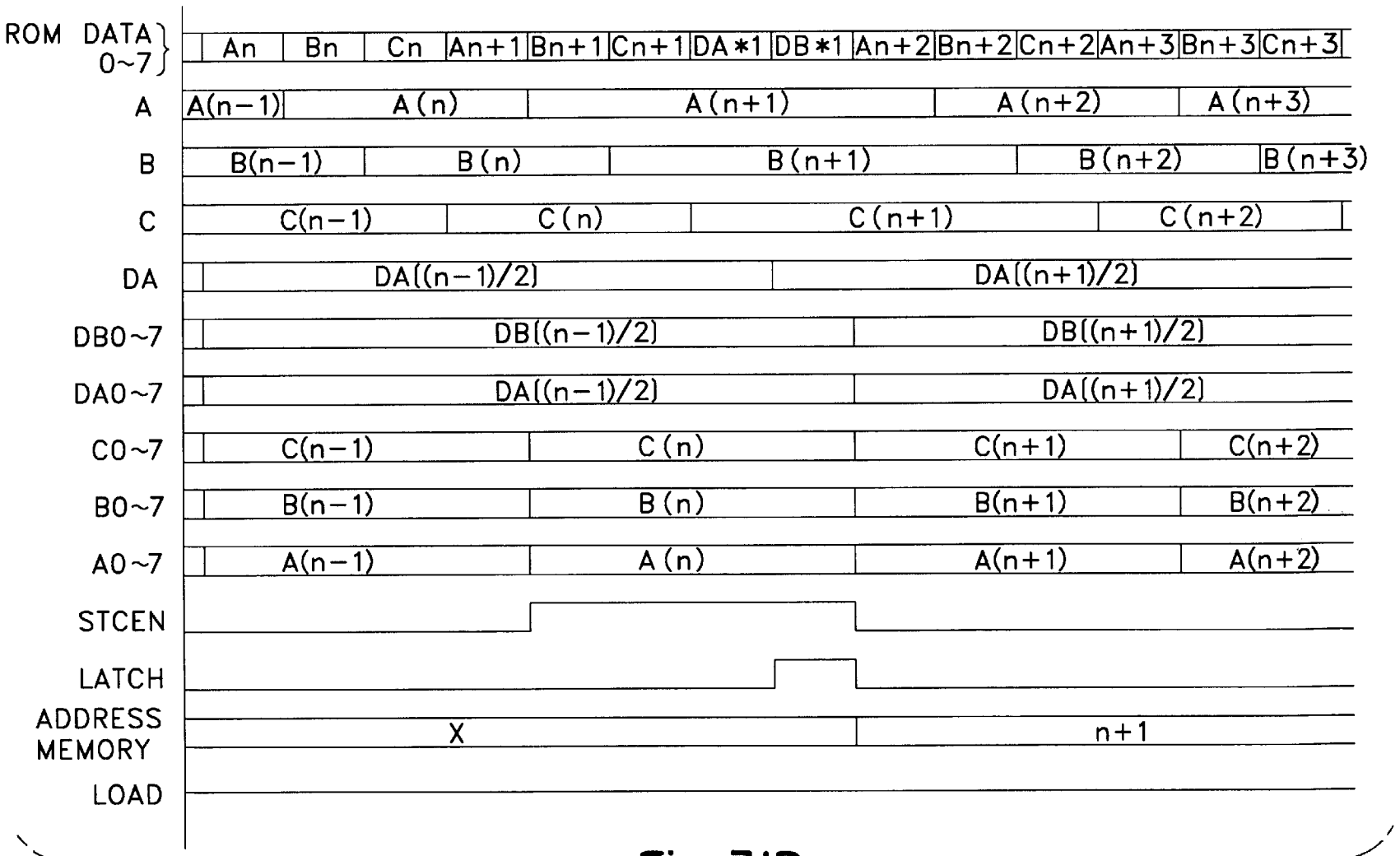
Figure 31C:
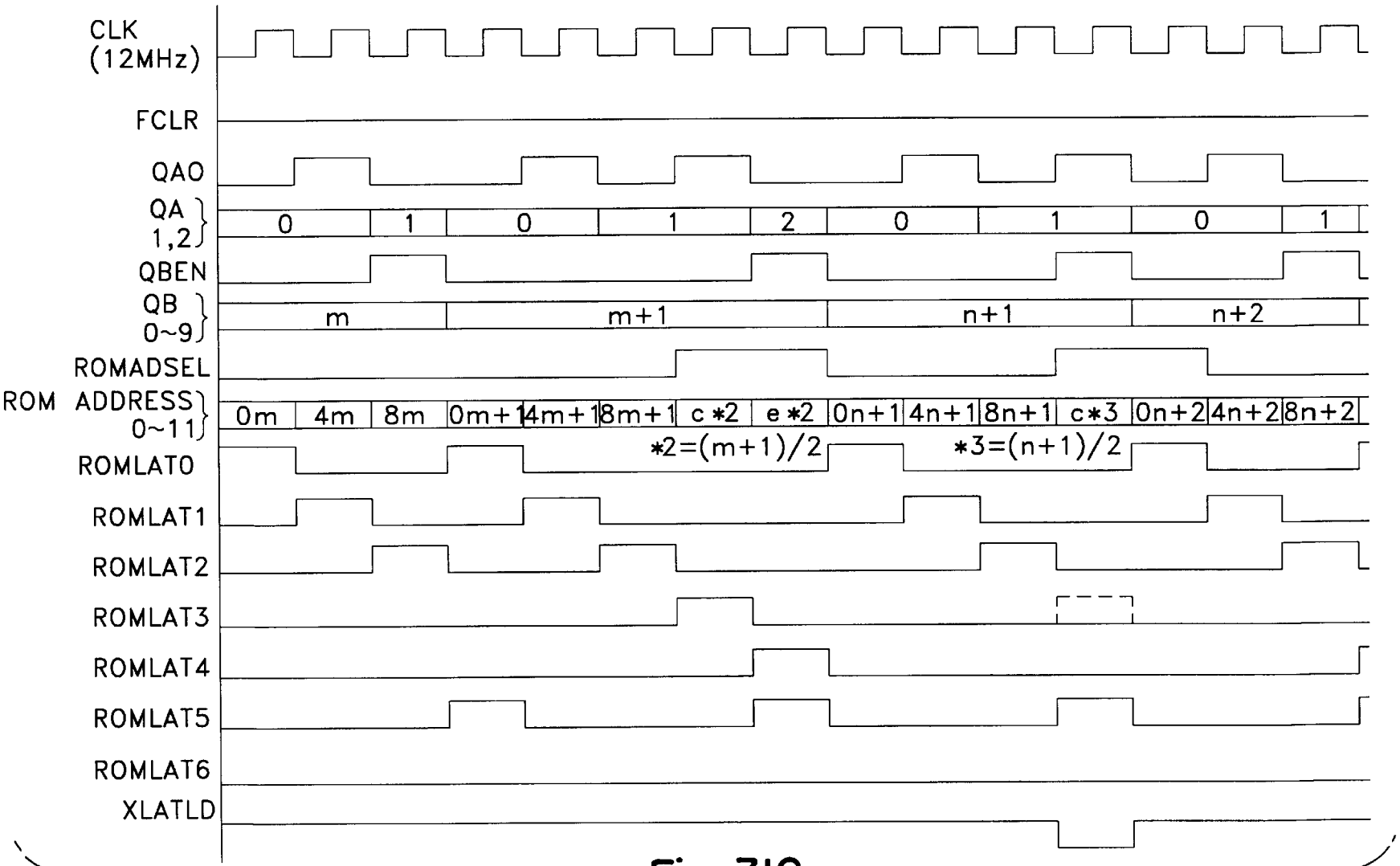
Figure 31D:
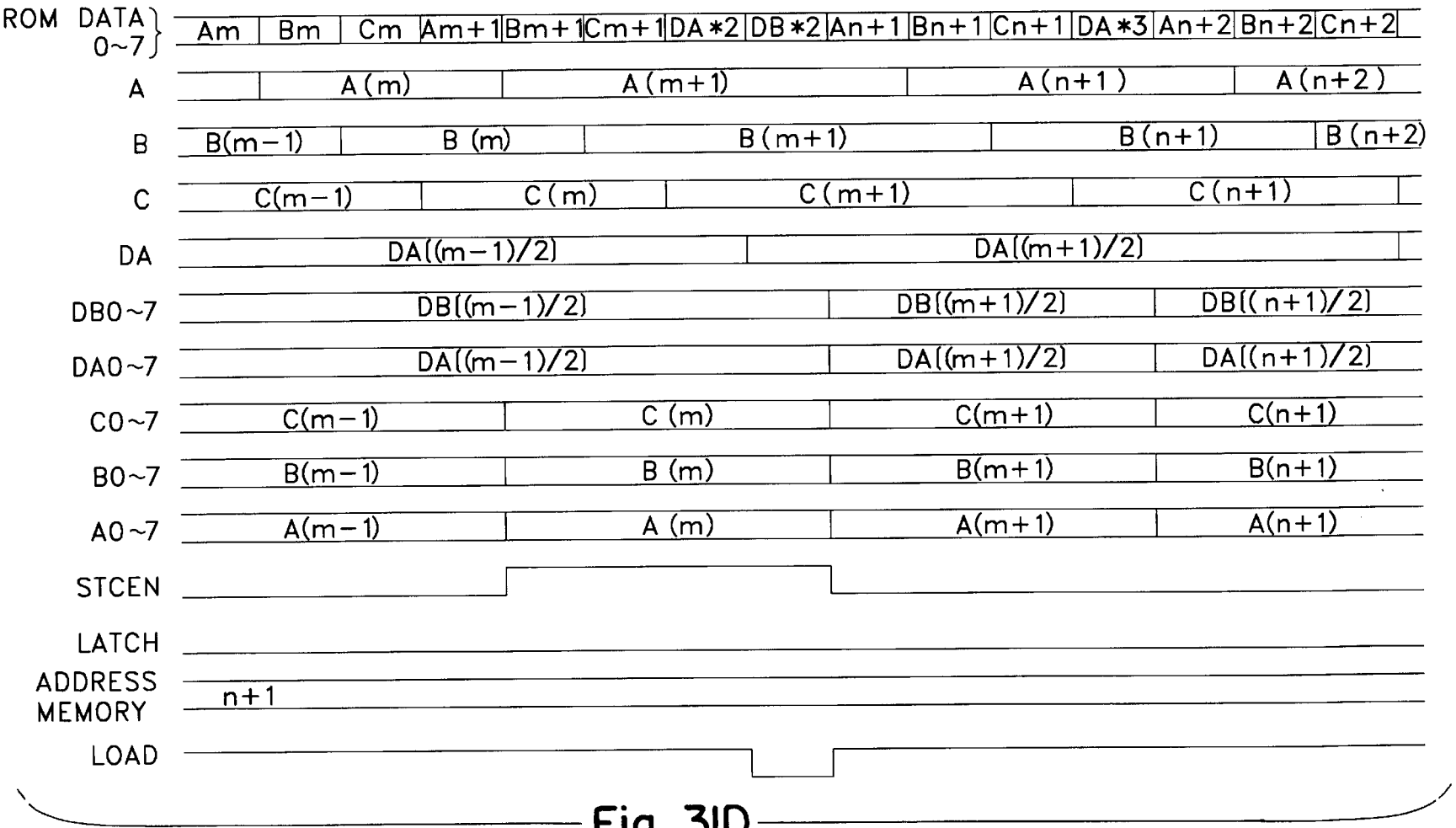
Figure 32A:
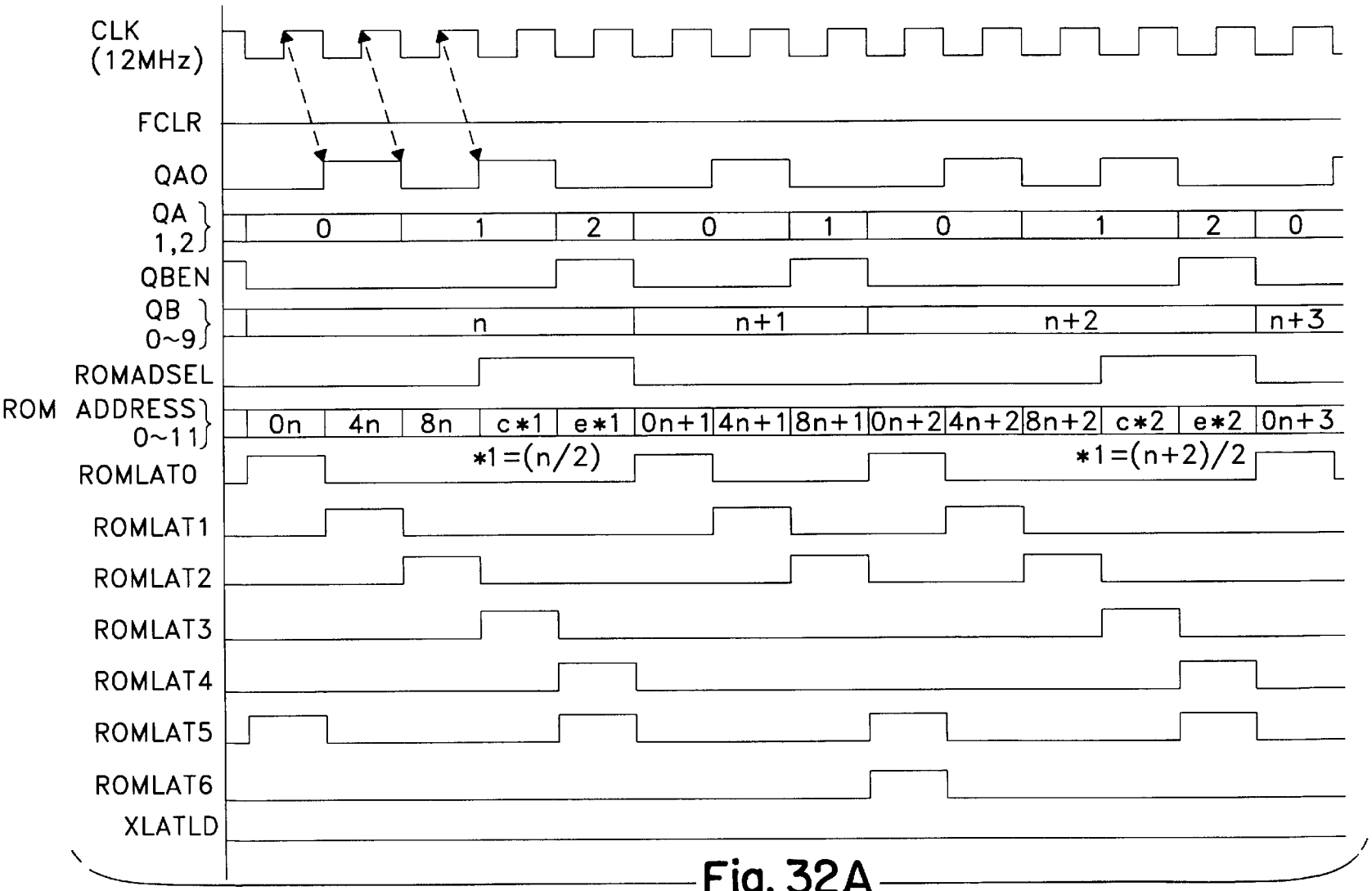
FIGS. 32A, 32B, 32C, and 32D are timing charts showing an operation to be performed when the start of the repetitive component is out of phase with the long period data but the end thereof is in phase therewith in the embodiment.
Figure 32B:
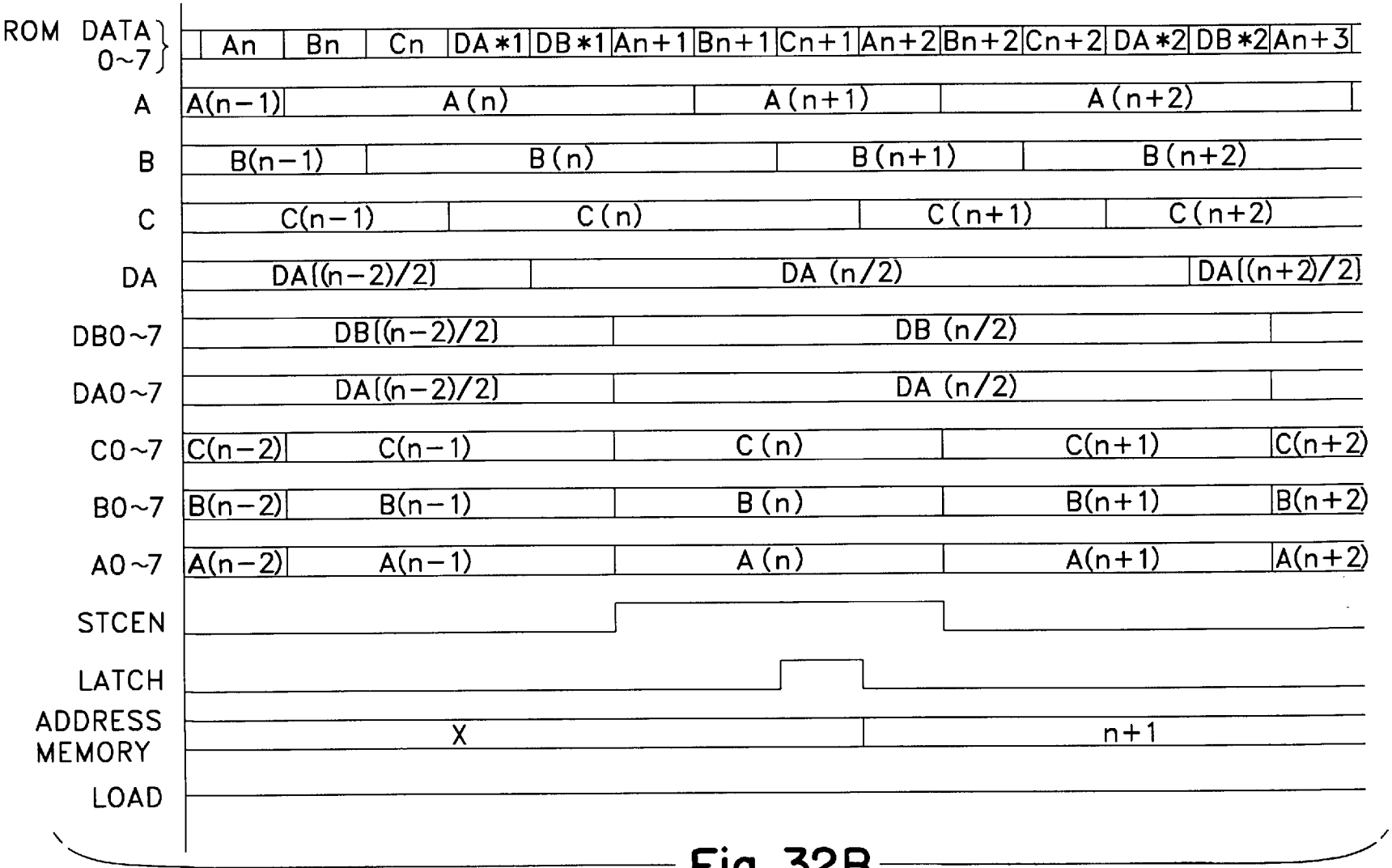
Figure 32C:
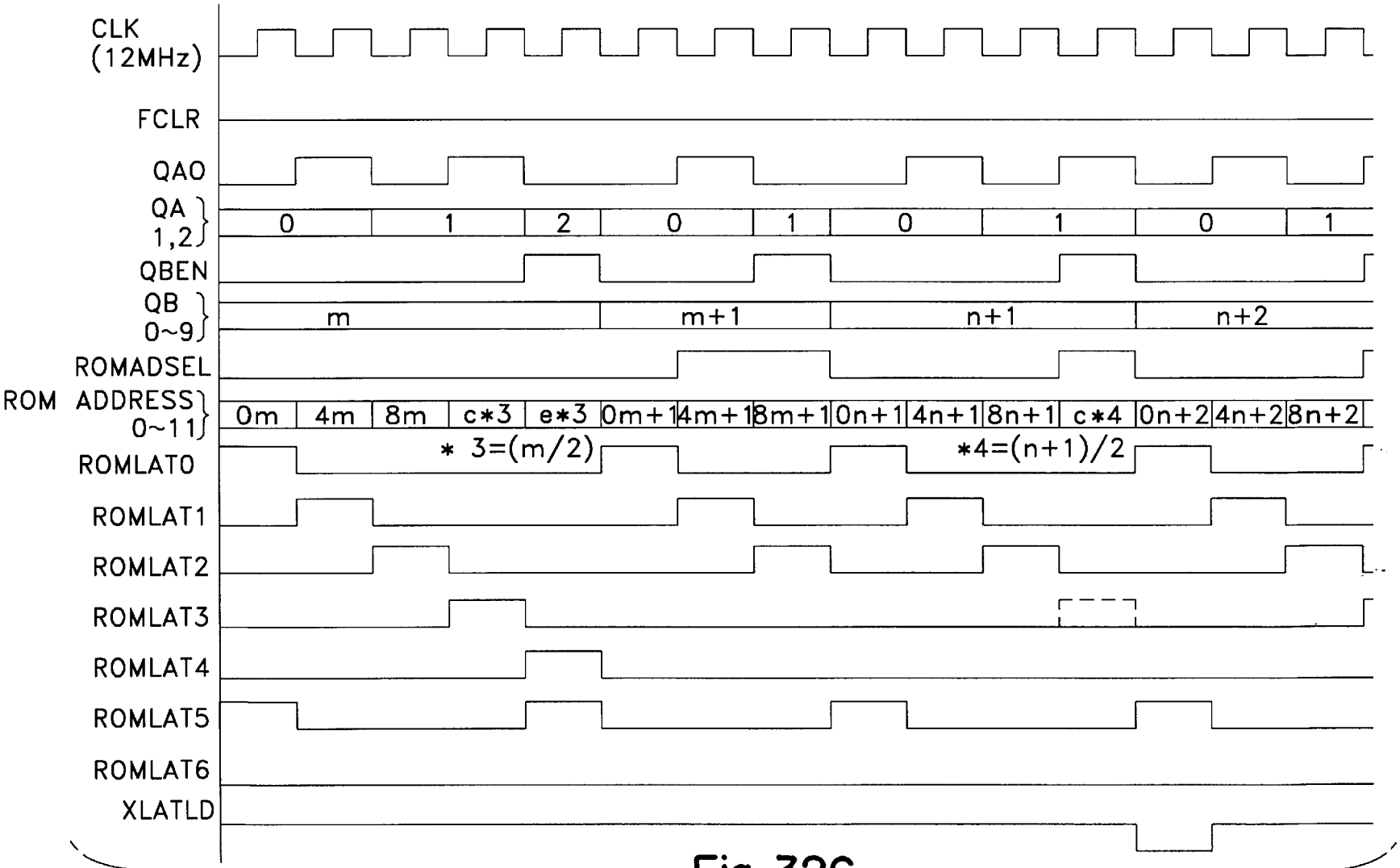
Figure 32D:
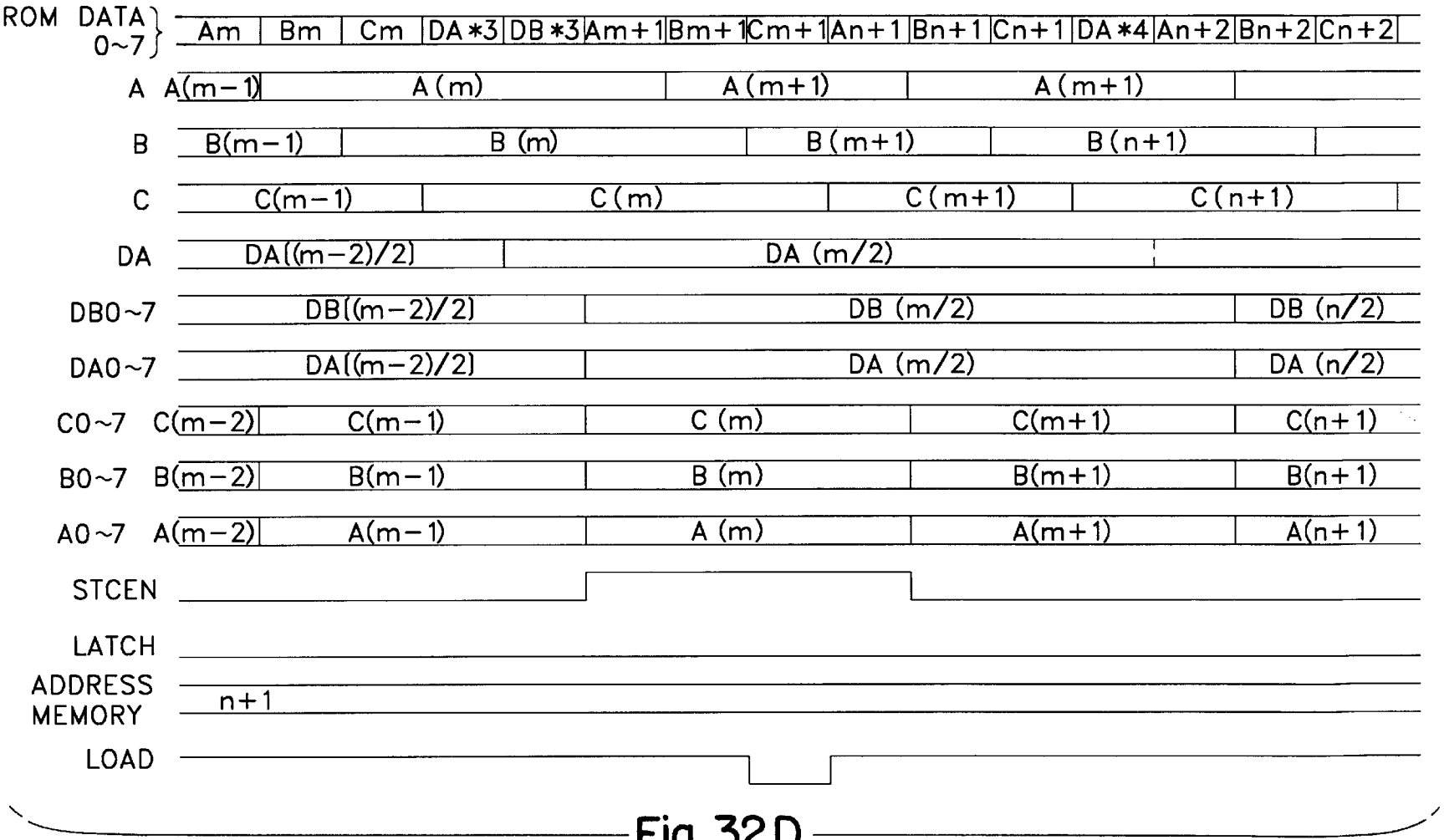

FIGS. 31A to 31B are timing charts for explaining the repetition performed when the start of a repetitive component of a wave is coincident with the cycle of twofold period data but the end thereof is not coincident with the cycle thereof. As illustrated, assume that a value of the signal STCEN indicating the start of the repetitive component is stored at an odd address n in area A, and a value thereof indicating the end of the repetitive component is stored at an odd address m in area A. The operation to be performed in response to the signal STCEN indicating the start of the repetitive component is substantially the same as that in the foregoing example. When the signal STCEN is output at the start of the repetitive component, an address signal n+1 is latched in the address memory unit 94 and a signal ROMLAT6 is output. The latches 974 and 978 hold data DA((n+1)/2) and DB((n+1)/2) according to the signal ROMLAT6.

Data A(m) containing the value of the signal STCEN indicating the end of the repetitive component is read out. The signal STCEN remains high while the data A(m) is being output. In response to the signal STCEN, the control unit 95 outputs a signal Load to the address counter 92A. In response to the signal Load, the address counter 92A loads the address signal n+1 output from the address memory unit 94. When outputting data A(m) is completed, reading data DB((m+1)/2) is completed. Outputting data A(m+1), B(m+1), C(m+1), DA((m+1)/2), and DB((m+1)/2) is started immediately. The next data must be output four cycles of the clock later. Since the address n+1 is loaded to the address counter 92A, reading data A(n+1), B(n+1), C(n+1), DA((n+1)/2), and DB((n+1)/2) is executed in a normal state. However, since it takes five cycles of the clock to complete the reading, data cannot be output in time. Therefore, data A(n+1), B(n+1), and C(n+1) are read out, and data stored at the start of the repetitive component is used as data DA((n+1)/2) and DB((n+1)/2). For this purpose, selectors 972 and 976 are switched over to the latches 974 and 978 so that the data held in the latches 974 and 978 can be selected and output.

FIGS. 32A to 32D are timing charts for explaining repetition performed when the end of a repetitive component of a wave is coincident with the cycle of twofold period data but the start thereof is not coincident with the cycle thereof. As illustrated, assume that a value of a signal STCEN indicating the start of the repetitive component is stored at an even address n in area A and a value thereof indicating the end of the repetitive component is stored at an even address m in area A.

Immediately after data A(n), B(n), C(n), DA(n/2), and DB(n/2) are read out, they are output. While data A(n) is being output, the signal STCEN remains high. In response to the signal STCEN, the control unit 95 output a latch signal Latch to the address memory unit 94 during reading of data C(n+1). Accordingly, the address memory unit 94 latches and holds an address signal n+1 being output at that time. Immediately after that, the latches 974 and 978 holds data DA(n/2) and DB(n/2) according to a signal ROMLAT6.

Data A(m) containing the value of the signal STCEN indicating the end of the repetitive component is read out. The signal STCEN remains high while data A(m) is being output. In response to the signal STCEN, the control unit 95 outputs a signal Load to the address counter 92A. In response to the signal Load, the address counter 92A loads the address signal n+1 output from the address memory unit 94. Reading data C(m+1) is completed by one cycle of the clock earlier than the completion of outputting data A(m). Data A(n+1), B(n+1), and C(n+1) are then read out. However, n+1 denotes an odd number and twofold period data is unavailable. The data stored at the start of the repetitive component is therefore used as data DA(n*2) and DB(n*2); that is, the selectors 972 and 976 are switched over to the latches 974 and 978 so that the data held in the latches 974 and 978 can be selected and output.

Figure 33A:
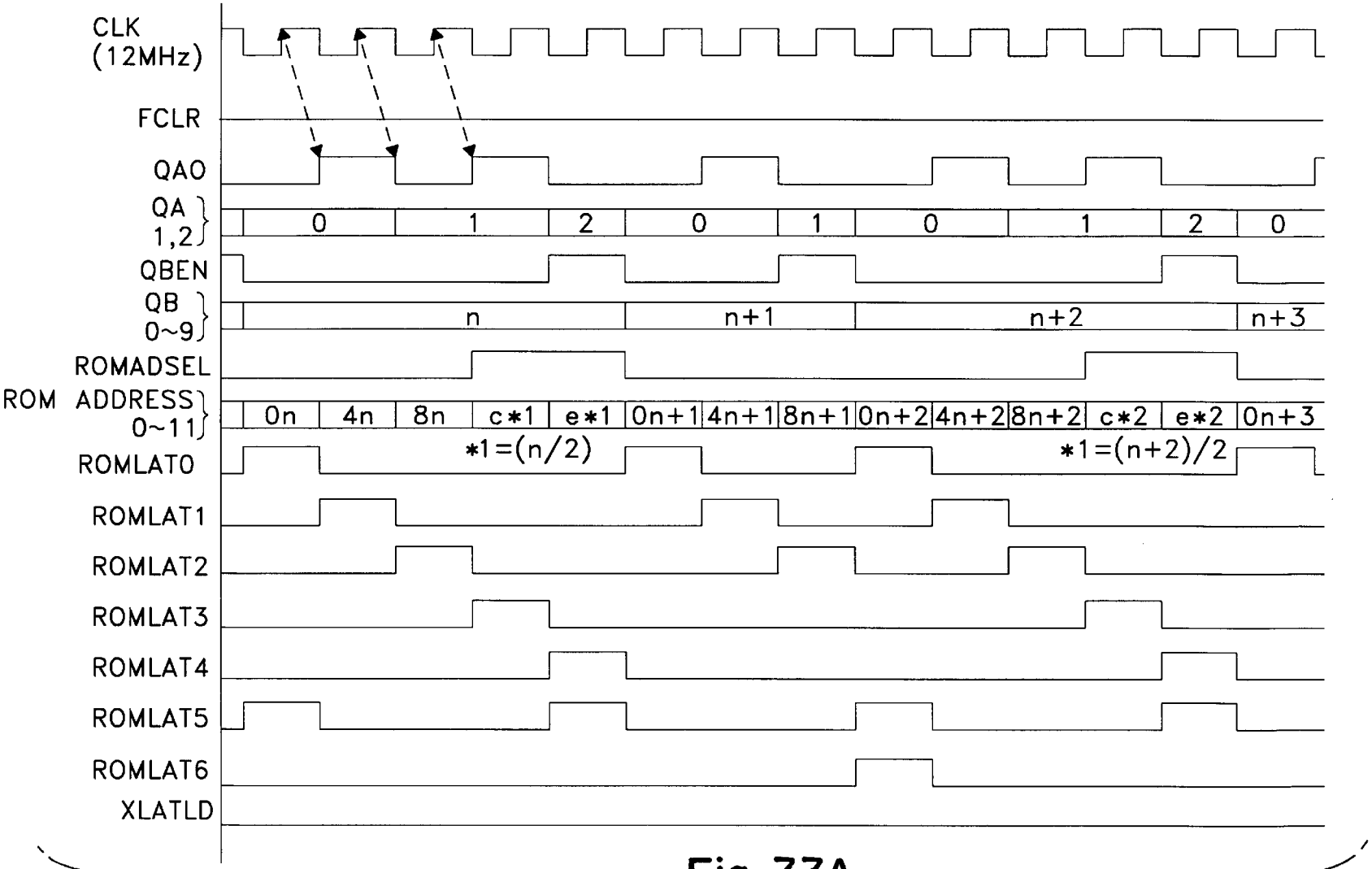
FIGS. 33A, 33B, 33C, and 33D are timing charts showing an operation to be performed when both the start and end of the repetitive component are out of phase with the long period data in the embodiment.
Figure 33B:
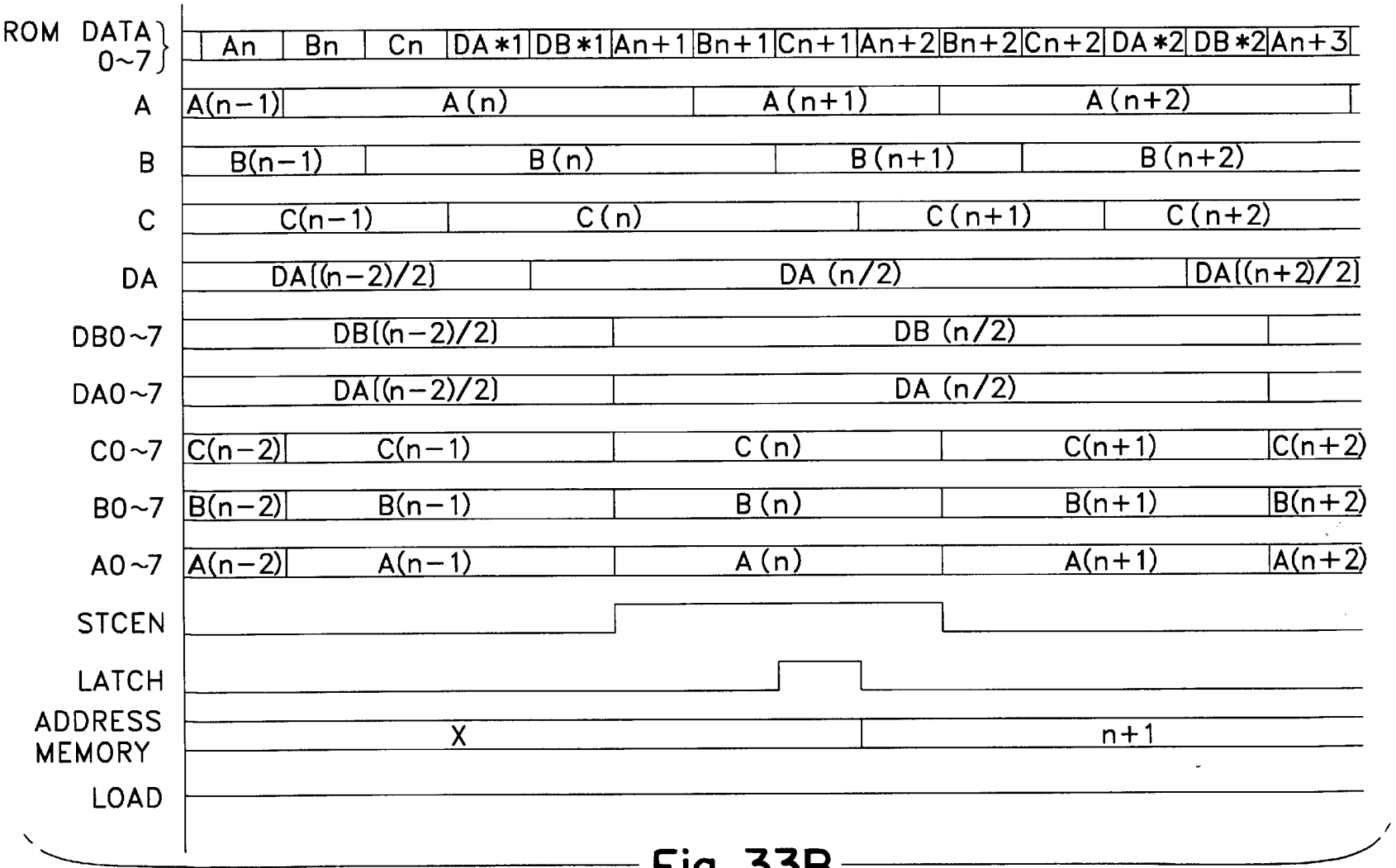
Figure 33C:
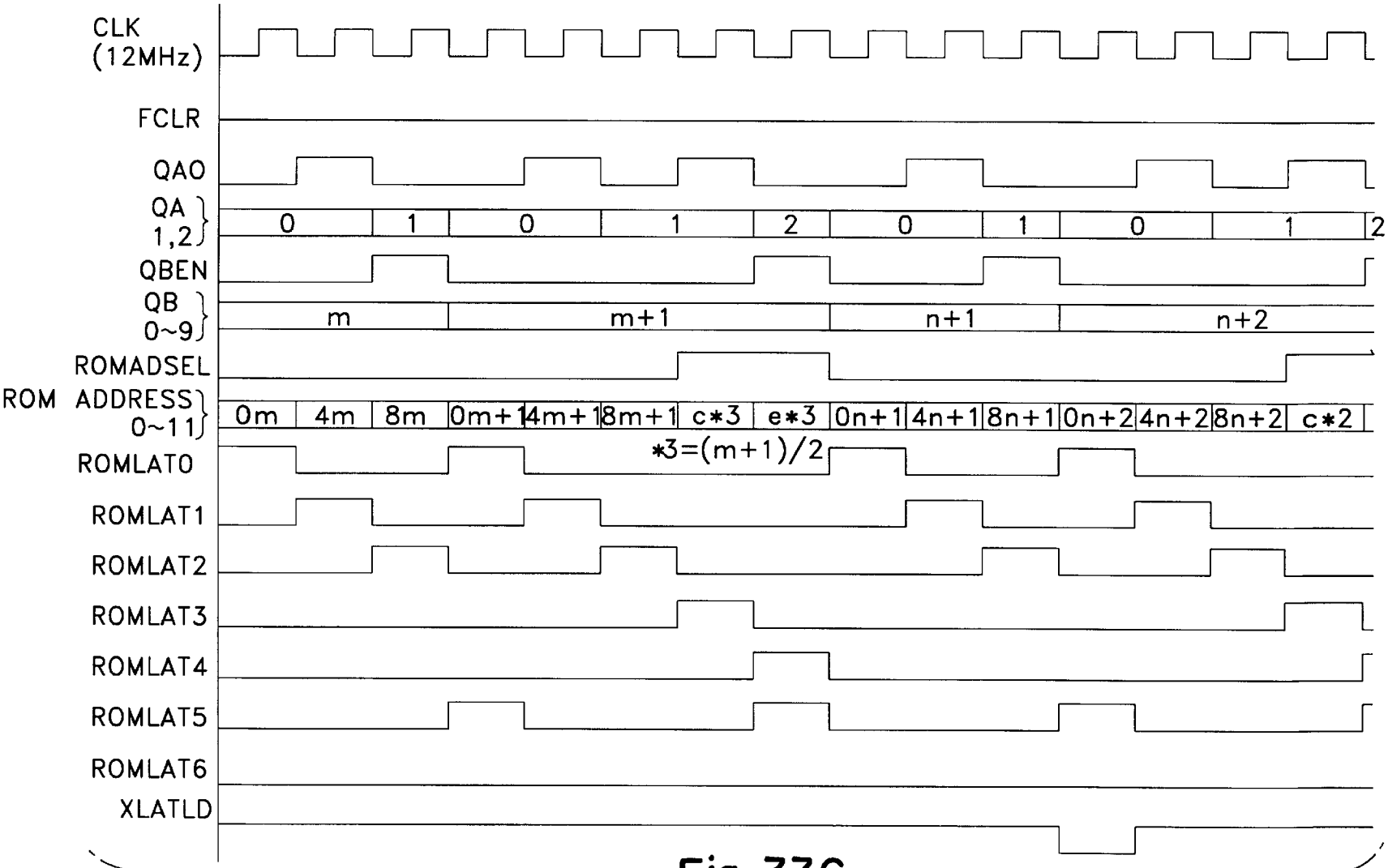
Figure 33D:
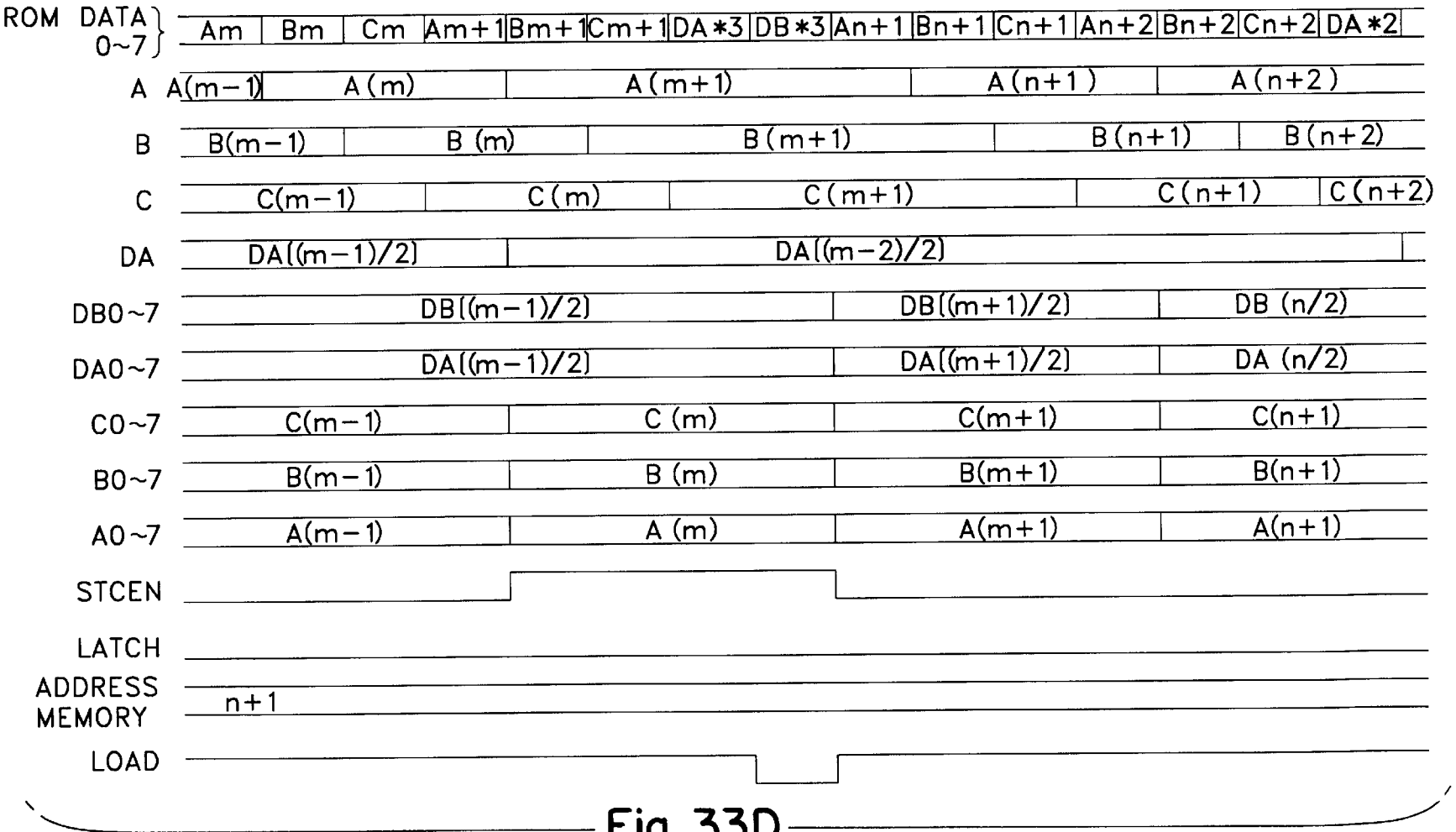

FIGS. 33A and 33B are timing charts for explaining repetition performed when both the start and end of a repetitive component of a wave are not coincident with the cycle of twofold period data. As illustrated, assume that a value of a signal STCEN indicating the start of the repetitive component is stored at an even address n in area A, and a value thereof indicating the end of the repetitive component is stored at an odd address m in area A.

Immediately after data A(n), B(n), C(n), DA(n/2), and DB(n/2) are read out, they are output. While data A(n) is being output, the signal STCEN remains high. In response to the signal STCEN, the control unit 95 outputs a latch signal Latch to the address memory unit 94 during reading of data C(n+1). Immediately after that, the latches 974 and 978 hold data DA(n/2) and DB(n/2) according to a signal ROMLAT6.

Data A(m) containing the value of the signal STCEN indicating the end of the repetitive component is then read out. While data A(m) is being output, the signal STCEN remains high. In response to the signal STCEN, the control unit 95 outputs a signal Load to the address counter 92A. In response to the signal Load, the address counter 92A loads an address signal n+1 output from the address memory unit 94. When outputting data A(m) is completed, reading data DB((m+1)/2) is completed. Outputting data A(m+1), B(m+1), C(m+1), DA((m+1)/2), and DB((m+1)/2) is started immediately. At the same time, data A(n+1), B(n+1), and C(n+1) are read out. However, n+1 denotes an odd number, and twofold period data is unavailable. The data held at the start of the repetitive component is therefore used as data D(n*2) and DB(n*2); that is, the selectors 972 and 976 are switched over to the latches 974 and 978 so that the data held in the latches can be selected and output.

A description has been made by taking, for instance, a mode in which basic period data is split and stored in three areas and twofold period data is split and stored in two areas. Alternatively, the basic period data described in conjunction with FIGS. 23A, 23B, and 24 may be stored in one area and the twofold period data may be split and stored in two areas, or the basic period data may be stored in one area and the three-fold period data may be split and stored in three areas. Various combinations are conceivable.

A wave generating circuit in accordance with the present invention is not limited to a PDP display, but may apply to any unit as long as the unit generates a wave by reading wave data and control data used to control the generation of a wave which are stored in a ROM.

As described above, according to the present invention, an effective quantity of data represented by a driving wave can be expanded without the necessity of increasing the storage capacity of a ROM and of decreasing the output frequency of the driving wave. This makes it possible to control driving by drivers more precisely. Eventually, the quality of a color plasma display panel (PDP) display can be improved.

We claim:

1. A plasma display panel display, comprising:

a plasma display panel including a plurality of cells that are selectively discharged to glow;

a reset circuit for bringing said plurality of cells to a given state;

an addressing circuit for setting said plurality of cells to states associated with display data; and a sustaining discharge circuit for enabling said plurality of cells to glow according to the set states;

said plasma display panel display further comprising:

an operation halt factor detecting circuit for detecting the fact that a factor of halting the operation of said plasma display panel has occurred; and an initializing circuit for selecting an operation from a plurality of operations according to timing when said operation halt factor has occurred and executing the selected operation so that the plurality of cells enter said given state.

2. A plasma display panel display according to claim 1, wherein said initializing circuit inhibits said addressing circuit from setting said plurality of cells to states associated with display data.

3. A plasma display panel display according to claim 1, wherein said initializing circuit inhibits setting of said plurality of cells to states associated with display data after said reset circuit has executed the first reset since occurrence of said factor of halting the operation of said plasma display panel.

4. A plasma display panel display according to claim 1, wherein if it is detected that said operation halt factor has occurred while said addressing circuit is setting said plurality of cells to states associated with display data, said initializing circuit applies an erasure pulse used to erase residual charges from said plurality of cells.

5. A plasma display panel display according to claim 1, wherein if it is detected that said operation halt factor has occurred while said sustaining discharge circuit is enabling said plurality of cells to glow according to the set states, said initializing circuit applies an erasure pulse used to erase residual charges from said plurality of cells.

6. A plasma display panel display according to claim 4, wherein after it is detected that said operation halt factor has occurred, said sustaining discharge circuit executes sustaining discharge at least by one cycle, and then said initializing circuit initializes said plasma display panel.

7. A plasma display panel display according to claim 4, said initializing circuit applies an erasure pulse whose pulse duration is set to permit self-erasure discharge.

8. A plasma display panel display according to claim 5, said initializing circuit applies an erasure pulse whose pulse duration is set to permit self-erasure discharge.

9. A plasma display panel display according to claim 4, wherein said initializing circuit applies an erasure pulse whose pulse duration is set short enough to permit short-duration erasure in which after application of said erasure pulse is stopped, charges on a wall surface and charges of gas are neutralized in each cell.

10. A plasma display panel display according to claim 5, wherein said initializing circuit applies an erasure pulse whose pulse duration is set short enough to permit short-duration erasure in which after application of said erasure pulse is stopped, charges on a wall surface and charges of gas are neutralized in each cell.

11. A plasma display panel display according to claim 4, wherein said initializing circuit applies an erasure pulse whose pulse duration is set long enough to permit long-duration erasure in which after application of said erasure pulse is stopped, a wall voltage in each cell is determined with an application voltage of said erasure pulse.

12. A plasma display panel display according to claim 5, wherein said initializing circuit applies an erasure pulse whose pulse duration is set long enough to permit long-duration erasure in which after application of said erasure pulse is stopped, a wall voltage in each cell is determined with an application voltage of said erasure pulse.

13. A driving method for a plasma display panel including a plurality of cells that are selectively discharge to glow, comprising:

a reset step of bringing said plurality of cells to a given state;

an addressing step of setting said plurality of cells to states associated with display data; and a sustaining discharge step of enabling said plurality of cells to glow according to the set states;

said driving method for a plasma display panel further comprising:

an operation halt factor detecting step of detecting the fact that a factor of halting the operation of said plasma display panel has occurred; and an initializing step of selecting an operation from a plurality of operations according to timing when said operation halt factor has occurred and executing the selected operation so that the plurality of cells enter said given state.

14. A driving method for a plasma display panel according to claim 13, wherein at said initializing step, it is inhibited to set said plurality of cells to states associated with display data.

15. A driving method for a plasma display panel according to claim 13, wherein at said initializing step, after the first reset has been executed since the occurrence of said factor of halting the operation of said plasma display panel, it is inhibited to set said plurality of cells to states associated with display data.

16. A driving method for a plasma display panel according to claim 13, wherein if it is detected, at said addressing step, that said factor of halting the operation of said plasma display panel has occurred, said initializing step is executed by applying an erasure pulse used to erase residual charges from said plurality of cells.

17. A driving method for a plasma display panel according to claim 13, wherein if it is detected at said sustaining discharge step that said factor of halting the operation of said plasma display panel has occurred, said initializing step is executed by applying an erasure pulse used to erase residual charges from said plurality of cells.

18. A driving method for a plasma display panel according to claim 16, wherein after it is detected that said factor of halting the operation of said plasma display panel has occurred, said sustaining discharge step is executed by at least one cycle, and then said initializing step is executed.

19. A driving method for a plasma display panel according to claim 17, wherein after it is detected that said factor of halting the operation of said plasma display panel has occurred, said sustaining discharge step is executed by at least one cycle, and then said initializing step is executed.

20. A driving method for a plasma display panel according to claim 16, wherein the voltage of said erasure pulse is set high so that said initializing step will be self-erasure discharge.

21. A driving method for a plasma display panel according to claim 17, wherein the voltage of said erasure pulse is set high so that said initializing step will be self-erasure discharge.

22. A driving method for a plasma display panel according to claim 16, wherein the pulse duration of said erasure pulse is set so that said initializing step will be short-duration erasure in which, after application of said erasure pulse is stopped, charges on a wall surface and charges of gas are neutralized in each cell.

23. A driving method for a plasma display panel according to claim 17, wherein the pulse duration of said erasure pulse is set so that said initializing step will be short-duration erasure in which, after application of said erasure pulse is stopped, charges on a wall surface and charges of gas are neutralized in each cell.

24. A driving method for a plasma display panel according to claim 16, wherein the pulse duration of said erasure pulse is set so that said initializing step will be long-duration erasure in which after application of said erasure pulse is stopped, wall charges in each cell are determined with an application voltage of said erasure pulse.

25. A driving method for a plasma display panel according to claim 17, wherein the pulse duration of said erasure pulse is set so that said initializing step will be long-duration erasure in which after application of said erasure pulse is stopped, wall charges in each cell are determined with an application voltage of said erasure pulse.

* * * * *

UNITED STATES PATENT AND TRADEMARK OFFICE

CERTIFICATE OF CORRECTION

PATENT NO. : 6,002,381
DATED : December 14, 1999
INVENTOR(S) : Tomio et al.

It is certified that error appears in the above-indentified patent and that said Letters Patent is hereby corrected as shown below:

On the Face of the Patent:

Under "[75] Inventors:" please delete "Akira Yamamoto; Masaya Tajima Toshio Ueda; Hirohito Kuriyama; Katsuhiro Ishida"

Signed and Sealed this

Seventeenth Day of April, 2001

*Attest:*

Nicholas P. Godici

NICHOLAS P. GODICI

*Attesting Officer*

*Acting Director of the United States Patent and Trademark Office*